US008444249B2

(12) United States Patent
Ito et al.

(10) Patent No.: US 8,444,249 B2
(45) Date of Patent: May 21, 2013

(54) DROPLET DISCHARGE DEVICE AND DROPLET DISCHARGE METHOD

(75) Inventors: Tatsuya Ito, Nagano (JP); Yuji Iwata, Nagano (JP); Osamu Kasuga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/478,300

(22) Filed: May 23, 2012

(65) Prior Publication Data

US 2012/0229548 A1 Sep. 13, 2012

Related U.S. Application Data

(62) Division of application No. 12/471,078, filed on May 22, 2009, now Pat. No. 8,205,957.

(30) Foreign Application Priority Data

May 28, 2008 (JP) ..... 2008-139051

(51) Int. Cl.
*B41J 29/393* (2006.01)
*B41J 29/38* (2006.01)

(52) U.S. Cl.
USPC ..... 347/19; 347/9; 347/14; 347/17

(58) Field of Classification Search
USPC ..... 347/9, 14, 17, 19
See application file for complete search history.

(56) References Cited

U.S. PATENT DOCUMENTS

2009/0002426 A1 1/2009 Jung et al.

FOREIGN PATENT DOCUMENTS

| | | | |
|---|---|---|---|
| JP | 08-295015 | A | 11/1996 |
| JP | 09-141849 | A | 6/1997 |
| JP | 2001-080057 | A | 3/2001 |
| JP | 2002-059563 | A | 2/2002 |
| JP | 2003-136758 | A | 5/2003 |
| JP | 2003-279725 | A | 10/2003 |
| JP | 2004-209429 | A | 7/2004 |
| JP | 2008-126175 | A | 6/2008 |

*Primary Examiner* — Jannelle M Lebron
(74) *Attorney, Agent, or Firm* — Global IP Counselors, LLP

(57) ABSTRACT

A droplet discharge device includes: a discharge unit discharging a droplet and being moved relatively to a discharged object, on which the droplet is discharged, so as to form a predetermined pattern on the discharged object; a discharge amount measurement unit measuring a discharge amount of the droplet discharged from the discharge unit; a temperature acquisition unit acquiring a temperature of the droplet in the formation of the predetermined pattern; a temperature adjustment unit adjusting the temperature of the discharge unit; and a discharge amount adjustment unit adjusting the discharge amount of the discharge unit. In the device, the temperature adjustment unit adjusts a temperature of the droplet in the measurement of the discharge amount by the discharge amount measurement unit to the temperature in the formation of the predetermined pattern.

24 Claims, 23 Drawing Sheets

DROPLET DISCHARGE DEVICE AND DROPLET DISCHARGE METHOD

CROSS-REFERENCE TO RELATED APPLICATIONS

This is a divisional application of U.S. patent application Ser. No. 12/471,078, now pending. This application also claims priority to Japanese Patent Application No. 2008-139051 filed on May 28, 2008. The entire disclosures of U.S. patent application Ser. No. 12/471,078 and Japanese Patent Application No. 2008-139051 are hereby incorporated herein by reference.

BACKGROUND

1. Technical Field

The present invention relates to a droplet discharge device including a discharge head having a discharge nozzle for discharging a droplet, and a droplet discharge method by the droplet discharge device.

2. Related Art

As a technique of forming a functional film such as a color filter of a color liquid crystal device, the following technique of forming a functional film by using a droplet discharge device is known. The droplet discharge device is provided with a droplet discharge head which discharges a droplet as droplets. In the technique, a droplet containing a material of the functional film is discharged as droplets so as to land on an arbitrary position on a substrate which serves as a processing object. Thus the droplet is arranged on the arbitrary position. Then, in the technique, the droplet arranged is dried so as to form the functional film. The droplet discharge head of the droplet discharge device used in such film formation can selectively discharge a minute droplet from its discharge nozzle and allow the droplet to land with a high positional accuracy so as to be able to form a film having a precise planar shape and a precise film thickness.

In order to form a functional film with higher functionality, it is required to realize a functional film having more precise planar shape and more precise film thickness. In order to form a functional film having a uniform film thickness, it is required to maintain a constant discharge amount of a functional liquid discharged from a discharge nozzle. The discharge amount means a size (volume) of a droplet discharged from the droplet discharge head or an amount discharged in a unit time from the discharge head which performs continuous discharge. A weight of a functional liquid corresponding to the discharge amount is referred to as a discharge weight. Discharge of a droplet toward a processing object is referred to as drawing discharge, and an approximate continuous discharge step including the drawing discharge is referred to as a drawing discharge step.

It is known that a viscosity of a droplet varies depending on a temperature. In a droplet discharge device, the variation of viscosity of the droplet varies flow resistance of the droplet, so that there is a possibility that the discharge amount varies. That is, there has been such a problem that the discharge amount from the droplet discharge device varies due to the variation of the temperature of the discharge device.

JP-A-2004-209429 as an example discloses a droplet discharge system that realizes a uniform discharge amount. The system realizes the uniform discharge amount such that a droplet discharge device is disposed in a chamber so as to maintain a temperature of the atmosphere approximately constant, and at the same time, a discharge weight is measured so as to adjust the discharge amount depending on the measurement result.

However, various driving sources for driving the discharge device of the droplet discharge device release heat as a heat source in many cases, so that the sources highly likely vary the temperature of the discharge device. Further, there is a possibility that a member that generates no heat such as a processing object and a droplet which is to be supplied to the discharged device absorbs heat, possibly varying the temperature of the discharge device. Even though the temperature of the atmosphere is maintained approximately constant as the droplet discharge system disclosed in the above example, there is a possibility that temperatures of the discharge device and the droplet vary during the drawing discharge step in which the processing object and the droplet are supplied and the discharge device is driven. The discharge amount may vary during the drawing discharge step due to the variation of the temperature during the drawing discharge step. In the same manner, the temperatures of the discharge device and the droplet may different between in the drawing discharge step and in the measurement of the discharge weight. Due to the difference, there is a possibility that the discharge amount obtained by measuring the discharge weight is not always a precise discharge amount in the drawing discharge step.

SUMMARY

The invention is proposed in order to solve the above-mentioned problems and can be achieved as the following aspects.

A droplet discharge device according to a first aspect of the invention includes: a discharge unit discharging a droplet and being moved relatively to a discharged object, on which the droplet is discharged, so as to form a predetermined pattern on the discharged object; a discharge amount measurement unit measuring a discharge amount of the droplet discharged from the discharge unit; a temperature acquisition unit acquiring a temperature in the formation of the predetermined pattern, of the droplet; a temperature adjustment unit adjusting the temperature of the droplet; and a discharge amount adjustment unit adjusting the discharge amount of the discharge unit. In the device, the temperature adjustment unit adjusts a temperature of the droplet in the measurement of the discharge amount by the discharge amount measurement unit to the temperature in the formation of the predetermined pattern.

According to the droplet discharge device of the first aspect, the temperature adjustment unit adjusts the temperature of the droplet in the measurement of the discharge amount by the discharge amount measurement unit to the temperature in the formation of the predetermined pattern, which is acquired by the temperature acquisition unit. The discharge amount that is an amount of the droplet discharged per unit time from the discharge unit or a volume of a discharged droplet is influenced by the temperature of the droplet. The discharge amount measurement unit measures the discharge amount in such state that the temperature of the droplet is the temperature in the formation of the predetermined pattern. Therefore, when the discharge amount is measured, the discharge amount in the formation of the predetermined pattern is highly likely duplicated in a precise manner. Thus, the discharge amount in the formation of the predetermined pattern can be more precisely measured, compared to a case without performing the temperature adjustment of the droplet by the temperature adjustment unit. By adjusting the discharge amount by the discharge amount adjustment unit depending on the discharge amount precisely measured, the discharge amount difference, which is caused by a temperature difference of the droplet between in the formation of the predetermined pattern and in the measurement of the discharge amount, is suppressed, being able to realize the formation of the predetermined pattern with precise discharge amount.

As the temperature of the droplet, the temperature of the droplet in a hole, from which the droplet is discharged, of the discharge unit, the temperature of the droplet in a pressure chamber that applies discharge pressure to the droplet, the temperature of the droplet in a flowing path of the droplet, or the temperature of the droplet immediately before supplied to the discharge unit may be employed arbitrarily. In any of these parts, the temperature of the droplet in the formation of the predetermined pattern by the discharge unit is acquired and the temperature of the droplet at the starting time of the formation of the predetermined pattern is adjusted to the temperature in the formation of the predetermined pattern, which is acquired by the temperature acquisition unit.

In the droplet discharge device according to the above aspect, it is preferable that the discharge unit include a plurality of nozzle groups each having one or more discharge nozzles; the discharge amount measurement unit measure the discharge amount of the droplet at each of the nozzle groups; the temperature acquisition unit acquire a temperature of the droplet in the formation of the predetermined pattern at each of the nozzle groups; the temperature adjustment unit adjust the temperature of the droplet at each of the nozzle groups; and the discharge amount adjustment unit adjust a discharge amount of each of the nozzle groups.

According to the device, the discharge amount difference, which is caused by a temperature difference of the droplet between in the formation of the predetermined pattern and in the measurement of the discharge amount, is suppressed, being able to realize the formation of the predetermined pattern with precise discharge amount. Therefore, even if temperatures of the discharge nozzles of the droplet discharge device are different from each other, precise measurement and precise adjustment of the discharge amount can be performed, compared to a case of measuring and adjusting the discharge amount for all of the discharge nozzles at once.

In the droplet discharge device according to the above aspect, it is preferable that the nozzle groups have a common path for supplying the droplet to each of the discharge nozzles of the discharge groups.

According to the device, the measurement and the adjustment of the discharge amount can be performed to the discharge nozzles all at once which have the common path for supplying the droplet. It is highly possible that the state of the droplet to be supplied is nearly same in the discharge nozzles having the common path for supplying the droplet, so that the peripheries of respective discharge nozzles highly likely have small temperature difference from each other, or the droplet at the peripheries of the discharge nozzles highly likely has small temperature difference at each of the peripheries of the nozzles. Thus the measurement and the adjustment of the discharge amount are performed with respect to the discharge nozzles, having small temperature difference from each other, all at once, of the nozzle group. Therefore, the measurement and adjustment of the discharge amount can be efficiently performed without degrading the accuracy of the measurement and the adjustment of the discharge amount, compared to a case of performing the measurement and the adjustment of the discharge amount individually.

In the droplet discharge device according to the above aspect, it is preferable that the nozzle groups be composed of discharge nozzles provided to one discharge head having the one or more discharge nozzles.

According to the device, the measurement and the adjustment of the discharge amount can be performed for the discharge nozzles of one discharge head all at once. One discharge head is commonly a unit for being independently moved or discharge-controlled. Therefore, the peripheries of respective discharge nozzles of the discharge head highly likely have small temperature difference from each other or the droplet at the peripheries of the discharge nozzles highly likely has small temperature difference at each of the peripheries of the nozzles. Thus the measurement and the adjustment of the discharge amount are performed with respect to the discharge nozzles, having small temperature difference from each other, all at once, of the nozzle group. Therefore, the measurement and adjustment of the discharge amount can be efficiently performed without degrading the accuracy of the measurement and the adjustment of the discharge amount, compared to a case of performing the measurement and the adjustment of the discharge amount individually.

In the droplet discharge device according to the above aspect, it is preferable that a single kind of the droplet be supplied to each of the discharge nozzles of the discharge groups.

According to the device, the measurement and the adjustment of the discharge amount can be performed for all of the discharge nozzles at once to which the single kind of the droplet is supplied. It is highly likely that the characteristic of the droplet is originally same and the characteristic and the state of the droplet are common in the respective discharge nozzles to which the single kind of droplet is supplied, the peripheries of respective discharge nozzles highly likely have small temperature difference from each other or the droplet at the peripheries of the discharge nozzles highly likely has small temperature difference at each of the peripheries of the nozzles. Thus the measurement and the adjustment of the discharge amount are performed with respect to the discharge nozzles, having small temperature difference from each other, all at once, of the nozzle group. Therefore, the measurement and adjustment of the discharge amount can be efficiently performed without degrading the accuracy of the measurement and the adjustment of the discharge amount, compared to a case of performing the measurement and the adjustment of the discharge amount individually.

In the droplet discharge device according to the above aspect, it is preferable that the temperature adjustment unit adjust the temperature of the droplet to the temperature in the formation of the predetermined pattern by warm-up driving the discharge unit.

According to the device, due to the warm-up drive of the discharge unit, the temperature of the discharge unit or the droplet can be set to be the temperature in the formation of the predetermined pattern, without separately providing a temperature adjustment device. Here, the driving state in which the discharge unit is warm-up driven is a driving state including a case where the discharge unit is driven so as to discharge the droplet in a normal state and a case where the discharge unit is driven to an extent that the droplet is not discharged.

In the droplet discharge device according to the above aspect, it is preferable that the temperature acquisition unit perform the warm-up drive under two or more kinds of warm-up drive conditions of the warm-up drive so as to estimate a temperature in the formation of the predetermined pattern.

According to the device, the warm-up drive is performed under the different kinds of warm-up drive conditions. In a case where the warm-up drive is performed under the different kinds of warm-up drive conditions, the state of the temperature change occurred from the warm-up drive differs among the warm-up drive conditions. By comparing the different kinds of temperature change states, the temperature in the formation of the predetermined pattern can be estimated.

The droplet discharge device according to the above aspect further includes: a warm-up condition setting unit obtaining a warm-up condition of the warm-up drive. In the device, it is preferable that the warm-up condition setting unit perform the warm-up drive under two or more different kinds of warm-up drive conditions so as to estimate the warm-up drive condition under which the temperature of the droplet becomes the temperature in the formation of the predetermined pattern by performing the warm-up drive.

According to the device, the warm-up drive is performed under the different kinds of warm-up drive conditions. In a case where the warm-up drive is performed under the different kinds of warm-up drive conditions, the state of the temperature change occurred from the warm-up drive differs among the warm-up drive conditions. The temperature in the formation of the predetermined pattern can be estimated by comparing the different kinds of temperature change states, so that the driving condition under which the temperature in the formation of the predetermined pattern can be realized can be estimated.

In the droplet discharge device according to the above aspect, it is preferable that the temperature adjustment unit further include a first temperature measurement unit measuring the temperature of the droplet, and adjust the temperature of the droplet to the temperature in the formation of the predetermined pattern by allowing the discharge unit to perform the warm-up drive depending on a measured result of the first temperature measurement unit.

According to the device, the discharge unit is allowed to perform the warm-up drive depending on the measured result of the temperature measurement unit so as to adjust the temperature of the discharge unit or the droplet. Therefore, an actual temperature, which is measured by the temperature measurement unit, of the discharge unit or the droplet can be securely adjusted to the temperature in the formation of the predetermined pattern.

In the droplet discharge device according to the above aspect, it is preferable that the temperature adjustment unit be one of a heating unit and a cooling unit, and adjust the temperature of the droplet to the temperature in the formation of the predetermined pattern by heating or cooling the droplet.

According to the device, the temperature of the discharge unit or the droplet can be securely changed to be adjusted to the temperature in the formation of the predetermined pattern by heating or cooling the discharge unit or the droplet by the heating unit or the cooling unit.

The droplet discharge device according to the above aspect, it is preferable that the temperature acquisition unit adjust the temperature of the droplet at a starting time of the formation of the predetermined pattern to two or more different kinds of temperatures, and estimate the temperature in the formation of the predetermined pattern based on a temperature change in the formation of the predetermined pattern in each case of the different kinds of temperatures.

According to the device, the formation of the predetermined pattern is started at different temperatures of the discharge unit or the droplet. The difference of the temperatures at the starting time of the formation of the predetermined pattern brings different behaviors of the temperatures of the discharge unit or the droplet in the formation of the predetermined pattern. By comparing different kinds of temperature changes, the temperature in the formation of the predetermined pattern can be estimated.

In the droplet discharge device according to the above aspect, it is preferable that the temperature adjustment unit further include a second temperature measurement unit measuring the temperature of the droplet, and one of the heating unit and the cooling unit heat or cool the droplet depending on a measured result of the second temperature measurement unit so as to adjust the temperature of the droplet to the temperature in the formation of the predetermined pattern.

According to the device, the heating unit or the cooling unit heats or cools the discharge unit or the droplet depending on the measured result of the temperature measurement unit. Therefore, an actual temperature, which is measured by the temperature measurement unit, of the discharge unit or the droplet can be securely adjusted to the temperature in the formation of the predetermined pattern.

A droplet discharge method, according to a second aspect of the invention, by which a discharge unit discharging a droplet is relatively moved to a discharged object on which the droplet is discharged, so as to form a predetermined pattern on the discharged object includes: a) acquiring a temperature of the droplet in the formation of the predetermined pattern; b) adjusting the temperature of the droplet; c) measuring a discharge amount of the droplet discharged from the discharge unit; and d) adjusting the discharge amount of the discharge unit. In the method, in the step b), a temperature of the discharge unit in performing the step c) is adjusted to the temperature in the formation of the predetermined pattern.

According to the droplet discharge method of the second aspect, the temperature of the droplet in the step c) is adjusted to the temperature, which is acquired in the step a), in the formation of the predetermined pattern, in the step b). The discharge amount that is an amount of the droplet discharged per unit time from the discharge unit or a volume of a discharged droplet is influenced by the temperature of the droplet which is discharged. The discharge amount is measured in the step c) in such state that the temperature of the droplet is the temperature in the formation of the predetermined pattern. Therefore, when the discharge amount is measured in the step c), the discharge amount in the formation of the predetermined pattern is highly likely duplicated in a precise manner. Accordingly, the discharge amount in the formation of the predetermined pattern can be more precisely measured, compared to a case without performing the temperature adjustment of the discharge unit. By adjusting the discharge amount in the step d) depending on the discharge amount precisely measured, the discharge amount difference, which is caused by a temperature difference of the discharge unit between in the formation of the predetermined pattern and in the measurement of the discharge amount, is suppressed, being able to realize the formation of the predetermined pattern with precise discharge amount.

As the temperature of the droplet, the temperature of the droplet in a hole, from which the droplet is discharged, of the discharge unit, the temperature of the droplet in a pressure chamber that applies discharge pressure to the droplet, the temperature of the droplet in a flowing path of the droplet, or the temperature of the droplet immediately before supplied to the discharge unit may be employed arbitrarily. In any of these parts, the temperature of the droplet in the formation of the predetermined pattern by the discharge unit is acquired and the temperature of the droplet at the starting time of the formation of the predetermined pattern is adjusted to the temperature in the formation of the predetermined pattern, which is acquired by the temperature acquisition unit.

In the droplet discharge method according to the above aspect, it is preferable that the discharge unit include a plurality of nozzle groups each having one or more discharge nozzles; a temperature of the droplet in the formation of the predetermined pattern be acquired at each of the nozzle groups in step a); the temperature of the droplet be adjusted at each of the nozzle groups in the step b); the discharge amount of the droplet be measured at each of the nozzle groups in the step c); and a discharge amount in each of the nozzle groups is adjusted in the step d).

According to the method, the discharge amount difference, which is caused by a temperature difference of the droplet between in the formation of the predetermined pattern and in the measurement of the discharge amount, is suppressed in the step c), being able to realize the formation of the predetermined pattern with precise discharge amount. Therefore, even if temperatures of the discharge nozzles of the discharge unit are different from each other, precise measurement and precise adjustment of the discharge amount can be performed, compared to a case of measuring and adjusting the discharge amount for all of the discharge nozzles at once.

In the droplet discharge method according to the above aspect, it is preferable that the nozzle groups have a common path for supplying the droplet to each of the discharge nozzles of the discharge groups.

According to the method, the measurement and the adjustment of the discharge amount can be performed to the discharge nozzles all at once which have the common path for supplying the droplet. It is highly possible that the state of the droplet to be supplied is nearly same in the discharge nozzles having the common path for supplying the droplet, so that the peripheries of respective discharge nozzles highly likely have small temperature difference from each other, or the droplet at the peripheries of the discharge nozzles highly likely has small temperature difference at each of the peripheries of the nozzles. Thus the measurement and the adjustment of the discharge amount are performed with respect to the discharge nozzles, having small temperature difference from each other, all at once, of the nozzle group. Therefore, the measurement and adjustment of the discharge amount can be efficiently performed without degrading the accuracy of the measurement and the adjustment of the discharge amount, compared to a case of performing the measurement and the adjustment of the discharge amount individually.

In the droplet discharge method according to the above aspect, it is preferable that the discharge nozzles of the nozzle groups be discharge nozzles provided to one discharge head having one or more discharge nozzles.

According to the method, the measurement and the adjustment of the discharge amount can be performed at the discharge nozzles of one discharge head all at once. One discharge head is commonly a unit for being independently moved or discharge-controlled. Therefore, the peripheries of respective discharge nozzles of the discharge head highly likely have small temperature difference from each other or the droplet at the peripheries of the discharge nozzles highly likely has small temperature difference at each of the peripheries of the nozzles. Thus the measurement and the adjustment of the discharge amount are performed with respect to the discharge nozzles, having small temperature difference from each other, all at once, of the nozzle group. Therefore, the measurement and adjustment of the discharge amount can be efficiently performed without degrading the accuracy of the measurement and the adjustment of the discharge amount, compared to a case of performing the measurement and the adjustment of the discharge amount individually.

In the droplet discharge method according to the above aspect, it is preferable that a single kind of the droplet be supplied to each of the discharge nozzles of the discharge groups.

According to the method, the measurement and the adjustment of the discharge amount can be performed for all of the discharge nozzles at once to which the single kind of the droplet is supplied. It is highly likely that the characteristic of the droplet is originally same and the characteristic and the state of the droplet are common in the respective discharge nozzles to which the single kind of droplet is supplied, so that the peripheries of respective discharge nozzles highly likely have small temperature difference from each other or the droplet at the peripheries of the discharge nozzles highly likely has small temperature difference at each of the peripheries of the nozzles. Thus the measurement and the adjustment of the discharge amount are performed with respect to the discharge nozzles, having small temperature difference from each other, all at once, of the nozzle group. Therefore, the measurement and adjustment of the discharge amount can be efficiently performed without degrading the accuracy of the measurement and the adjustment of the discharge amount, compared to a case of performing the measurement and the adjustment of the discharge amount individually.

In the droplet discharge method according to the above aspect, it is preferable the temperature of the droplet be adjusted to the temperature in the formation of the predetermined pattern by warm-up driving the discharge unit, in the step b).

According to the method, due to the warm-up drive of the discharge unit, the temperature of the discharge unit or the droplet can be set to be the temperature in the formation of the predetermined pattern, without separately providing a temperature adjustment device. Here, the driving state in which the discharge unit is warm-up driven is a driving state including a case where the discharge unit is driven so as to discharge the droplet in a normal state and a case where the discharge unit is driven to an extent that the droplet is not discharged.

In the droplet discharge method according to the above aspect, it is preferable that the step a) include e) forming the predetermined pattern after the warm-up drive is performed under a first warm-up drive condition, and f) forming the predetermined pattern after the warm-up drive is performed under a second warm-up drive condition that is different from the first warm-up drive condition, and the temperature in the formation of the predetermined pattern be estimated depending on a temperature change of the droplet in the formation of the predetermined pattern in each of the step e) and the step f).

According to the method, the steps e) and f) are performed after the warm-up drive is performed under different kinds of warm-up drive conditions. In a case where the warm-up drive is performed under the different kinds of warm-up drive conditions, the state of the temperature change occurred from the warm-up drive and a reached temperature differ among the warm-up drive conditions. Therefore, the temperature at the start of the formation of the predetermined pattern differs among the warm-up drive conditions. In the formation of the predetermined pattern with the different starting temperatures, the temperature change states are different from each other. By comparing the different kinds of temperature change states, the temperature in the formation of the predetermined pattern can be estimated.

The droplet discharge method according to the above aspect, further includes: g) setting a warm-up drive condition of the warm-up drive. It is preferable that the step g) include h) forming the predetermined pattern after the warm-up drive is performed under a first warm-up drive condition; i) forming the predetermined pattern after the warm-up drive is performed under a second warm-up drive condition that is different from the first warm-up drive condition; and j) estimating the warm-up drive condition under which the temperature of the droplet becomes the temperature in the formation of the predetermined pattern, based on a temperature change of the droplet in the formation of the predetermined pattern in each of the step h) and the step i).

According to the method, the steps h) and i) are performed after the warm-up drive is performed under different kinds of warm-up drive conditions. In a case where the warm-up drive is performed under the different kinds of warm-up drive conditions, the state of the temperature change occurred from the warm-up drive and a reached temperature differ among the warm-up drive conditions. Therefore, the temperatures at the start of the steps h) and i) differ between the warm-up drive conditions. In the steps h) and i) with the different starting temperatures, the temperature change states are different from each other. The temperature in the formation of the predetermined pattern can be estimated by comparing the different kinds of temperature change states, so that the driving condition under which the temperature in the formation of the predetermined pattern can be realized can be estimated.

In the droplet discharge method according to the above aspect, it is preferable that the step b) further include k) measuring the temperature of the droplet, and the discharge unit be warm-up driven depending on a measured result in the step k) so as to adjust the temperature of the droplet to the temperature in the formation of the predetermined pattern.

According to the device, the discharge unit is allowed to perform the warm-up drive depending on the measured result of the step k) of the temperature so as to adjust the temperature of the discharge unit or the droplet. Therefore, an actual temperature, which is measured in the step k), of the discharge unit or the droplet can be securely adjusted to the temperature in the formation of the predetermined pattern.

In the droplet discharge method according to the above aspect, it is preferable that the temperature of the droplet be adjusted to the temperature in the formation of the predetermined pattern by heating or cooling the droplet, in the step b).

According to the method, the temperature of the discharge unit or the droplet can be securely changed to be adjusted to the temperature in the formation of the predetermined pattern by heating or cooling the discharge unit or the droplet.

The droplet discharge method according to the above aspect, it is preferable that the temperature of the droplet at a starting time of the formation of the predetermined pattern be adjusted to two or more different kinds of temperatures, and the temperature in the formation of the predetermined pattern be estimated based on a temperature change in the formation of the predetermined pattern in each case of the temperatures, in the step a).

According to the method, the formation of the predetermined pattern is started at different temperatures of the discharge unit or the droplet. The difference of the temperatures at the starting time of the formation of the predetermined pattern brings different behaviors of the temperatures of the discharge unit or the droplet in the formation of the predetermined pattern. By comparing different kinds of temperature changes, the temperature in the formation of the predetermined pattern can be estimated.

In the droplet discharge method according to the above aspect, it is preferable that the step b) further include l) measuring the temperature of the droplet, and the droplet be heated or cooled depending on a measured result of the step l) so as to adjust the temperature of the droplet to the temperature in the formation of the predetermined pattern.

According to the method, the discharge unit or the droplet is heated or cooled depending on the measured result of the step l) of the temperature. Therefore, an actual temperature, which is measured in the step l), of the discharge unit or the droplet can be securely adjusted to the temperature in the formation of the predetermined pattern.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
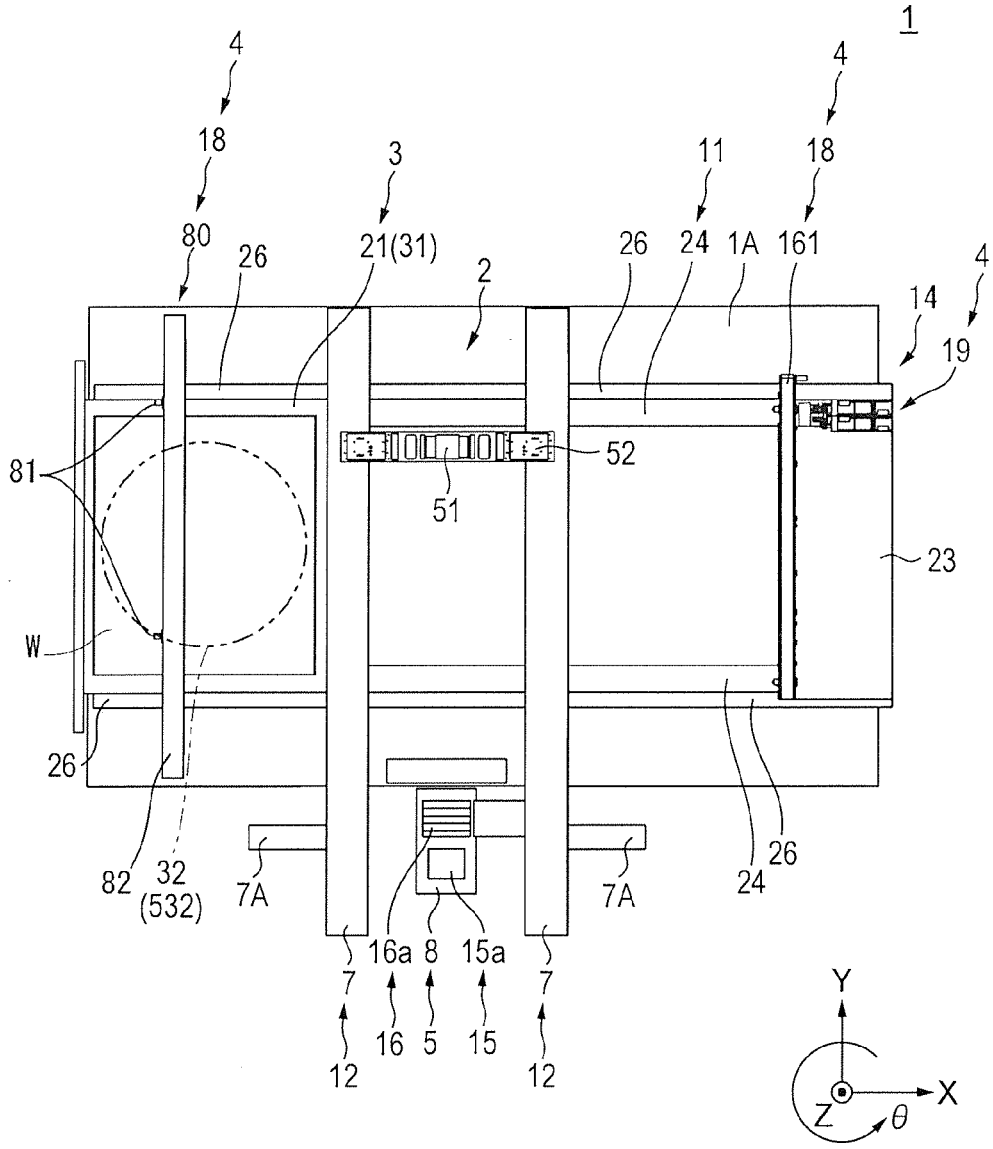
FIG. 1 is a plan view schematically showing a structure of a droplet discharge device according to a first embodiment.

Hereinafter, preferred embodiments of a droplet discharge device, a method for discharging a droplet, an electro-optical device manufacturing device, a method for manufacturing an electro-optical device, an electronic apparatus manufacturing device, and a method for manufacturing an electronic apparatus manufacturing device will be described with reference to the accompanying drawings. The embodiments will be described with an example of a process for forming a color element film (a filter film) constituting a color filter with a droplet discharging device that employs an inkjet method. The color filter is provided to a substrate of a liquid crystal display device that is an example of the electro-optical device. The droplet discharge device is an example of the droplet discharging device. Note that the drawings referred to in the following descriptions sometimes show members or portions having different horizontal and vertical ratios from the actual members or portions for the sake of illustration.

First Embodiment

A droplet discharge device as a droplet discharge device according to a first embodiment is used in a manufacturing line of a liquid crystal device and used for forming a color element film of a color filter. The color element film is formed such that a functional liquid is arranged on a glass substrate, for example, as an object to be drawn (an object to be processed) with a droplet discharge head employing an inkjet method. The droplet discharge head is capable of discharging a functional liquid containing a material of a color element film and the like.

Droplet Discharge Method

A droplet discharge method used for forming a functional film such as a filter film will be first described. The droplet discharge method has such an advantage that a material can be accurately disposed on a desired location in a desired amount with little waste in the use of the material. As discharging techniques of the droplet discharge method, a charge control method, a pressurized vibration method, an electromechanical converting method, an electrothermal converting method, an electrostatic attraction method, and the like are exemplified.

Among these, the electromechanical converting method is such a method that uses a deformation characteristic of a piezoelectric element in response to a pulsed electric signal. In the method, a piezoelectric element is deformed to apply pressure to a space storing a liquid material with a member made of an elastic material interposed therebetween and thus the liquid material is pushed out of the space to be discharged from a discharge nozzle. The piezo method does not heat the liquid material and generate bubbles in the material so as to less influence a component of the material. Therefore, the method has such an advantage that a size of a droplet is easily adjusted by adjusting a drive voltage. The embodiment employs the piezo method because the piezo method does not influence a component of a material so as to provide high degree of freedom in selecting a liquid material, and because the size of a droplet is easily adjusted so as to provide a good controllability of a droplet.

Droplet Discharge Device

Figure 2:
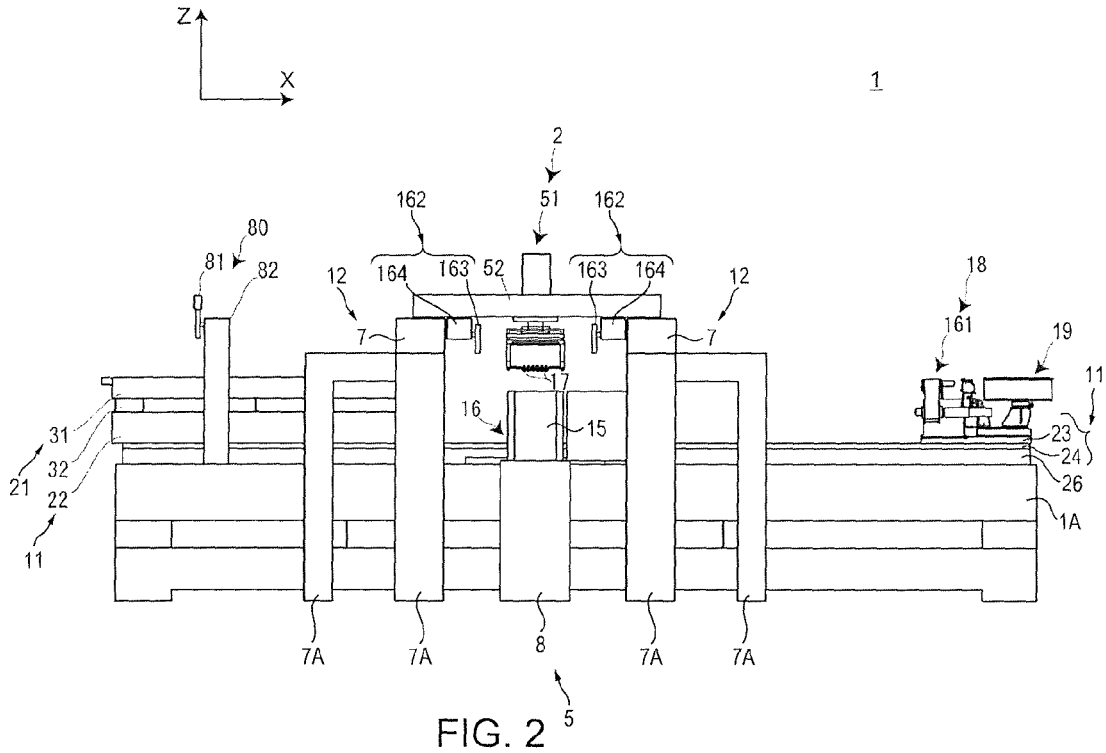
FIG. 2 is a lateral view schematically showing a structure of the droplet discharge device.

Next, the whole structure of a droplet discharge device 1 will be described with reference to FIGS. 1 and 2. FIG. 1 is a plan view schematically showing a structure of a droplet discharge device. FIG. 2 is a lateral view schematically showing a structure of the droplet discharge device.

Figure 7:
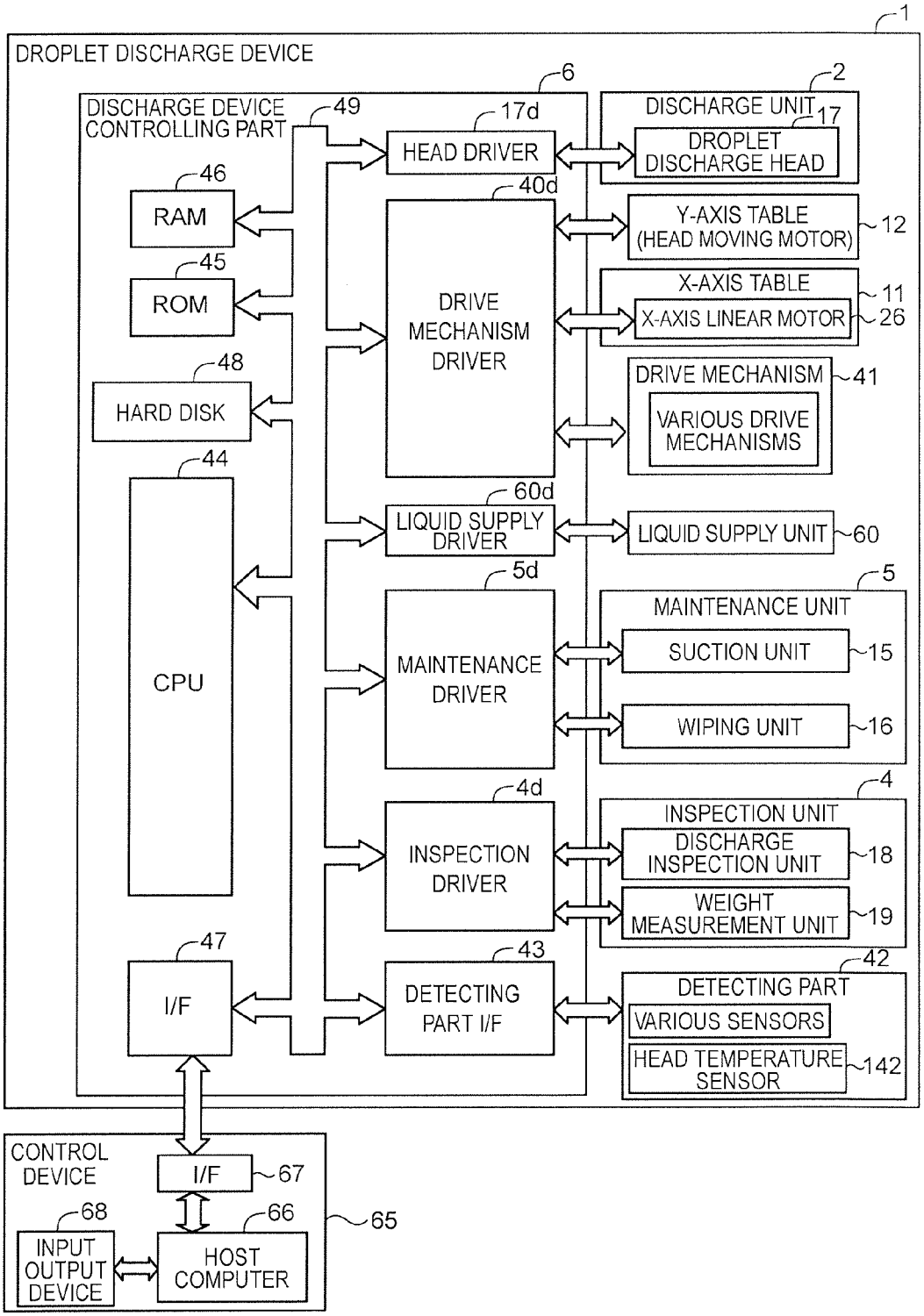
FIG. 7 is an electrical structure block diagram showing an electrical structure of the droplet discharge device.

As shown in FIG. 1 or 2, this droplet discharge device 1 includes a discharge unit 2 having a droplet discharge head 17 (refer to FIG. 3), a work unit 3, a liquid supply unit 60 (refer to FIG. 7), an inspection unit 4, a maintenance unit 5, and a discharge device controlling part 6 (refer to FIG. 7).

The discharge unit 2 includes 6 pieces of the droplet discharge heads 17 that discharge a functional liquid as the droplet as a droplet, and includes a Y-axis table 12 used for moving the droplet discharge heads 17 in a Y-axis direction and keeping them at a position to which the heads are moved. The work unit 3 includes a work placing board 21 for placing a work W that is an object for discharging a droplet which is discharged from the droplet discharge heads 17. The liquid supply unit 60 includes a storing tank (not shown) for storing the functional liquid and supplies the functional liquid to the droplet discharge heads 17. The inspection unit 4 includes a discharge inspection unit 18 and a weight measurement unit 19 for inspecting a discharging state from the droplet discharge heads 17. The weight measurement unit 19 has a flashing unit 14. The maintenance unit 5 includes a suction unit 15 and a wiping unit 16 that perform maintenance of the droplet discharge heads 17.

The discharge device controlling part 6 totally controls each of these units. A weight measurement processing, a drawing processing, a discharge inspection processing, a maintenance processing, and the like respectively performed by the weight measurement unit 19, the discharge unit 2, the discharge inspection unit 18, the maintenance unit 15, and the like are performed by controlling each of the units by the discharge device controlling part 6.

The droplet discharge device 1 includes an X-axis supporting base 1A supported on a stone surface plate, and each unit thereof is disposed on the X-axis supporting base 1A. An X-axis table 11 that extends in an X-axis direction as a main-scanning direction and is disposed on the X-axis supporting base 1A moves the work placing board 21 in the X-axis direction (the main-scanning direction).

The Y-axis tables 12 of the discharge unit 2 are disposed on a pair of Y-axis supporting bases 7 and 7, which are formed to straddle the X-axis table 11, on a plurality of columns 7A, and extend in the Y-axis direction as a sub-scanning direction. The discharge unit 2 includes a carriage unit 51 having the six pieces of the droplet discharge heads 17. The carriage unit 51 is formed to be suspended from a bridge plate 52. The bridge plate 52 is supported on the Y-axis table 12 in a slidable manner in the Y-axis direction with a Y-axis slider (not shown) interposed. The Y-axis table 12 moves the bridge plate 52 (the carriage unit 51) in the Y-axis direction (the sub-scanning direction).

Droplets of the functional liquid are discharged by discharge-driving the droplet discharge heads 17 of the discharge unit 2 in synchronization with the drive of the X-axis table 11 and the Y-axis table 12, thus drawing a desired drawing pattern with the functional liquid on the work W that is placed on the work placing board 21.

The discharge inspection unit 18 includes an inspection drawing unit 161 and an imaging unit 162. The inspection drawing unit 161 is fixed on an X-axis second slider 23 so as to be moved together with the weight measurement unit 19 and the flashing unit 14 that are also fixed on the X-axis second slider 23. The imaging unit 162 includes two pieces of inspection cameras 163, and camera moving mechanisms 164 that support the inspection cameras 163 in a slidable manner in the Y-axis direction.

The suction unit 15 and the wiping unit 16 included in the maintenance unit 5 are disposed on a pedestal 8. The pedestal 8 is disposed on a position apart from the X-axis table 11 and does not disturb the move of the carriage unit 51 moved by the Y-axis table 12. The suction unit 15 includes a cap unit 15*a*. The suction unit 15 seals a nozzle forming surface 76*a* (refer to FIG. 3) of the droplet discharge heads 17 by the cap unit 15*a* and sucks a discharge nozzle 78 (refer to FIG. 3) so as to compel the droplet discharge heads 17 to eject the functional liquid from the discharge nozzle 78. The wiping unit 16 includes a wiping sheet 16*a* to which a cleaning liquid is sprayed, and cleans (wipes) the nozzle forming surface 76*a* of the droplet discharge heads 17 after the sucking. Thus, the suction unit 15 and the wiping unit 16 perform maintenance operations for functional maintenance or functional recovery of the droplet discharge heads 17 of the discharge unit 2.

The X-axis table 11 includes an X-axis first slider 22, the X-axis second slider 23, a pair of left and right X-axis linear motors 26 and 26, and a pair of X-axis common supporting bases 24 and 24.

On the X-axis first slider 22, the work placing board 21 is attached. The X-axis first slider 22 is supported on the X-axis common supporting bases 24, which extend in the X-axis direction, in a slidable manner in the X-axis direction. To the X-axis second slider 23, the inspection drawing unit 161, the weight measurement unit 19, and the flashing unit 14 are attached. The X-axis second slider 23 is supported on the X-axis common supporting bases 24, which extends in the X-axis direction, in a slidable manner in the X-axis direction. The X-axis linear motors 26 are formed in parallel with the X-axis common supporting bases 24. The motors 26 move the X-axis first slider 22 or the X-axis second slider 23 along the X-axis common supporting bases 24 so as to move the work placing board 21 (the work W placed on the work placing board 21) or the weight measurement unit 19 in the X-axis direction. The X-axis first slider 22 and the X-axis second slider 23 can be separately driven by the X-axis linear motors 26. The X-axis direction corresponds to the main-scanning direction and the Y-axis direction corresponds to the sub-scanning direction.

The work placing board 21 includes an adsorption table 31, a θ table 32, and the like. The adsorption table 31 adsorbs and fixes the work W that is placed and holds it. The θ table 32 supports the adsorption table 31. The θ table 32 θ-compensates a position of the work W set on the adsorption table 31 in a θ direction that is a direction around a Z axis which is orthogonal to the X-axis direction and the Y-axis direction, and maintains and keeps the θ-compensated direction. The θ table 32 includes a θ driving motor 532 which drives the θ table 32.

The position of the work placing board 21 shown in FIGS. 1 and 2 is a material supply and removal position for supplying and removing the work W. When the work W which is not processed is introduced (supplied) to the adsorption table 31 or the work W which is processed is withdrawn (removed), the adsorption table 31 is moved to this position. The work W is carried in and out (replaced) with respect to the adsorption table 31 by a robot arm (not shown) on the material supply and removal position. The work W which is supplied to the adsorption table 31 and is not processed is aligned on the supply and removal position by using the θ table 32 and an image recognition unit 80.

The image recognition unit 80 includes two pieces of alignment cameras 81 and a camera moving mechanism 82. The camera moving mechanism 82 is provided on the X-axis supporting base 1A so as to extend in the Y-axis direction and straddle the X-axis table 11. The alignment cameras 81 are supported on the camera moving mechanism 81 in a slidable manner in the Y-axis direction with a camera holder (not shown) interposed. The alignment cameras 81 supported on the camera moving mechanism 82 face the X-axis table 11 from the upside so as to image-recognize a reference mark (alignment mark) of each work W placed on the work placing board 21 on the X-axis table 11. The two pieces of alignment cameras 81 can be separately moved by a camera moving motor (not shown) in the Y-axis direction.

Each of the alignment cameras 81 is moved by the camera moving mechanism 82 in the Y-axis direction and takes an image of an alignment mark of each work W that is supplied by the robot arm in collaboration with the move of the work placing board 21 in the X-axis direction. Then, based on an imaging result of the alignment cameras 81, the work W is θ-compensated (aligned) by the θ table 32.

The Y-axis table 12 is provided with a pair of Y-axis sliders (not shown) and a pair of Y-axis linear motors (not shown). The pair of Y-axis linear motors are formed respectively on the pair of Y-axis supporting bases 7 and 7 and extend in the Y-axis direction. The Y-axis sliders are respectively supported by the Y-axis supporting bases 7 and 7 in a slidable manner. The pair of Y-axis sliders that are respectively supported by the Y-axis supporting bases 7 and 7 supports the bridge plate 52 at both ends of the plate 52. To the bridge plate 52, the carriage unit 51 included in the discharge unit 2 is fixed. The bridge plate 52 that fixes the carriage plate 51, which is included in the discharge unit 2, thereon is formed on the pair of Y-axis supporting bases 7 and 7 in a manner interposing the Y-axis sliders that support the bridge plate 52 at both ends of the plate 52.

When the Y-axis linear motors are (synchronously) driven, the Y-axis sliders move at a time in parallel in the Y-axis direction with a guide of the Y-axis bases 7 and 7. Due to the move of the sliders, the bridge plate 52 moves in the Y-axis direction, and accordingly the carriage unit 51 suspended from the bridge plate 52 moves in the Y-axis direction.

The carriage unit 51 is provided with a head unit 54 (refer to FIG. 4) having the six pieces of droplet discharge heads 17 and the carriage plate 53 (refer to FIG. 4), which supports the six pieces of droplet discharge heads 17 in a manner separating them in two groups consisting of three pieces. The head unit 54 is supported with a head ascend and descend mechanism interposed, in such a manner that the mechanism freely ascends and descends in the Z-axis direction.

Droplet Discharge Head

Figure 3A:
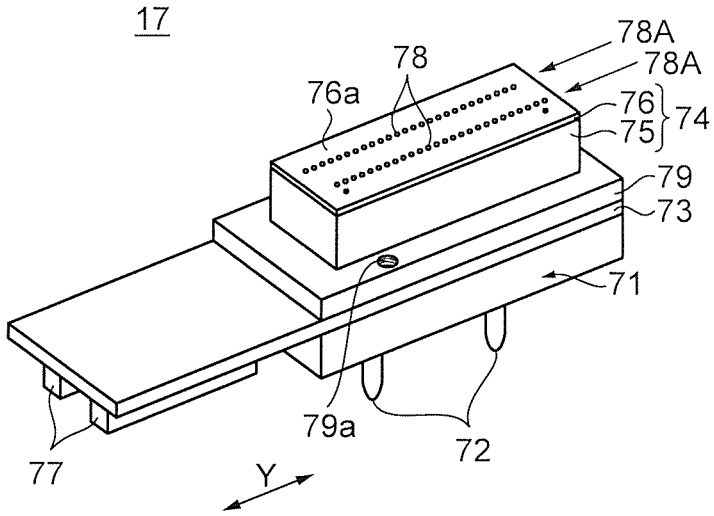
FIG. 3A is a perspective view showing an exterior appearance of a droplet discharge head viewed from a nozzle plate side.
Figure 3B:
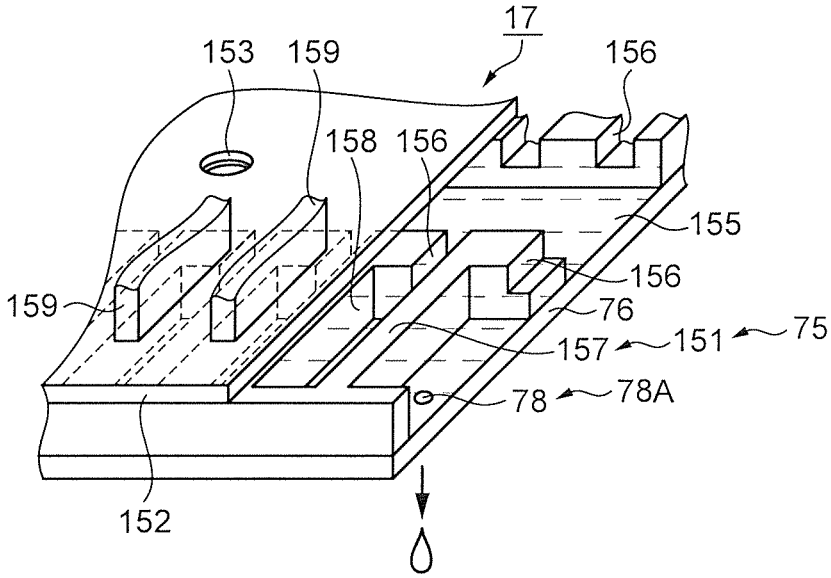
FIG. 3B is a perspective sectional view showing a structure around a pressure chamber of the droplet discharge head.
Figure 3C:
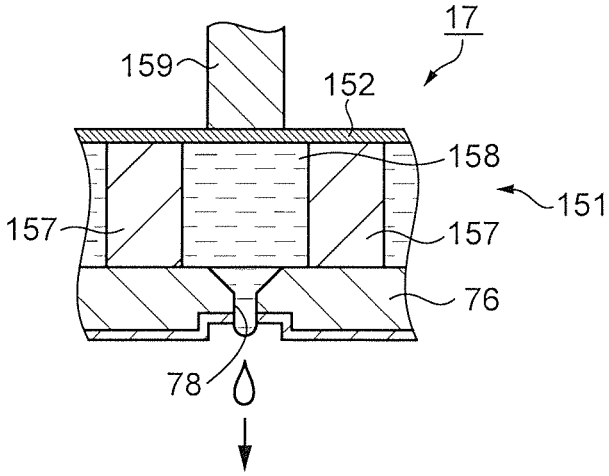
FIG. 3C is a sectional view showing a structure of a discharge nozzle part of the droplet discharge head.

The droplet discharge head 17 will be described with reference to FIGS. 3A to 3C. FIGS. 3A to 3C are drawings showing a structure of a droplet discharging head. FIG. 3*a* is an exterior perspective view showing the droplet discharge head viewed from a nozzle plate side. FIG. 3B is a perspective sectional view showing a structure around a pressure chamber of the droplet discharge head. FIG. 3C is a sectional view showing a structure of the discharge nozzle of the droplet discharge head. The droplet discharge head 17 corresponds to a discharge unit.

As shown in FIG. 3A, the droplet discharge head 17 is a double barreled head. The droplet discharge head 17 includes a liquid introducing part 71 having double connecting needles 72 and 72, a head substrate 73 continuing to a lateral side of the liquid introducing part 71, a pump part 75 continuing to the liquid introducing part 71, and a nozzle plate 76 continuing to the pump part 75. To each of connecting needles 72 of the liquid introducing part 71, a pipe connecting member is coupled. To the pipe connecting member, a liquid supply tube is coupled so as to supply the functional liquid from a liquid supply unit 60 which is coupled with the liquid supply tube. Mounted on the head substrate 73 are a pair of head connectors 77 and 77, through which a flexible flat cable (FFC) is coupled to the head substrate 73. The droplet discharge head 17 is coupled to the discharge device controlling part 6 through the FFC through which the head 17 sends and receives a signal. A head body 74 having a rectangular shape is composed of the pump part 75 and the nozzle plate 76.

At a base portion side of the pump part 75, that is, at a base portion side of the head body 74, a flange part 79 having a rectangular flange shape is formed so as to support the liquid introducing part 71 and the head substrate 73. On the flange part 79, a pair of small screw holes (female threaded screws) 79*a* for fixing the droplet discharge head 17 are formed. The droplet discharge head 17 is fixed on a head supporting member with locking screws that penetrate the head supporting member and engage with the screw holes 79*a*.

On the nozzle forming surface 76*a* of the nozzle plate 76, two nozzle rows 78A are formed. The nozzle rows 78A are composed of discharge nozzles 78 that are formed on the nozzle plate 76 and discharge droplets. The two nozzle rows 78A are arranged in parallel, and each of the nozzle rows 78A and 78A is composed of 180 pieces, for example, (schematically shown in the drawing) of discharge nozzles 78 that are arranged in a regular pitch. That is, the two nozzle rows 78A are disposed on the nozzle forming surface 76*a* of the head body 74 in such a manner that the two nozzle rows 78A are symmetric with respect to the center line of the nozzle forming surface 76*a*.

In a state that the droplet discharge head 17 is attached to the droplet discharge device 1, the nozzle rows 78A extend in the Y-axis direction. The discharge nozzles 78 constituting one of the two nozzle rows 78A are arranged in a manner shifting by a half pitch to those constituting the other of the rows 78A in the Y-axis direction. One nozzle pitch is 140 μm, for example. On a certain position in the X-axis direction, droplets that are discharged from the discharge nozzles 78 constituting respective nozzle rows 78A land linearly so as to align at regular intervals in the Y-axis direction, on a design. In a case where a nozzle pitch of the discharge nozzles 78 of the nozzle rows 78A is 140 μm, a distance between centers of the landed positions that align linearly is 70 μm on the design.

As shown in FIGS. 3B and 3C, in the droplet discharge head 17, a pressure chamber plate 151 constituting the pump part 75 is layered on the nozzle plate 76, and a vibrating plate 152 is layered on the pressure chamber plate 151.

On the pressure chamber plate 151, a reservoir 155 is formed. The reservoir 155 is constantly filled with the functional liquid that is supplied from the liquid introducing part 71 through a liquid supply hole 153 of the vibrating plate 152. The reservoir 155 is a space surrounded by the vibrating plate 152, the nozzle plate 76, and the pressure chamber plate 151. Further, a pressure chamber 158 that is separated by a plurality of head partitions 157 is formed on the pressure chamber plate 151. A space formed by the vibrating plate 152, the nozzle plate 76, and two pieces of the head partitions 157 is the pressure chamber 158.

Corresponding to the discharge nozzles 78, the pressure chamber 158 is provided in the same number as the discharge nozzles 78. Into the pressure chamber 158, the functional liquid is supplied from the reservoir 155 through a supply opening 156 positioned between two pieces of the head partitions 157. Groups each including the head partitions 157, the pressure chamber 158, the discharge nozzles 78, and the supply opening 156 are aligned along the reservoir 155, and the discharge nozzles 78 arranged in a line form the nozzle row 78A. Though not shown in FIG. 3B, discharge nozzles 78 are arranged in a line to form another nozzle row 78A at an approximately symmetric position to the nozzle row 78A which includes the discharge nozzle 78 which is shown in the drawing. Thus groups each including the head partitions 157, the pressure chamber 158, and the supply opening 156 are arranged in a line.

On a portion, which constitutes the pressure chamber 158, of the vibrating plate 152, one end of a piezoelectric element 159 is fixed. The other end of the piezoelectric element 159 is fixed on a pedestal (not shown) supporting the whole of the droplet discharge head 17 with a fixing plate 154 (refer to FIG. 9B) interposed.

The piezoelectric element 159 includes an active part in which an electrode layer and a piezoelectric element are layered. The active part constricts in a longitudinal direction (a thickness direction of the vibrating plate 152 in FIG. 3B or 3C) by an application of a drive voltage to the electrode layer. Due to the constriction of the active part, the vibrating plate 152, to which one end of the piezoelectric element 159 is fixed, receives a force pulling the plate 152 toward the opposite side to the pressure chamber 158. Pulled toward the opposite side to the pressure chamber 158, the vibrating plate 152 bends toward the opposite side to the pressure chamber 158. Due to the bend of the vibrating plate 152, a volume of the pressure chamber 158 is increased, so that the functional liquid is supplied to the pressure chamber 158 from the reservoir 155 through the supply opening 156. Then, when the application of the drive voltage to the electrode layer is stopped, the active part turns to have the original length. Therefore, the piezoelectric element 159 presses the vibrating plate 152. Due to the press, the vibrating plate 152 returns toward a the pressure chamber 158 side. Because of this, the volume of the pressure chamber 158 rapidly returns to be the original volume, that is, the volume that has been increased is decreased. Accordingly, a pressure is applied to the functional liquid filling the pressure chamber 158, and therefore the functional liquid is discharged as droplets from the discharge nozzles 78 formed to communicate with the pressure chamber 158. The flowing path of the functional liquid includes the reservoir 155, the supply opening 156, the pressure chamber 158, and the like.

The discharge controlling part 6 controls the application of voltage with respect to the piezoelectric element 159, that is, controls a drive signal so as to control the discharge of the functional liquid with respect to each of the discharge nozzles 78. More specifically, the discharge controlling part 6 can change a volume of droplets discharged from the discharge nozzles 78, the number of droplets discharged per unit time, and the like. Accordingly, a distance between the droplets that land on the substrate, an amount of the functional liquid to land on a certain area of the substrate, and the like can be changed. If discharge nozzles 78 discharging droplets are used selectively from the discharge nozzles 78 aligning in the nozzle row 78A, for example, a plurality of droplets can be discharged at a time by a pitch of the discharge nozzles 78 in a range of the length of the nozzle row 78A in an extending direction of the nozzle row 78A. In a direction nearly orthogonal to the extending direction of the nozzle row 78A, the substrate is moved relatively to the discharge nozzles 78. In the relative move direction, droplets discharged from the discharge nozzles 78 can be arranged on arbitrary positions, to which the discharge nozzles 78 can face, of the substrate. Here, the volume of the droplets discharged from each of the discharge nozzles 78 is variable within a range from 1 pl (picoliters) to 300 pl, for example.

Head Unit

Figure 4:
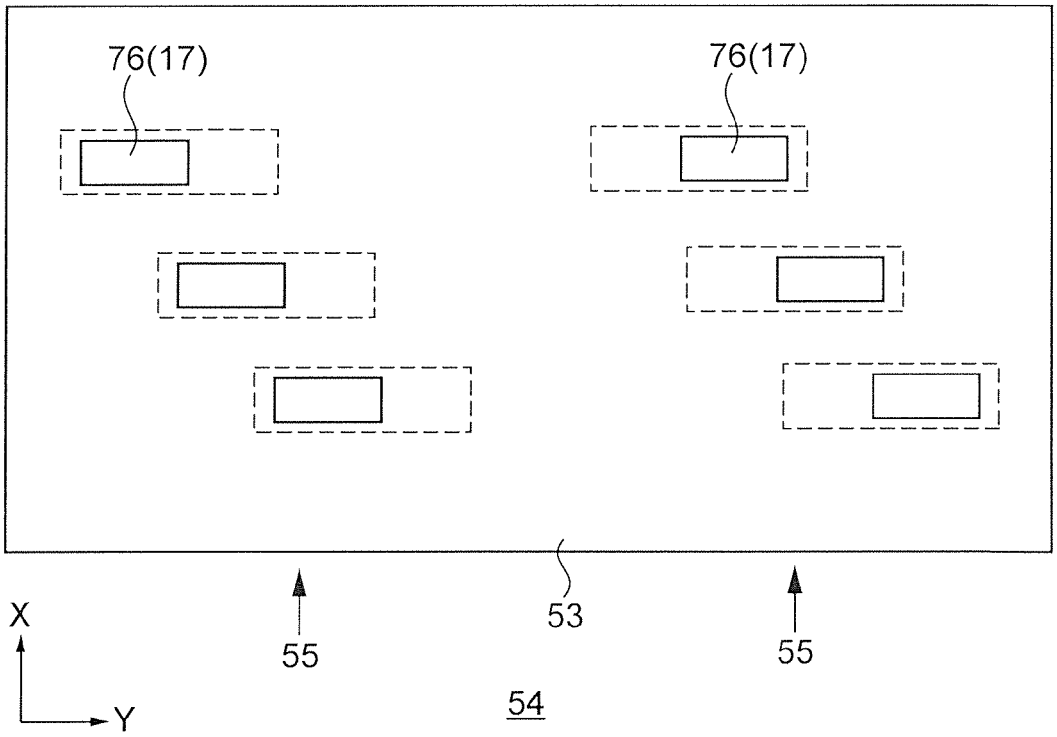
FIG. 4 is a plan view schematically showing a structure of a head unit.

A schematic structure of the head unit 54 provided to the discharged unit 2 will be described with reference to FIG. 4. FIG. 4 is a plan view showing a schematic structure of a head unit. X axis and Y axis shown in FIG. 4 correspond to the X axis and the Y axis shown in FIG. 1 in a state that the head unit 54 is attached to the droplet discharge device 1.

As shown in FIG. 4, the head unit 54 includes the carriage plate 53, and six pieces of the droplet discharge heads 17 disposed on the carriage plate 53. The droplet discharge heads 17 are fixed on the carriage plate 53 with holding members (not shown) interposed, the head body 74 is freely fit at a hole (not shown) formed on the carriage plate 53, and the nozzle plate 76 (the head body 74) is protruded from the surface of the carriage plate 53. FIG. 4 is a diagram viewed from a nozzle plate 76 (the nozzle forming surface 76*a*) side. The six pieces of the droplet discharge heads 17 are divided in the Y-axis direction so as to form two groups, that is, head groups 55 respectively having three pieces of the droplet discharge heads 17. The nozzle rows 78A of each of the droplet discharge heads 17 extend in the Y-axis direction.

The three pieces of the droplet discharge heads 17 included in one head group 55 are positioned such that the discharge nozzle 78 positioned at a first end (which is positioned at a second droplet discharge head side) of a first droplet discharge head 17 shift in the Y-axis direction by a half pitch with respect to the nozzle 78 positioned at a second end (which is positioned at the first head side) of the second droplet discharge head 17 that is adjacent to the first head 17. If all of the discharge nozzles 78 of the three pieces of the droplet discharge heads 17 included to the head group 55 are aligned on a certain position of the X-axis direction, the discharge nozzles 78 are arranged in a regular interval of a half nozzle pitch in the Y-axis direction. That is, on the certain position in the X-axis direction, droplets that are discharged from the discharge nozzles 78 constituting the nozzle rows 78A of the droplet discharge heads 17 land so as to be arranged in a line at regular intervals in the Y-axis direction, on a design. Since the droplet discharge heads 17 cannot be aligned in a line in the Y-axis direction due to their physical shapes, the heads 17 overlaps with each other in the Y-axis direction so as to be arranged step-like in the X-axis direction and thus form the head group 55.

A line formed by discharging droplets one by one from the each of the discharge nozzles 78 of the heads of the head group 55 is defined as a nozzle group line. One head group 55 and another head group 55 are disposed in the Y-axis direction in such relative position that discharge nozzles 78 positioned at each end of the head groups 55 are apart from each other at a distance which is obtained by adding a half nozzle pitch to the length of the nozzle group line. For example, two head groups 55 discharge droplets one by one from respective discharge nozzles 78 so as to form first two nozzle group lines, and the two head groups 55 form second nozzle group lines at a position apart from an end of the first nozzle group lines in the Y-axis direction at a distance which is obtained by adding a half nozzle pitch to a length of the nozzle group line. Consequently, 4320 droplets discharged from 2160 pieces of the discharge nozzles 78 provided to the six pieces of the droplet discharged heads 17 are disposed at a regular interval, forming a straight line.

Discharge Inspection Unit

Figure 5:
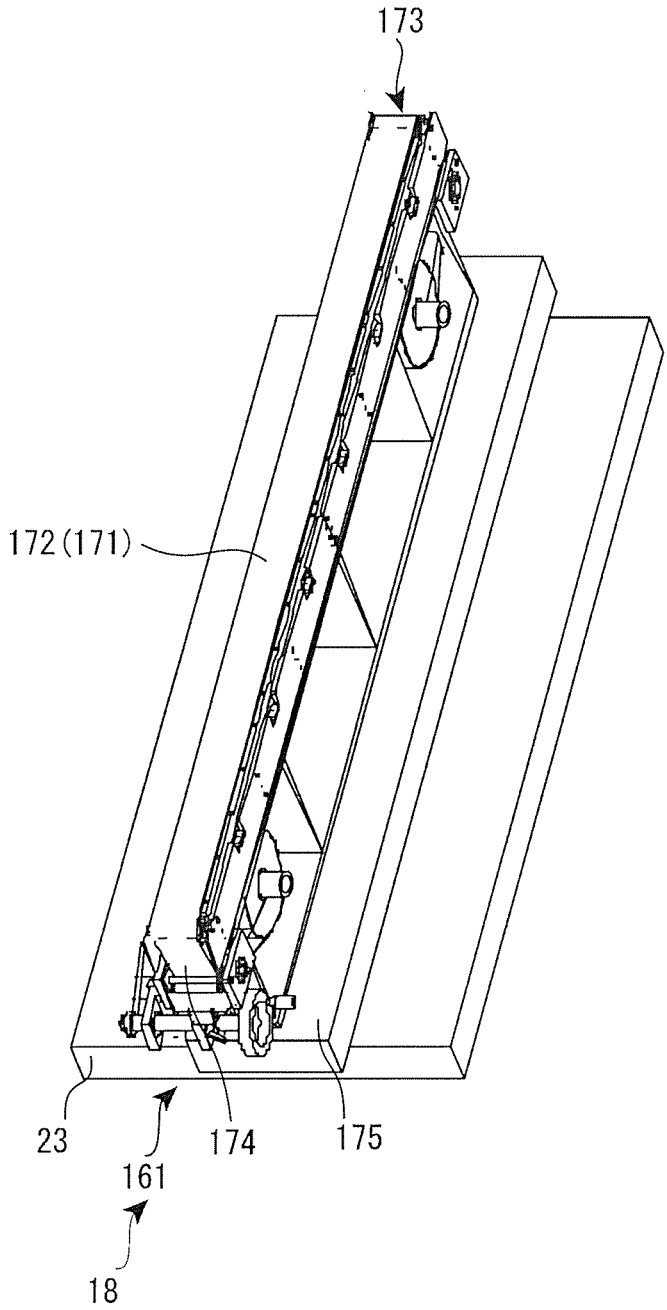
FIG. 5 is an external perspective view showing a whole structure of an inspection drawing unit.

The discharge inspection unit 18 will be described with reference to FIG. 5. FIG. 5 is an external perspective view showing a whole structure of an inspection drawing unit. As described with reference to FIG. 1, the discharge inspection unit 18 includes the inspection drawing unit 161 and the imaging unit 162. The inspection drawing unit 161 is structured so as to move together with the weight measurement unit 19 and the flashing unit 14.

The discharge inspection unit 18 inspects whether the functional liquid is appropriately discharged from (the discharge nozzles 78 of) all of the droplet discharge heads 17 constituting the discharge unit 2. The inspection drawing unit 161 is structured such that the unit 161 can receive the functional liquid inspect-discharged from all of the discharge nozzles 78 of all of the droplet discharge heads 17 provided to the head unit 54, when the head unit 54 provided to the discharge unit 2 is positioned to be able to face the work W placed on the work placing board 21 in the Y-axis direction. The imaging unit 162 images and inspects an inspection pattern (a pattern of landed dots) drawn by the inspection drawing unit 161. As described above, the inspection drawing unit 161 is disposed on the X-axis table 11. The imaging unit 162 is fixed on the Y-axis supporting base 7 directly under the Y-axis table 12. The imaging unit 162 is provided in a fixed manner to an inspection position in the X-axis direction. The two inspection cameras 163 provided to the imaging unit 162 can be moved separately in the Y-axis direction.

As shown in FIG. 5, the inspection drawing unit 161 includes an inspection sheet 171, an inspection stage 172, a sheet carrying unit 173, a sheet carrying unit supporting member 174, and a unit base 175. The inspection sheet 171 is a belt-like sheet on which droplets of the functional liquid inspect-discharged from the droplet discharge head 17 are landed. The inspection sheet 171 extends in the Y-axis direction shown in FIG. 1, in the droplet discharge device 1. The inspection stage 172 extends in the Y-axis direction shown in FIG. 1 in the droplet discharge device 1. The inspection sheet 171 is placed on the inspection stage 172. The sheet carrying unit 173 moves the inspection sheet 171 so as to send an uninspected portion of the sheet to the inspection stage 172 and send an inspected portion of the sheet away from the inspection stage 172. The sheet carrying unit 173 is supported by the sheet carrying unit supporting member 174, and the sheet carrying unit supporting member 174 is supported by the unit base 175.

As described with reference to FIG. 2, the imaging unit 162 includes two inspection cameras 163 and the camera moving mechanism 164 that supports the two inspection cameras 163 in a slidable manner in the Y-axis direction. The inspection cameras 163 image-recognize the landed dots inspect-discharged on the inspection sheet 171. The cameras 163 supported on the Y-axis supporting base 7 in a slidable manner in the Y-axis direction with the camera moving mechanism 164 interposed, in a posture facing the X-axis table 11.

The inspection drawing unit 161 is capable of moving to a position on which the inspection sheet 171 faces the inspection cameras 163 of the imaging unit 162 and staying on the position. An imaged result by the two inspection cameras 163 is send to the discharge device controlling part 6 and image-recognized. Based on the image recognition, whether each of the discharge nozzles 78 of each of the droplet discharge heads 17 normally discharges the functional liquid or not (whether the nozzle is clogged or not) is determined. Further, whether a relative position of the landed droplet is a specified position or not is determined.

Weight Measurement Unit

Figure 6A:
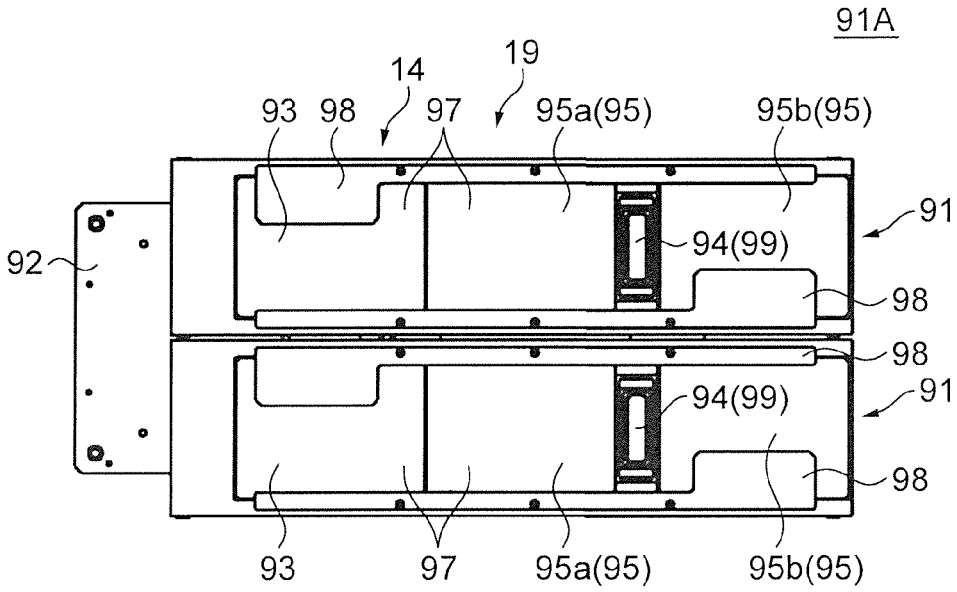
FIG. 6A is a plan view showing a weight measurement block including a part of a weight measurement unit and a part of a flashing unit.
Figure 6B:
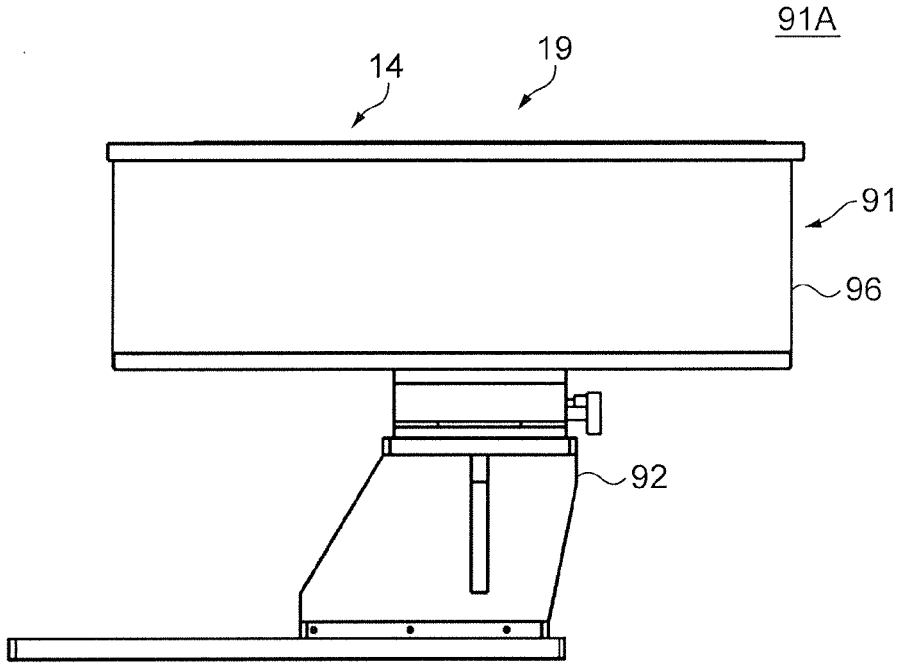
FIG. 6B is a lateral view showing the weight measurement block.

The weight measurement unit 19 and the flashing unit 14 will be described with reference to FIGS. 6A and 6B. FIGS. 6A and 6B are diagrams showing a weight measurement block including a part of a weight measurement unit and a part of a flashing unit. FIG. 6A is a plan view of the weight measurement block, and FIG. 6B is a lateral view of the weight measurement block. As described above, a discharge inspection block including the weight measurement unit 19, the flashing unit 14, and the inspection drawing unit 161 moves in an integrated manner.

Referring to FIGS. 6A and 6B, this weight measurement block 91A includes two pieces of weight measurement devices 91 and a supporting frame 92. The supporting frame 92 supports the two pieces of weight measurement devices 91. Further, the supporting frame 92 is fixed on the X-axis second slider 23, mounting the weight measurement block 91A on the X-axis second slider 23. One weight measurement device 91 corresponds to one head group 55, and the two weight measurement devices 91 arranged in parallel correspond to one head unit 54.

The weight measurement device 91 includes a periodic flashing box 93, a liquid receiving container 94, an electronic balance 99 (hidden under the liquid receiving container 94 in FIG. 6A), a weight measurement time flashing box 95, a functional liquid absorber 97, a holding plate 98, and a case 96 storing these components. The periodic flashing box 93, the weight measurement time flashing box 95, the functional liquid absorber 97, and the holding plate 98 are included in the flashing unit 14. The liquid receiving container 94 and the electronic balance 99 are included in the weight measurement unit 19.

The liquid receiving container 94 has such a size that the liquid receiving container 94 can face only one arbitrary droplet discharge head 17, among the three droplet discharge heads 17 constituting the head group 55, so as to receive the functional liquid discharged from the droplet discharge head 17 that the container 94 faces. The liquid receiving container 94 is mounted on the electronic balance 99. The electronic balance 99 measures the weight of the liquid receiving container 94 so as to measure the weight of the functional liquid that land on the liquid receiving container 94. The weight of the liquid receiving container 94 increased by receiving the functional liquid from the droplet discharge head 17 is the weight of the functional liquid that is discharged from the droplet discharge head 17 and land on the liquid receiving container 94.

In terms of the weight measurement time flashing box 95, a weight measurement time flashing box 95*a* and a weight measurement time flashing box 95*b* are arranged in the X-axis direction with the liquid receiving container 94 interposed. When one of the three droplet discharge heads 17 constituting the head group 55 faces the liquid receiving container 94, the other two droplet discharge heads 17 are positioned to face any of the weight measurement time flashing box 95*a* and the weight measurement time flashing box 95*b*. When the droplet discharge head 17 for a weight measurement object faces the liquid receiving container 94 and performs discharge for the weight measurement, the other droplet discharge heads 17 for other than the weight measurement object face the weight measurement time flashing box 95*a* or 95*b* and perform discarding discharge.

One weight measurement device 91 performs weight measurement of the three pieces of droplet discharge heads 17 of the head group 55. Therefore, when one droplet discharge head 17 performs discharge for weight measurement, the other two droplet discharge heads 17 wait until the measurement of the one discharge head 17 is finished. However, the other two heads 17 in the "waiting" (standby) state can perform discarding discharge. Accordingly, the discharge nozzles 78 are prevented from being dried in the "waiting" (standby) state so as to be able to favorably perform weight measurement discharge after the "waiting" (standby) state, being able to provide a proper measurement result.

The periodic flashing box 93 receives the functional liquid that undergoes discarding discharge in periodic flashing.

In the weight measurement time flashing box 95 and the periodic flashing box 93, the functional liquid absorber 97 is disposed in a manner held by a pair of holding plates 98 at both long sides of the flashing box 95 and the flashing box 93. The liquid receiving container 94 is formed so as to be able to receive the functional liquid in a nozzle row unit with respect to each of the droplet discharge heads 17.

The electronic balance 99 measures the weight of the functional liquid discharged to the liquid receiving container 94 so as to output a measurement result to the discharge device controlling part 6. Based on the measurement result that is received, the discharge device controlling part 6 controls driving power (voltage value) which is to be applied to the droplet discharge heads 17 from a head driver 17*d* (refer to FIG. 7).

Electrical Structure of Droplet Discharge Device

An electrical structure for driving the droplet discharge device 1 having the above-mentioned structure will be described with reference to FIG. 7. FIG. 7 is a block diagram showing an electrical structure of a droplet discharge device. The droplet discharge device 1 is controlled by an application of data or an application of controlling command of start or stop of an operation through a control device 65. The control device 65 includes a host computer 66 performing arithmetic processing, and an input output device 68 for inputting and outputting information into and from the droplet discharge device 1. The control device 65 is coupled to the discharge device controlling part 6 through an interface (I/F) 67. Examples of the input output device 68 include a key board by which information can be inputted; an external input output device by which information is inputted and outputted through a recording medium; a recording part that stores information inputted through the external input output device; a monitoring device; and the like.

The discharge device controlling part 6 of the droplet discharge device 1 includes an interface (I/F) 47, a central processing unit (CPU) 44, a read only memory (ROM) 45, a random access memory (RAM) 46, and a hard disk 48. Further, the discharge device controlling part 6 includes the head driver 17*d*, a drive mechanism driver 40*d*, a liquid supply driver 60*d*, a maintenance driver 5*d*, an inspection driver 4*d*, and a detecting part interface (I/F) 43. These are electrically coupled with each other through a data bus 49.

The interface 47 sends and receives data to and from the control device 65, and the CPU 44 performs various arithmetic processings based on a command from the control device 65 and outputs a control signal for controlling an operation of each unit of the droplet discharge device 1. The RAM 46 temporarily stores a controlling command or printing data received from the control device 65 in accordance with a command from the CPU 44. The ROM 45 stores routines for various arithmetic processings performed by the CPU 44, and the like. The hard disk 48 stores the controlling command or the printing data received from the control device 65 or stores the routines for various arithmetic processings performed by the CPU 44.

To the head driver 17*d*, the droplet discharge heads 17 included in the discharge unit 2 are coupled. The head driver 17*d* drives the droplet discharge heads 17 in accordance with the control signal from the CPU 44 so as to allow the heads 17 to discharge droplets of the functional liquid. To the drive mechanism driver 40*d*, a head moving motor of the Y-axis table 12, the X-axis liner motor 26 of the X-axis table 11, and a drive mechanism 41 including various drive mechanisms having various driving source are coupled. The various drive mechanisms are the camera moving motor for moving the alignment camera 81, the θ driving motor 532 of the θ table 32, and the like. The drive mechanism drive 40*d* drives the motor and the like in accordance with the control signal from the CPU 44 so as to relatively move the droplet discharge head 17 and the work W and thus land droplets of the functional liquid on arbitrary positions on the work W in a manner collaborating with the head driver 17*d*.

To the maintenance driver 5*d*, the suction unit 15 and the wiping unit 16 of the maintenance unit 5 are coupled. The maintenance driver 5*d* drives the suction unit 15 or the wiping unit 16 in accordance with the control signal from the CPU 44 so as to perform a maintenance operation of the droplet discharge head 17.

To the inspection driver 4*d*, the discharge inspection unit 18 and the weight measurement unit 19 of the inspection unit 4 are coupled. The inspection driver 4*d* drives the discharge inspection unit 18 or the weight measurement unit 19 in accordance with the control signal from the CPU 44 so as to perform an inspection of a discharging state of the droplet discharge head 17 such as a discharge weight, discharge availability, and accuracy of a landing position.

The discharge weight in the first embodiment corresponds to a weight of one droplet of the functional liquid discharged by the droplet discharge head 17. A bulk (volume) of one droplet of the functional liquid discharged by the droplet discharge head 17 is referred to as a discharge amount. The discharge weight and the discharge amount express a certain amount respectively by a weight and a volume.

To the liquid supply driver 60*d*, the liquid supply unit 60 is coupled. The liquid supply driver 60*d* drives the liquid supply unit 60 in accordance with the control signal from the CPU 44 so as to supply the functional liquid to the droplet discharge head 17. To the detecting part interface 43, a detecting part 42 including various sensors such as a head temperature sensor 142 for measuring a temperature of the droplet discharge head 17 is coupled. Detected information detected by each of the sensors of the detecting part 42 is transferred to the CPU 44 through the detecting part interface 43.

As the temperature of the droplet discharge head 17, a temperature of a part of the droplet discharge head 17 is used. The temperature of the part can be measured by relating variation of the temperature of the part to variation of the weight of a droplet discharged from the droplet discharge head 17. For example, a temperature of an outer wall surface of the pump part 75, a temperature of the nozzle plate 76, a temperature of a part, which constitutes the pressure chamber 158, of the vibrating plate 152, and the like can be used. The head temperature sensor 142 is a contact type temperature sensor, for example. The sensor is disposed so as to be able to contact with any of the above parts and measure the temperature of any of the parts.

Discharge of Functional Liquid

Figure 8:
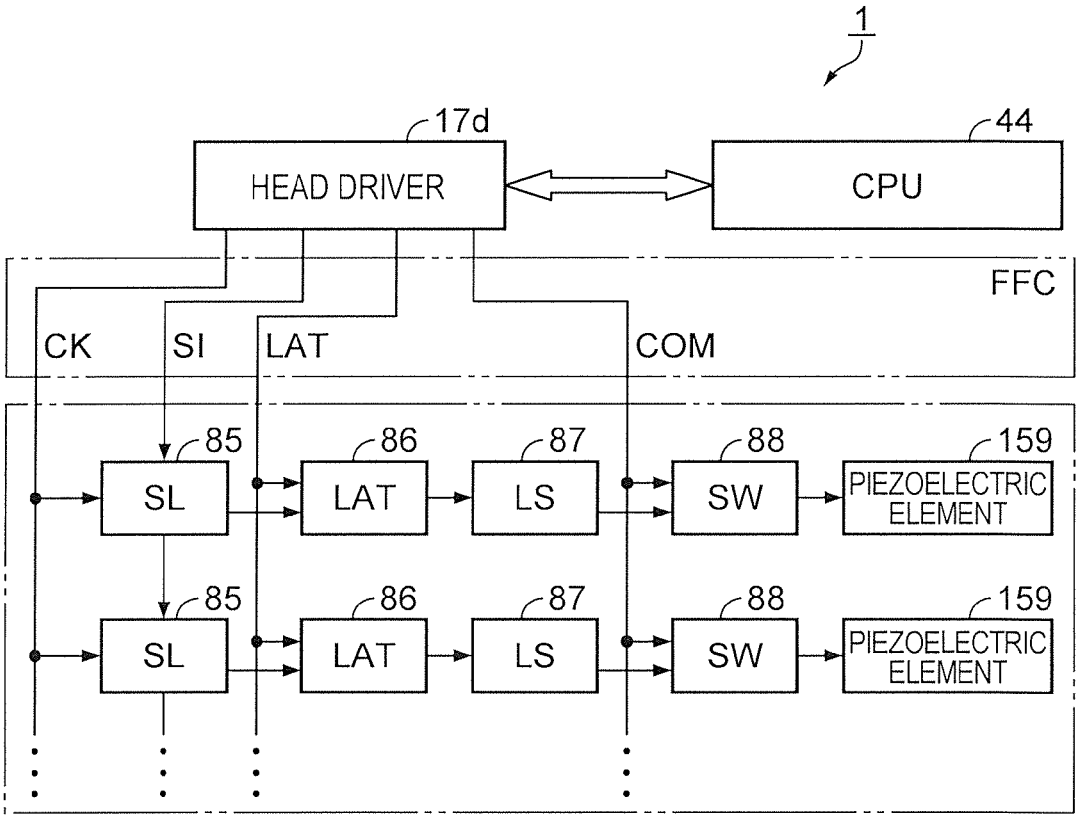
FIG. 8 is an explanatory diagram showing an electrical structure of the droplet discharge head and a flow of a signal.

A discharge controlling method in the droplet discharge device 1 will be described with reference to FIG. 8. FIG. 8 is an explanatory diagrams showing an electrical structure of a droplet discharge head and a flow of a signal.

As described above, the droplet discharge device 1 includes the CPU 44 that outputs a control signal for controlling an operation of each unit of the droplet discharge device 1, and the head driver 17*d* performing an electrical driving control of the droplet discharge head 17.

As shown in FIG. 8, the head driver 17*d* is electrically coupled to each of the droplet discharge heads 17 through a flexible flat cable (FFC). Further, the droplet discharging head 17 includes a shift register (SL) 85, a latch circuit (LAT) 86, a level shifter (LS) 87, and a switch (SW) 88 corresponding to the piezoelectric element 159 that is provided to each of the discharge nozzles 78 (refer to FIG. 3).

Discharge control in the droplet discharge device 1 is performed as follows. First, The CPU 44 sends dot pattern data to the head driver 17*d*. The dot pattern data is obtained by converting an arrangement pattern of the functional liquid on a drawing object such as the work W into data. Then the head driver 17*d* decodes the dot pattern data so as to generate nozzle data that is ON/OFF (discharging/non-discharging) information of each of the discharge nozzles 78. The nozzle data is converted into a serial signal (SI) and transmitted to each of the shift registers 85 in synchronization with the clock signal (CK).

The nozzle data transmitted to the shift registers 85 is latched with the timing with which a latch signal (LAT) is inputted into the latch circuit 86, and further, converted into a gate signal for the switch 88 by the level shifter 87. Specifically, when the nozzle data is "ON," the switch 88 opens to supply the piezoelectric element 159 with a drive signal (COM), and when the nozzle data is "OFF," the switch 88 is closed and no drive signal (COM) is supplied to the piezoelectric element 159. Then the functional liquid is discharged as droplets from the discharge nozzle 78 corresponding to the data of "ON" and land on a drawing object such as a work W, thus arranging the functional liquid on the drawing object.

Drive Waveform

Figure 9A:
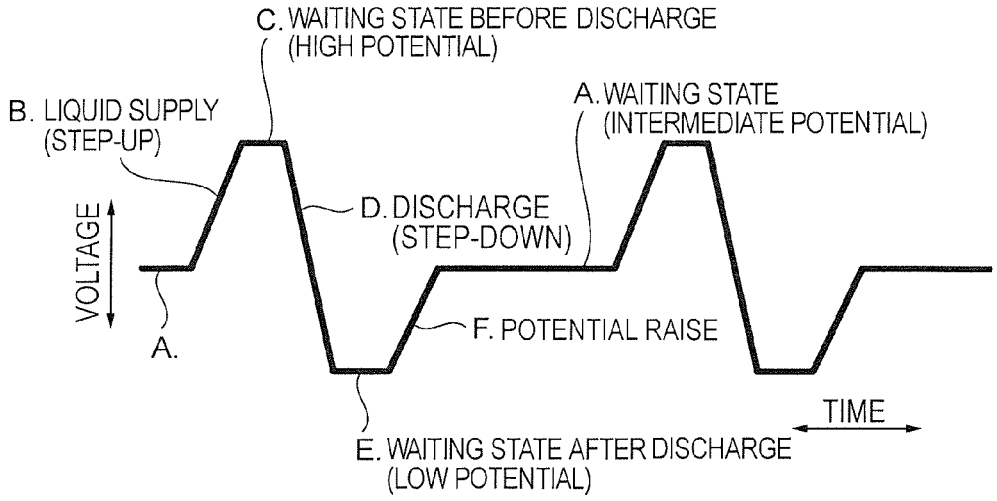
FIG. 9A is a diagram showing a fundamental waveform of a drive waveform of a drive signal which is applied to a piezoelectric element.
Figure 9B:
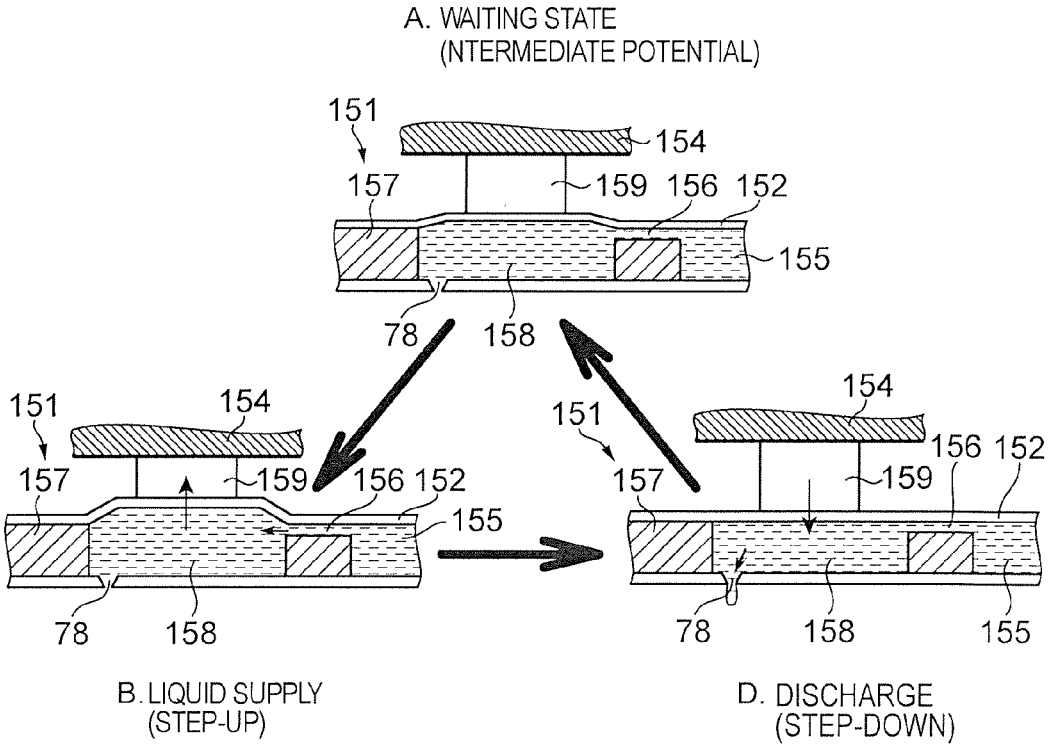
FIG. 9B is a sectional view schematically showing a discharging operation of the droplet discharge head by an operation of the piezoelectric element corresponding to the drive waveform.

A drive waveform of a drive signal applied to the piezoelectric element 159, and a discharging operation by an operation of the piezoelectric element 159 to which the drive signal having the drive waveform is applied will be described with reference to FIGS. 9A and 9B. FIGS. 9A and 9B are diagrams showing a fundamental waveform of a drive waveform and an operation of a piezoelectric element corresponding to the drive waveform. FIG. 9A is a diagram showing a fundamental waveform of a drive signal to be applied to a piezoelectric element. FIG. 9B is a sectional view schematically showing a discharge operation of a droplet discharge head by an operation of the piezoelectric element corresponding to the waveform.

As shown in FIG. 9A, a certain voltage is applied to the piezoelectric element 159 in a waiting state that is before a drive signal is applied (a state A in FIG. 9A). This voltage is referred to as an intermediate potential. In a performance of the drawing, the voltage to be applied to the piezoelectric element 159 is raised up to the intermediate potential before the start of the drawing, and the voltage is returned to the ground level after the drawing.

As shown in FIG. 9B, in the waiting state in which the piezoelectric element 159 is maintained at the intermediate potential, the piezoelectric element 159 is slightly constricted so as to pull the vibrating plate 12 toward a side of the piezoelectric element 159. Therefore, the vibrating plate 152 bends toward a side opposite to the pressure chamber 158 (a state A in FIG. 9B).

In a first step of a drive period, a voltage to be applied to the piezoelectric element 159 is raised up to a high potential from the intermediate potential (a state B in FIG. 9A). Due to the raise of the voltage to be applied to the piezoelectric element 159, the piezoelectric element 159 further constricts and the vibrating plate 152 receives a force by which the plate 152 is pulled toward a side opposite to the pressure chamber 158. Pulled toward the side opposite to the pressure chamber 158, the vibrating plate 152 made of a flexible material bends toward the side opposite to the pressure chamber 158. Due to the bend of the vibrating plate 152, the volume of the pressure chamber 158 is increased, so that the functional liquid is supplied to the pressure chamber 158 from the reservoir 155 through the supply opening 156 (a state B in FIG. 9B). This step is referred to as a step-up liquid supply step. In the step-up liquid supply step, the piezoelectric element 159 is slowly displaced so as to prevent air from entering the pressure chamber from the discharge nozzle 78. The voltage of the high potential applied to the piezoelectric element 159 corresponds to the drive voltage applied for driving the droplet discharge head 17.

After the step-up liquid supply step, a state keeping the voltage to be applied to the piezoelectric element 159 at high potential is maintained. This state is referred to as a waiting state before discharge (a state C in FIG. 9A). A piezoelectric material for the piezoelectric element 159 mechanically vibrates even after the voltage fluctuation is stopped. Therefore, a step of waiting until the mechanical vibration is stopped is the waiting state before discharge.

After the waiting state before discharge is maintained until the mechanical vibration is stopped, the voltage applied to the piezoelectric element 159 is rapidly stepped down (a state D in FIG. 9A). The rapid stepping down of the voltage applied to the piezoelectric element 159 makes the displacement of the piezoelectric element 159 zero at once. Accordingly, the pressure chamber 158 is rapidly narrowed so as to discharge the functional liquid that has filled the pressure chamber 158 from the discharge nozzle 78 (a state D in FIG. 9B). This step is referred to as a step-down discharge step.

A constriction amount of the piezoelectric element 159 differs depending on the voltage value of the high potential, so that an increasing amount of the volume of the pressure chamber 158 differs. Therefore, changing of the voltage value of the high potential can adjust an amount of the functional liquid supplied to and discharged from the pressure chamber 158, that is, a discharge amount from the droplet discharge head 17.

After the step-down discharge step, a state keeping the voltage to be applied to the piezoelectric element 159 at low potential is maintained. This state is referred to as a waiting state after discharge (a state E in FIG. 9A). A step of keeping the state of low potential until the mechanical vibration of the piezoelectric element 159 is stopped is the waiting state after discharge.

After the waiting state after discharge is maintained until the mechanical vibration of the piezoelectric element 159 is stopped, the voltage applied to the piezoelectric element 159 is raised up to the intermediate potential (a state F in FIG. 9A) so as to make the voltage in the waiting state (the intermediate potential) again.

Structure of Liquid Crystal Display Panel

A liquid crystal display panel that is an example of a liquid crystal device as an electrooptical device will be described. The electrooptical device uses the droplet discharge device 1 so as to form a functional film. A liquid crystal display panel 200 (refer to FIG. 10) is an example of the liquid crystal device, and is a liquid crystal display panel having a color filter for a liquid crystal display panel as an example of the color filter.

Figure 10:
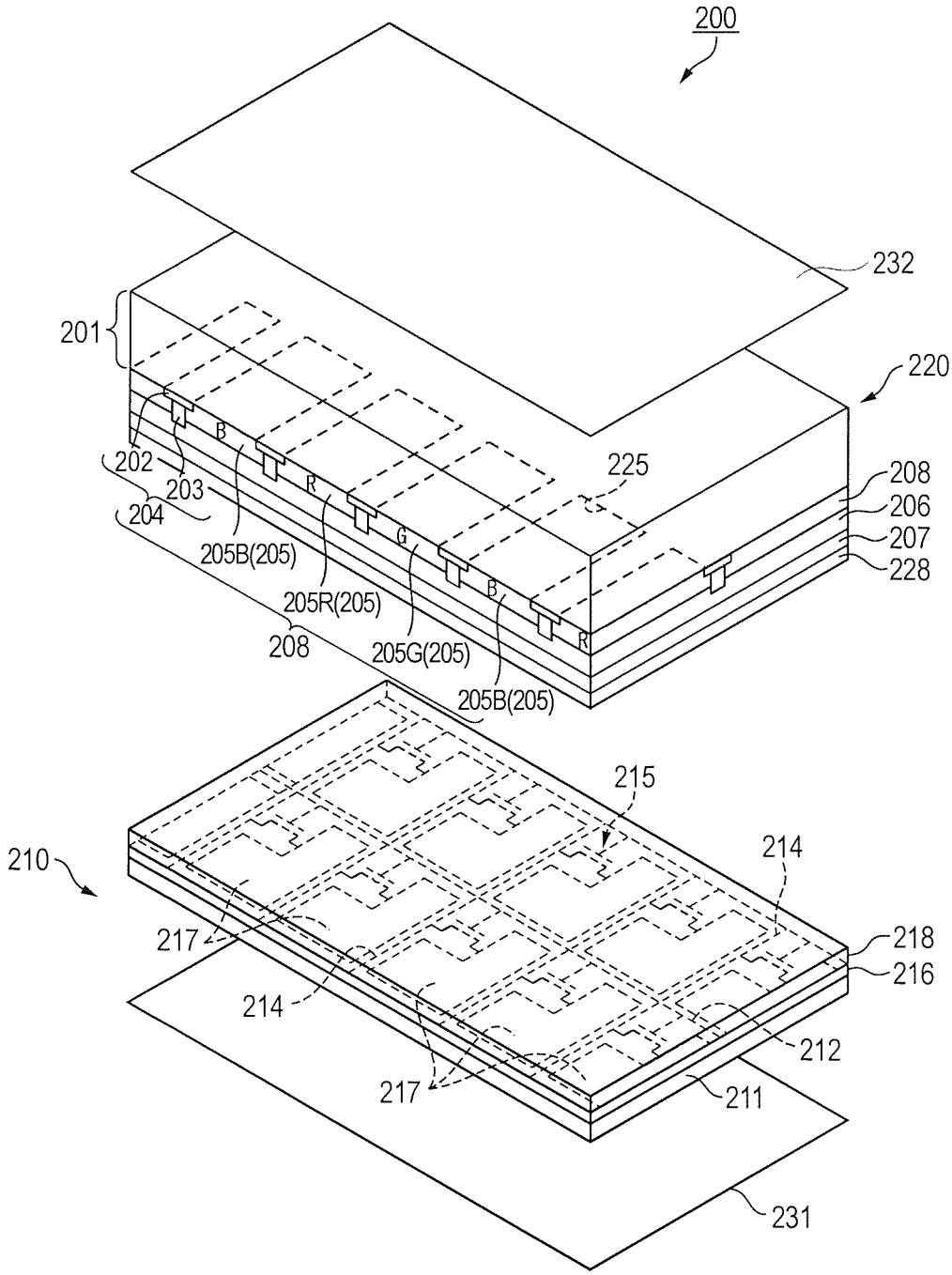
FIG. 10 is an exploded perspective view schematically showing a structure of a droplet discharge panel.

A structure of the liquid crystal display panel 200 will be first described with reference to FIG. 10. FIG. 10 is an exploded perspective view schematically showing a structure of a droplet discharge panel. This liquid crystal display panel 200 shown in FIG. 10 is an active matrix type liquid crystal device using a thin film transistor (TFT) as a driving element, and also is a transmissive liquid crystal device using a back light which is not shown.

As shown in FIG. 10, the liquid crystal panel 200 includes an element substrate 210 having a TFT element 215; a counter substrate 220 having a counter electrode 207; and liquid crystal 230 (refer to FIG. 15K) filling a space between the element substrate 210 and the counter substrate 220 that are bonded with each other by a sealant (not shown). To surfaces, opposed to surfaces that are bonded with each other, of the element substrate 210 and the counter substrate 220, a polarizing plate 231 and a polarizing plate 232 are respectively formed.

The element substrate 210 is provided with the TFT element 215, and a pixel electrode 217, a scanning line 212, and a signal line 214 that have conductivity on a surface, facing the counter substrate 220, of a glass substrate 211. An insulation layer 216 is formed so as to fill a space between these elements and a film having conductivity. The scanning line 212 and the signal line 214 are formed so as to cross each other with a part of the insulation layer 216 interposed. The scanning line 212 and the signal line 214 are insulated from each other by interposing the part of the insulation layer 216. In an area surrounded by the scanning line 212 and the signal line 214, the pixel electrode 217 is provided. The pixel electrode 217 has a rectangular shape of which one corner portion is cut out in a rectangular shape. The TFT element 215 including a source electrode, a drain electrode, a semiconductor portion, and a gate electrode is fitted in the part surrounded by a cutout part of the pixel electrode 217, the scanning line 212, and the signal line 214. The TFT element 215 is turned on and off with an application of a signal with respect to the scanning line 212 and the signal line 214 so as to perform conducting control to the pixel electrode 217.

On a surface, which contacts with the liquid crystal 230, of the element substrate 210, an alignment film 218 is provided. The alignment film 218 covers the whole area in which the scanning line 212, the signal line 214, and the pixel electrode 217 described above are formed.

The counter substrate 220 is provided with a color filter (hereinafter, referred to as "CF") layer 208 on a surface, which faces the element substrate 210, of a glass substrate 201. The CF layer 208 includes a partition 204, a red filter film 205R, a green filter film 205G, and a blue filter film 205B. A black matrix 202 constituting the partition 204 is formed in matrix on the glass substrate 201, and a bank 203 is formed on the black matrix 202. The partitions 204 composed of the black matrix 202 and the bank 203 form a filter film region 225 having a rectangular shape. In the filter film region 225, the red filter film 205R, the green filter film 205G, or the blue filter film 205B is formed. Each of the red filter film 205R, the green filter film 205G, and the blue filter film 205B is formed on a position facing the pixel electrode 217 in a shape corresponding to the pixel electrode 217.

On the CF layer 208 (a side facing the element substrate 210), a planarization film 206 is provided. On the planarization film 206, the counter electrode 207 made of a transparent conductive material such as ITO is provided. Due to the provision of the planarization film 206, a surface on which the counter electrode 207 is formed is nearly planarized. The counter electrode 207 is contiguous films having a size to cover the whole region in which the pixel electrode 217 described above is formed. The counter electrode 207 is coupled to a wiring formed on the element substrate 210 through a conduction part which is not shown.

On a surface, which contacts with the liquid crystal 230, of the counter substrate 220, an alignment film 228 covering the whole surface of the pixel electrode 217 is provided. The liquid crystal 230 is filled in a space surrounded by the alignment film 228 of the counter substrate 220, the alignment film 218 of the element substrate 210, and a sealant for bonding the counter substrate 220 and the element substrate 210, in a state that the element substrate 210 and the counter substrate 220 are bonded to each other.

The liquid crystal display panel 200 has a transmissive structure, but the panel 200 may be formed to be a reflective liquid crystal device provided with a reflective layer or a transflective liquid crystal device provided with a transflective layer.

Mother Counter Substrate

Figure 11A:
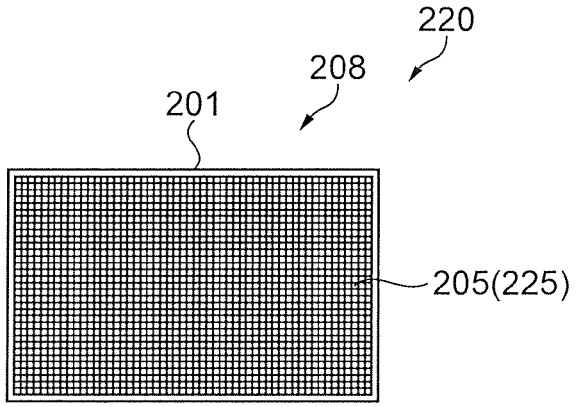
FIG. 11A is a plan view schematically showing a planar structure of a counter substrate.
Figure 11B:
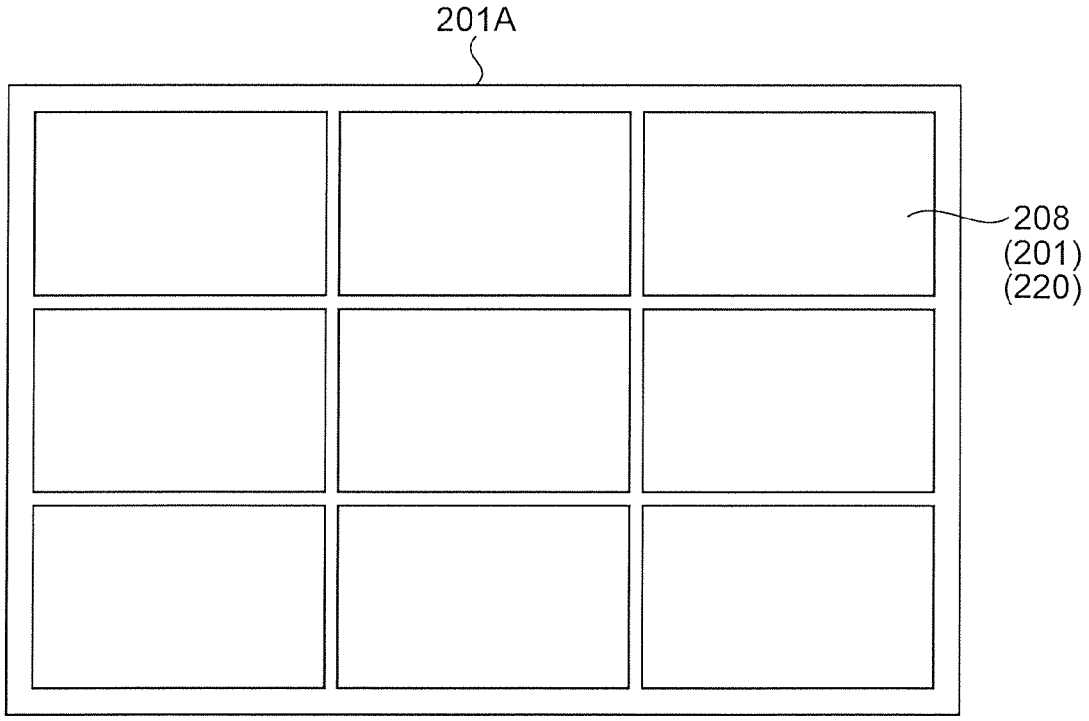
FIG. 11B is a plan view schematically showing a planar structure of a mother counter substrate.

A mother counter substrate 201A will be described with reference to FIGS. 11A and 11B. The counter substrate 220 is formed such that after the CF layer 208 and the like are formed on the mother counter substrate 201A, which is to be divided to be glass substrates 201, the mother counter substrate 201A is divided so as to form separate counter substrates 220 (glass substrates 201). FIG. 11A is a plan view schematically showing a planar structure of a counter substrate. FIG. 11B is a plan view schematically showing a planar structure of a mother counter substrate. In the embodiment, a substrate which is provided with the CF layer 208 and the like, and a substrate on which the formation of the CF layer 208 and the like is ongoing are called the mother counter substrate 201A.

The counter substrate 220 is composed of the glass substrate 201 which is made of transparent quartz glass having the thickness of 1.0 mm. As shown in FIG. 11A, the counter substrate 220 is provided with the CF layer 208 formed on a part, other than a small frame-region which is a circumference of the glass substrate 201, of the glass substrate 201. The CF layer 208 is formed such that a plurality of filter film regions 225 are formed on a surface of the glass substrate 201 having a rectangular shape in a dot pattern fashion, which is a dot matrix fashion in the embodiment, and filter films 205 are formed on the filter film regions 225. In an area, other than the area in which the CF layer 208 is formed, of the glass substrate 201, an alignment mark which is not shown is formed. The alignment mark is used as a positioning reference mark in setting the glass substrate 201 on a manufacturing device such as the droplet discharge device 1 so as to execute steps for forming the CF layer 208 and the like.

As shown in FIG. 11B, in the mother counter substrate 201A, the CF layer 208 of the counter substrate 220 is formed on each part, which is to be the glass substrate 201, in a separate fashion.

Color Filter

Figure 12A:
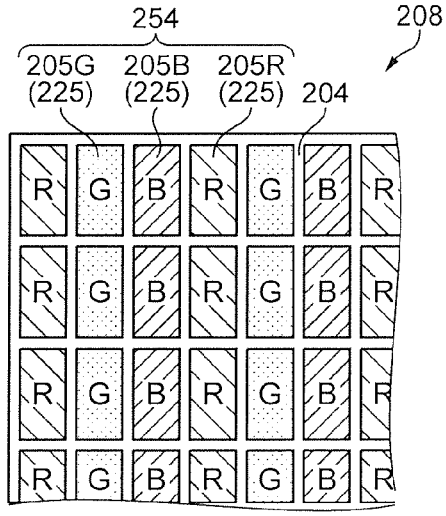
FIGS. 12A to 12C are plan views schematically showing arrangement examples of filter films of a three-color filter.
Figure 12B:
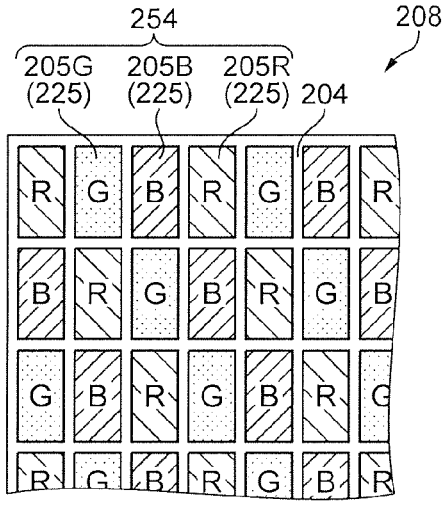
Figure 12C:
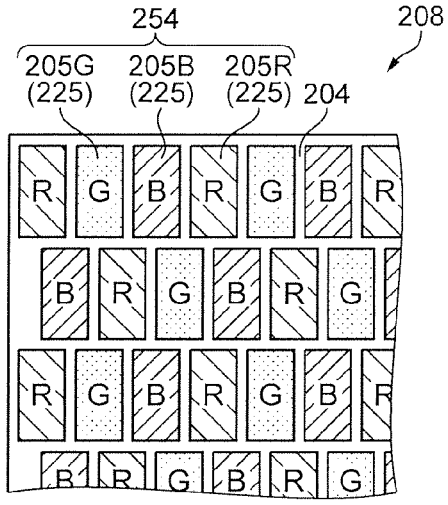

The CF layer 208 formed on the counter substrate 220 and arrangements of the filter films 205 (the red filter film 205R, the green filter film 205G, and the blue filter film 205B) will be described with reference to FIGS. 12A to 12C. FIGS. 12A to 12C are plan views schematically showing arrangement examples of filter films of a three-color filter.

As shown in FIGS. 12A to 12C, the filter films 205 are formed by filling a plurality of the filter film regions 225, which have a rectangular shape for example, with color material. The filter film regions 225 are separated by the partition 204, which is formed in lattice-like pattern and made of a non-translucent resin material, and arranged in dot matrix. For example, a functional liquid containing a color material for forming the filter films 205 is filled in the filter film area 225, and then a solvent of the functional liquid is evaporated. Thus, the filter films 205 filling the filter film regions 225 are formed.

As arrangements of the red filter films 205R, the green filter films 205G, and the blue filter films 205B in the three-color filter, a stripe arrangement, a mosaic arrangement, and a delta arrangement are known. In the stripe arrangement, all of films on one column are the red filter films 205R, the green filter films 205G, or the blue filter films 205B, as shown in FIG. 12A. In the mosaic arrangement, the films in adjacent rows are arranged to shift by one color, that is, one filter film in the lateral direction. In a case of a three-color filter, any three filter films 205 adjacent to each other on a column or a row have different colors, i.e. three colors, as shown in FIG. 12B. In the delta arrangement, the filter films 205 are arranged to be staggered. In a case of a three-color filter, any three filter films 205 adjacent to each other have different colors, as shown in FIG. 12C.

In a three-color filter shown in FIGS. 12A to 12C, each of the filter films 205 is made of a color material of one of red (R), green (G), and blue (B). A group including each of the red filter film 205R, the green filter film 205G, and the blue filter film 205B that are formed adjacent to each other forms a picture element filter (hereinafter, referred to as a "picture element filter 254") that is the minimum unit constituting a pixel. Full-color display is realized by selectively letting light pass through one of the red filter film 205R, the green filter film 205G, and the blue filter film 205B or a combination of these, and further adjusting an amount of passing light.

Formation of Liquid Crystal Display Panel

Figure 13:
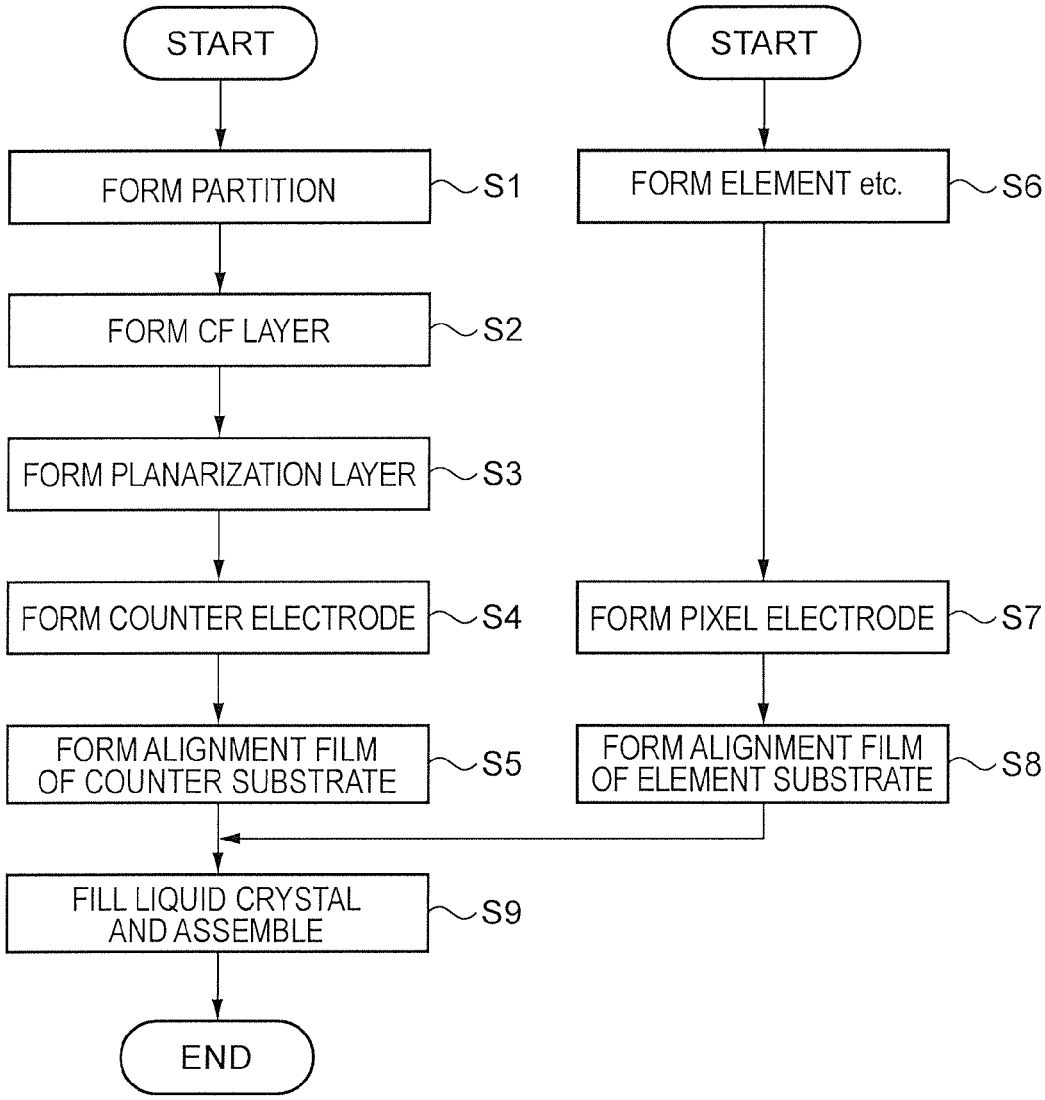
FIG. 13 is a flow chart showing a process of forming the liquid crystal display panel.

A process of forming the liquid crystal display panel 200 will be described with reference to FIGS. 13 to 15K. FIG. 13 is a flow chart showing the process of forming a liquid crystal display panel. FIGS. 14A to 14F are sectional views showing a step of forming a filter film and the like in the process of forming a liquid crystal display panel. FIGS. 15G to 15K are sectional views showing a step of forming an alignment film and the like in the process of forming a liquid crystal display panel. The liquid crystal display panel 200 is formed by bonding the element substrate 210 and the counter substrate 220 that are individually formed.

The counter substrate 220 is formed by executing a step S1 through a step S5 shown in FIG. 13.

Figure 14A:
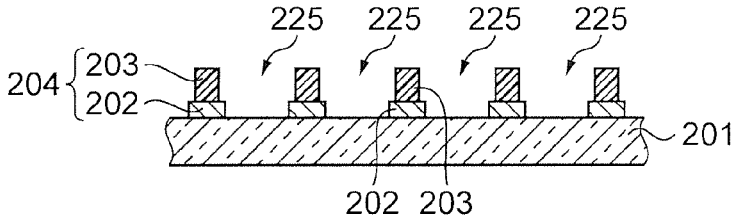
FIGS. 14A to 14F are sectional views showing a step for forming a filter film and the like in a forming process of the liquid crystal display panel.

In the step S1, a partition part for sectioning the filter film regions 225 is formed on the glass substrate 201. The partition part is formed by arranging the partitions 204 in matrix. The partition 204 is composed of the black matrix 202 formed in matrix and the bank 203 formed on the black matrix 202. Accordingly, as shown in FIG. 14A, filter film regions 225 that are sectioned by the partition 204 and have a rectangular shape is formed on the surface of the glass substrate 201.

Then, in the step S2 shown in FIG. 13, red filter films 205R, green filter films 205G, and blue filter films 205B are formed so as to form the CF layer 208. The red filter films 205R, the green filter films 205G, and the blue filter films 205B are formed by filling functional liquids respectively containing materials for forming the red filter film 205R, the green filter film 205G, and the blue filter film 205B in the filter film regions 225 and drying the functional liquids.

Figure 14B:
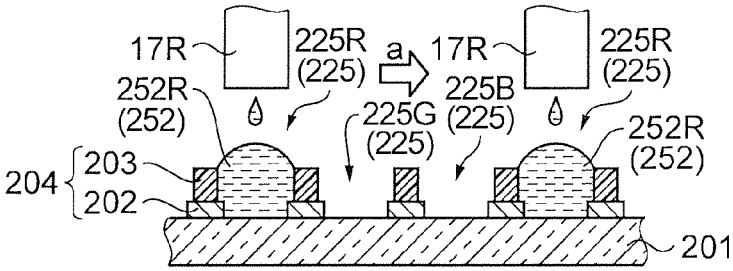

In specific, as shown in FIG. 14B, a red discharge head 17R is positioned to face the surface of the glass substrate 201 on which the filter film areas 225 that are sectioned by the partition 204 are formed. A red functional liquid 252R is discharged toward a filter film region 225R, in which a red filter film 205R is formed, from the discharge nozzle 78 included in the red discharge head 17R so as to arrange the red functional liquid 252R in the filter film region 225R. At the same time, the red discharge head 17R is moved as an arrow a shown in the drawing relatively to the glass substrate 201 so as to arrange the red functional liquid 252R in all filter film regions 225R. The red functional liquid 252R that is arranged is dried so as to form the red filter film 205R in the filter film region 225R, as shown in FIG. 14C.

Figure 14C:
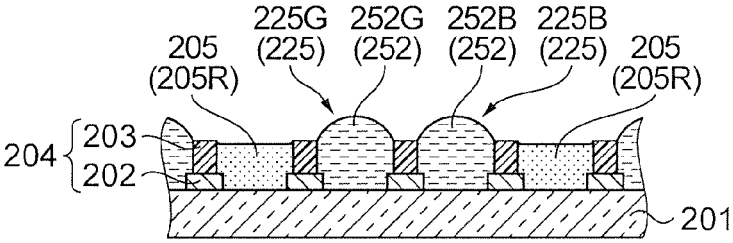
Figure 14D:
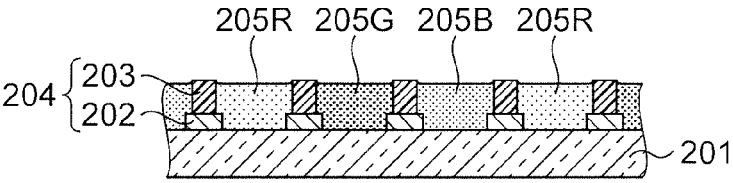

In the same manner, a green functional liquid 252G and a blue functional liquid 252B are respectively arranged in a filter film region 225G and a filter film region 225B, shown in FIG. 14B, on which the green filter film 205G and the blue filter film 205B are respectively formed as shown in FIG. 14C. The green functional liquid 252G and the blue functional liquid 252B are dried so as to respectively form the green filter film 205G and the blue filter film 205B respectively in the filter film region 225G and the filter film region 225B, as shown in FIG. 14D. Thus, a three-color filter composed of the red filter film 205R, the green filter film 205G, and the blue filter film 205B is formed.

Figure 14E:
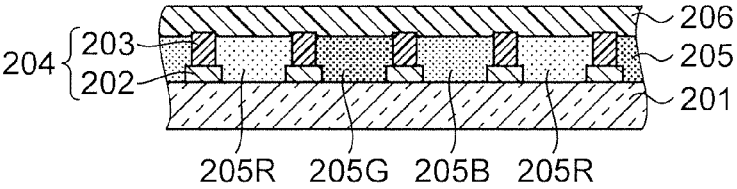

In the step S3 shown in FIG. 13, a planarization layer is formed. As shown in FIG. 14E, the planarization film 206 serving as a planarization layer is formed on the CF layer 208 composed of the red filter film 205R, the green filter film 205G, the blue filter film 205B, and the partition 204. The planarization film 206 is formed in a region which covers at least the whole of the CF layer 208. Due to the provision of the planarization film 206, a surface on which the counter electrode 207 is formed is nearly planarized.

Figure 14F:
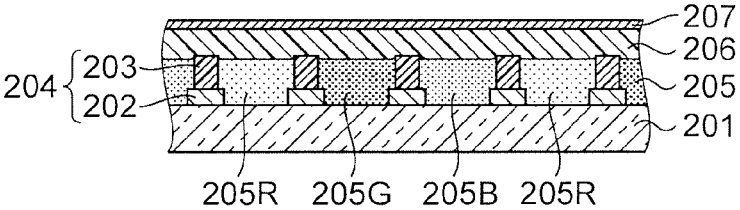

In the step S4 shown in FIG. 13, the counter electrode 207 is formed. As shown in FIG. 14F, a thin film is formed on a region of the planarization film 206 with a transparent conductive material. The region of the planarization film 206 covers at least the whole surface of the region, in which the filter films 205 are formed, of the CF layer 208. The thin film is the counter electrode 207 described above.

In the step S5 shown in FIG. 13, the alignment film 228 of the counter substrate 220 is formed on the counter electrode 207. The planarization film 228 is formed in a region which covers at least the whole of the CF layer 208.

Figure 15G:
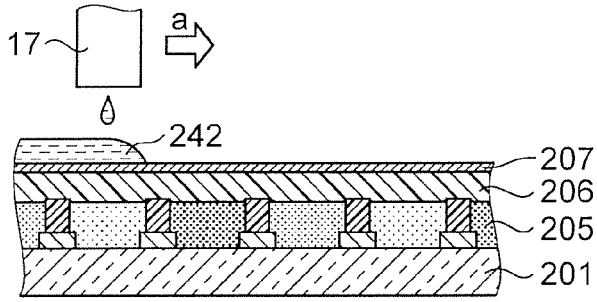
FIGS. 15G to 15K are sectional views showing a step for forming an alignment film and the like in the forming process of the liquid crystal display panel.
Figure 15H:
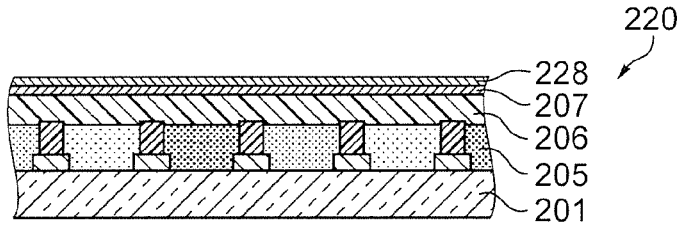

As shown in FIG. 15G, the droplet discharge head 17 is positioned to face the surface of the glass substrate 201 on which the counter electrode 207 is formed, and an alignment film liquid 242 is discharged toward the surface of the glass substrate 201 from the droplet discharge head 17. At the same time, the droplet discharge head 17 is moved as the arrow a shown in the drawing relatively to the glass substrate 201 so as to arrange the alignment film liquid 242 on the whole surface of a region, in which the alignment film 228 is to be formed, of the glass substrate 201. The alignment film liquid 242 that is arranged is dried so as to form the alignment film 228, as shown in FIG. 15H. The counter substrate 220 is completed by executing the step S5.

The element substrate 210 is formed by executing a step S6 through a step S8 shown in FIG. 13.

In the step S6, a conductive layer, an insulating layer, and a semiconductor layer are formed on the glass substrate 211 so as to form elements such as the TFT element 215; the scanning line 212; the signal line 214; and the insulating layer 216. The scanning line 212 and the signal line 214 are formed on a position facing the partition 204, that is, a circumferential position of a pixel, in a state that the element substrate 210 and the counter substrate 220 are bonded with each other. The TFT element 215 is formed so as to be positioned at an end of the pixel, and at least one TFT element 215 is formed in one pixel.

In the step S7, the pixel electrodes 217 are formed. The pixel electrodes 217 are formed on positions to face the red filter film 205R, the green filter film 205G, and the blue filter film 205B in a state that the element substrate 210 and the counter substrate 220 are bonded with each other. The pixel electrodes 217 are electrically coupled with a drain electrode of the TFT element 215.

In the step S8, the alignment film 218 of the element substrate 210 is formed on the pixel electrodes 217 and the like. The alignment film 218 is formed on a region which covers at least the whole surface of all of the pixel layers 217.

Figure 15I:
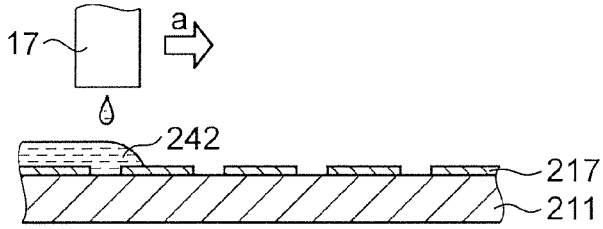
Figure 15J:
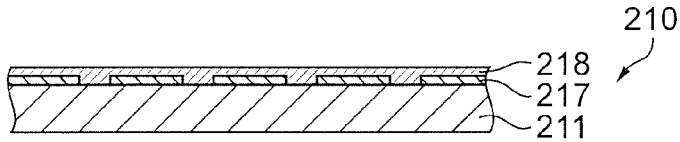

As shown in FIG. 15I, the droplet discharge head 17 is positioned to face the surface of the glass substrate 211 on which the pixel electrodes 217 are formed so as to discharge the alignment film liquid 242 toward the surface of the glass substrate 211 from the droplet discharge head 17. At the same time, the droplet discharge head 17 is moved as the arrow a shown in the drawing relatively to the glass substrate 211 so as to arrange the alignment film liquid 242 on the whole surface of a region, in which the alignment film 218 is to be formed, of the glass substrate 211. The alignment film liquid 242 that is arranged is dried so as to form the alignment film 218, as shown in FIG. 15J. The element substrate 210 is completed by executing the step S8.

Figure 15K:
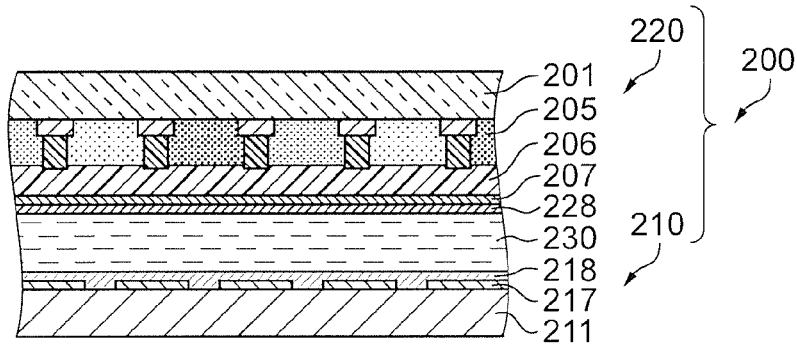

Subsequently, in the step S9 shown in FIG. 13, the liquid crystal 230 is filled in a space between the counter substrate 220 and the element substrate 210 which are bonded with each other, as shown in FIG. 15K. Further, the polarizing plate 231 and the polarizing plate 232 are bonded, for example, assembling the liquid crystal display panel 200. In a case where a plurality of counter substrates 220 and element substrates 210 are formed on a mother substrate composed of a plurality of glass substrates 201 or the glass substrates 211, the mother substrate on which a plurality of liquid crystal display panels 200 is divided into individual liquid crystal display panels 200. Alternatively, after the step of dividing the mother counter substrate 201A or the mother element substrate into the counter substrates 220 or the element substrates 210 is executed, the step S9 is executed. After the step S9 is executed, the process of forming the liquid crystal display panel 200 is ended.

Structure of Wiring Board

Figure 16:
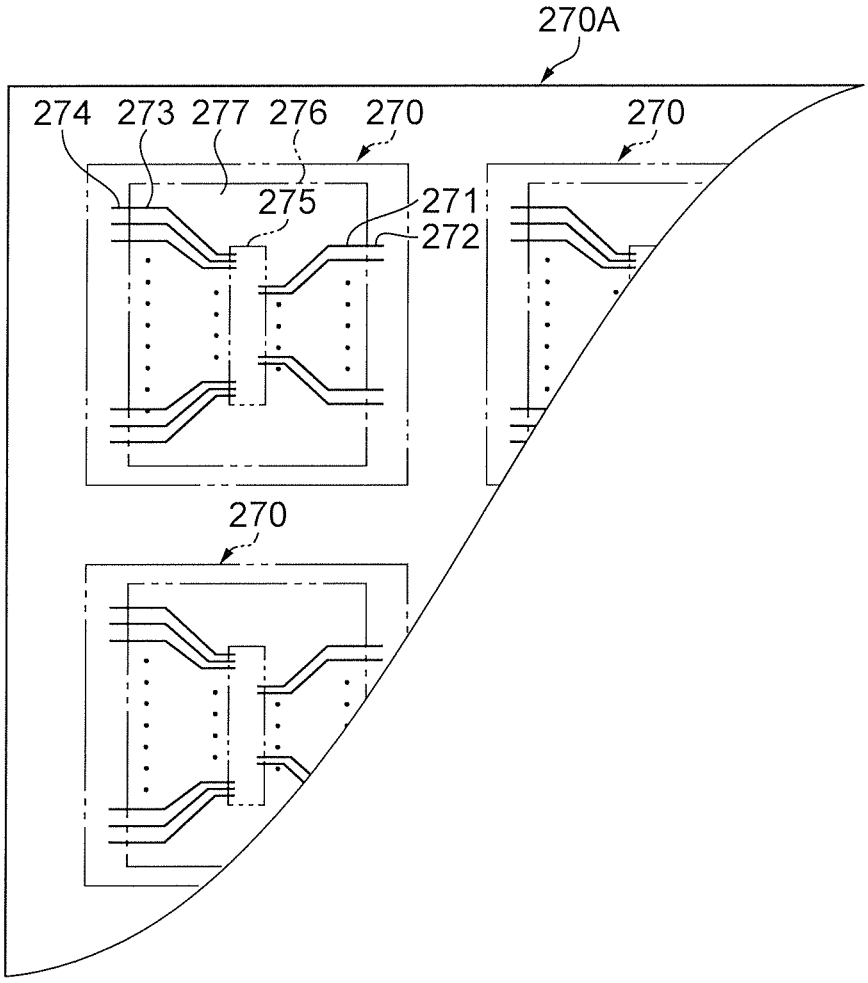
FIG. 16 is a plan view schematically showing a mother substrate of a wiring board.

A wiring board on which a metal wiring is formed will be described with reference to FIG. 16. The wiring board is an example of an object on which a functional liquid is arranged by the droplet discharge device 1 so as to form a functional film. FIG. 16 is a plan view schematically showing a mother substrate of a wiring board.

As shown in FIG. 16, a wiring board 270 is a circuit substrate on which a semiconductor device (IC) is surface-mounted, and includes an input wiring 271 and an output wiring 273, which are made of a conductive material and arranged corresponding to an input/output electrode (bump) of the IC, and an insulation film 277. The insulation film 277 is formed on a part within an outline 276 shown by a two-dot chain line other than a mounting region 275 shown by a two-dot chain line. Further, the insulation film 277 covers a plurality of input wirings 271 and output wirings 273 in a manner avoiding an input terminal part 272 and an output terminal part 274 and exposing a part of the input wirings 271 and the output wirings 273 within the mounting region 275. A plurality of the wiring boards 270 are formed on a mother substrate 270A in matrix. By dividing the mother boards 270A, individual wiring substrates 270 are obtained. The mother substrate 270A may be a glass substrate, a ceramic substrate, a glass epoxy resin substrate, which are rigid, or may be a flexible resin substrate as an insulation substrate. For dividing the mother substrate 270A, scribing, dicing, laser cutting, pressing, or the like is selected depending on the material of the mother substrate 270A.

In the embodiment, the input wirings 271 and the output wirings 273 that are made of a conductive material, and the insulation film 277 that is made of an insulating material are formed by a droplet discharge method with the droplet discharge device 1 described above. By the droplet discharge, wirings and insulating films can be formed without wasting each material. In addition, as compared to photolithography, the droplet discharge method does not require a mask for exposure or a process such as development, etching, or the like in forming a pattern. Therefore, the manufacturing process can be simplified regardless of the dimensions of the mother substrate 270A.

The conductive material contained in the functional liquid that is discharged from the droplet discharge device 1 may be metallic fine particles containing at least any one of gold, silver, copper, aluminum, palladium, and nickel; an oxide of any of these; fine particles of conductive polymer or superconductor; or the like, for example. These conductive fine particles may be used with their surfaces coated with an organic matter, for example, to improve their dispersibility. The diameter of the conductive fine particles is preferably in the range from 1 nm to 1.0 μm inclusive. A particle diameter larger than 1.0 μm can cause clogging of the discharge nozzles 78 of the droplet discharge heads 17. On the other hand, particles whose diameter is smaller than 1 nm may make the volume ratio of a coating agent to the conductive fine particles so large that the ratio of the organic matter in an obtained film becomes excessive.

Here, any dispersion medium can be used as long as the dispersion medium is capable of dispersing the above-described conductive fine particles and does not cause an aggregation. Examples of the dispersion medium includes: water; alcohols such as methanol, ethanol, propanol, and butanol; hydro-carbon compounds such as n-heptane, n-octane, decane, dodecane, tetradecane, toluene, xylene, cymene, durene, indene, dipentene, tetrahydronaphthalene, decahydronaphthalene, and cyclohexylbenzene; ether compounds such as ethylene glycol dimethyl ether, ethylene glycol diethyl ether, ethylene glycol methyl ethyl ether, diethylene glycol dimethyl ether, diethylene glycol diethyl ether, diethylene glycol methyl ethyl ether, 1,2-dimethoxyethane, his (2-methoxyethyl)ether, and p-dioxane; and polar compounds such as propylene carbonate, gamma-butyrolactone, N-methyl-2-pyrrolidone, dimethylformamide, dimethyl sulfoxide, and cyclohexanone. Among these, water, alcohols, hydrocarbon compounds, and ether compounds are preferably used due to particulate dispersibility, dispersion-liquid stability, and applicability to a droplet discharge method, and more preferably, water and hydrocarbon compounds are used.

The surface tension of the dispersion liquid (functional liquid) of the conductive fine particles is preferably within the range from 0.02 N/m to 0.07 N/m inclusive. A surface tension less than 0.02 N/m for discharging the functional liquid by droplet discharge increases the functional liquid's wettability relative to the nozzle forming surface 76*a*, so that a flying curve may easily occur. A surface tension more than 0.07 N/m makes a meniscus shape at the tip of the discharge nozzle 78 unstable, making it difficult to control the amount and timing of discharge. To adjust the surface tension, a fluorine-, silicone-, or nonionic-based surface tension regulator, for example, may be added in a small amount to the dispersion liquid within a range not largely lowering a contact angle to the mother substrate 270A. The nonionic surface tension regulator enhances the wettability of the functional liquid with respect to the mother substrate 270A, improves leveling property of a film, and serves to prevent generation of minute irregularity of the film. The surface tension regulator may include, as necessary, organic compounds, such as alcohol, ether, ester, and ketone.

The viscosity of the dispersion liquid is preferably within the range from 1 mPa·s to 50 mPa·s inclusive. A viscosity lower than 1 mPa·s for discharging droplets of the functional liquid by droplet discharge may easily cause contamination of the periphery of the discharge nozzle 78 due to leakage of the functional liquid. A viscosity higher than 50 mPa·s may frequently cause clogging of the discharge nozzle 78, making it difficult to discharge droplets smoothly. The viscosity of the dispersion liquid changes in accordance with change of the temperature of the dispersion liquid, so that it is preferable that the temperature of the dispersion liquid is kept approximately constant.

Arrangement of Functional Liquid

Figure 17:
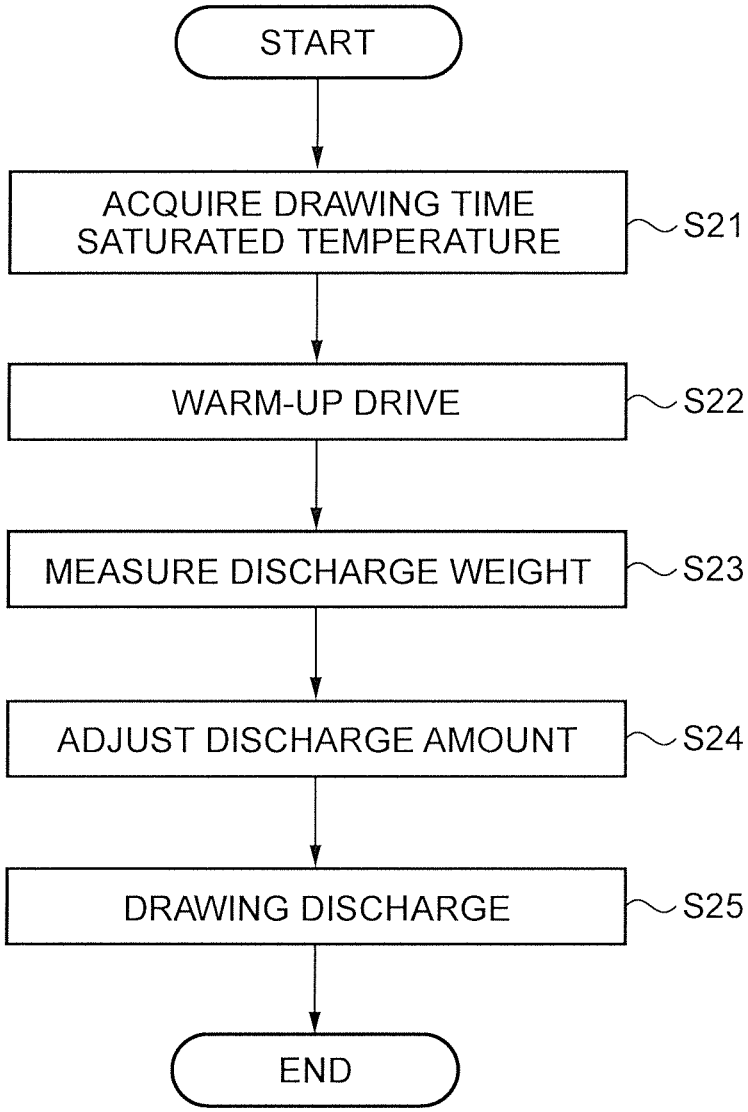
FIG. 17 is a flow chart showing a process of arranging a functional liquid.

A process of arranging the functional liquid will be described with reference to FIG. 17. In the process, the functional liquid is arranged to the filter film regions 225 of the CF layer 208 and the like on the mother counter substrate 201A by discharging the functional liquid from the droplet discharge head 17 included in the droplet discharge device 1. FIG. 17 is a flow chart showing the process of arranging the functional liquid.

In a step S21 shown in FIG. 17, a drawing time saturated temperature that is obtained in advance is acquired. When the functional liquid is discharged toward the mother counter substrate 201A and the like from the droplet discharge head 17 of the droplet discharge device 1, that is, the drawing discharge is executed, the temperature of the head 17 is changed due to driving of the head 17. Then, the temperature becomes nearly constant by continuing the driving of the head 17. This temperature is the drawing time saturated temperature. As the drawing time saturated temperature, data individually obtained of each of the twelve nozzle rows 78A formed in the discharge unit 2 is acquired. The nozzle rows 78A in this case correspond to nozzle groups.

As the temperature of the droplet discharge head 17, a temperature of such a part of the droplet discharge head 17 is used that the temperature of the part can be measured by relating variation of the temperature of the part to variation of the weight of a droplet discharged from the droplet discharge head 17, as described above. For example, a temperature of an outer wall surface of the pump part 75, a temperature of the nozzle plate 76, a temperature of a part, which constitutes the pressure chamber 158, of the vibrating plate 152, and the like can be used.

The temperature of the outer wall surface of the pump part 75 and the temperature of the part, constituting the pressure chamber 158, of the vibrating plate 152 can be measured by disposing the head temperature sensor 142 on these parts. Alternatively, the temperature of the part, constituting the pressure chamber 158, of the vibrating plate 152 can be measured by using the piezoelectric material of the piezoelectric element 159 as a temperature sensor. Further, the temperature of an outer wall surface of the pump part 75 and that of the nozzle plate 76 can be measured from a removed position by using a contactless infrared temperature sensor.

The discharge device controlling part 6 receives the drawing time saturated temperature from the input output device 68 of the controlling device 65, for example, and stored the temperature in the RAM 46 or the hard disk 48 thereof. The input output device 68 of the controlling device 65, for example, corresponds to a temperature acquisition unit.

In a step S22, warm-up drive is executed. Driving conditions used in the warm-up drive are conditions that are obtained in advance at individual temperatures corresponding to a desired drawing time saturated temperature and inputted and stored in the RAM 46 or the hard disk 48 of the discharge device controlling part 6. The drawing time saturated temperature is individually obtained for each of the twelve nozzle rows 78A formed in the discharge unit 2, so that an individual driving condition corresponding to the drawing time saturated temperature of each of the twelve nozzle rows 78A of the discharge unit 2 is employed.

The discharge device controlling part 6 executes the warm-up drive by driving the droplet discharge head 17 under the corresponding driving condition. In this case, the discharge device controlling part 6 corresponds to a temperature adjustment unit.

In a step S23, discharge weight measurement is executed.

At the start of the weight measurement, the X-axis second slider 23 is moved in the X-axis direction by the X-axis linear motor 26, and at the same time, the head unit 54 is moved in the Y-axis direction by the Y-axis linear motor. By this operation, the liquid receiving container 94 of each of the weight measurement devices 91 fixed on the X-axis second slider 23 is allowed to face a first droplet discharge head 17 of each of the head groups 55 of the head unit 54.

Weight measurement discharge is executed with respect to each liquid receiving container 94 from all nozzles in one nozzle row 78A of the first droplet discharge head 17 of each of the head groups 55. At this time, second and third droplet discharge heads 17 of each of the head groups 55 face the weight measurement time flashing box 95 and perform discarding discharge to the weight measurement time flashing box 95. After the weight measurement discharge of the predetermined amount is ended, the electronic balance 99 measures the weight of discharged droplets that land on the liquid receiving container 94.

The discharge weight measurement of the head groups 55 is executed by measuring discharge weight of each of the six nozzle rows 78A of the three droplet discharge heads 17 included in the head group 55. The weight measurement unit 19 provided with the weight measurement device 91 corresponds to a discharge amount measurement unit.

In a step S24, the discharge weight that is measured in the step S23 is compared with a specified discharge weight and the discharge amount is adjusted in accordance with the mismatched amount from the specified discharge weight. The discharge amount can be adjusted by changing a voltage value (drive voltage) of high potential in a driving waveform of a drive signal that is applied to the piezoelectric element 159 and thus adjusting the amount of the functional liquid to be filled in the pressure chamber 158, as described above with reference to FIGS. 9A and 9B. Alternatively, the discharge amount can be adjusted by adjusting time of the step-down discharge step and a voltage value of low potential, or by adjusting time of the step-up liquid supply step or time of the waiting state before discharge.

The discharge amount is adjusted at each of the twelve nozzle rows 78A of the discharge unit 2. The drive voltage value of the drive signal that is applied to the droplet discharge head 17 from the head driver 17*d* is adjusted by the CPU 44 that is controlled by a program stored in the ROM 45 and the like. The CPU 44 of this case corresponds to a discharge amount adjustment unit.

In a step S25, the functional liquid is discharged from the droplet discharge head 17 of which the discharge amount is adjusted in the step S24 toward the filter film regions 225 and the like, that is, the drawing discharge is executed.

After the execution of the drawing discharge of the step S25, the process of arranging the functional liquid is ended.

Here, when a processing object such as the mother counter substrate 201A after the execution of the drawing discharge is exchanged with a new processing object, the droplet discharge head 17 is in a resting state. Therefore, the temperature of the head 17 under the execution of the drawing discharge may not be maintained. Therefore, in a case where the head 17 rests, for example, during the exchange of processing objects in the drawing discharge, the warm-up drive of the head 17 is preferably executed so as to restrain change of the head temperature.

Setting of Condition of Warm-up Drive

Figure 18A:
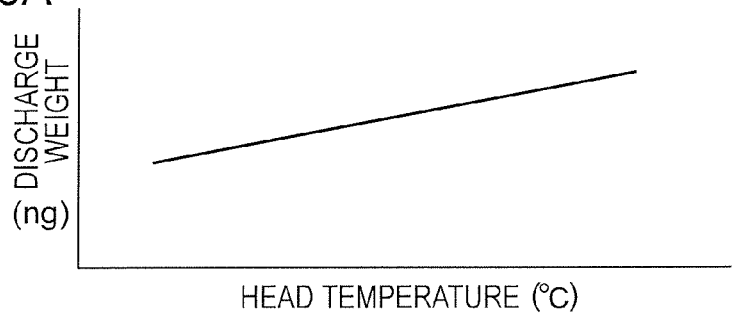
FIG. 18A is a graph showing a relation between a discharge amount and a head temperature.
Figure 18B:
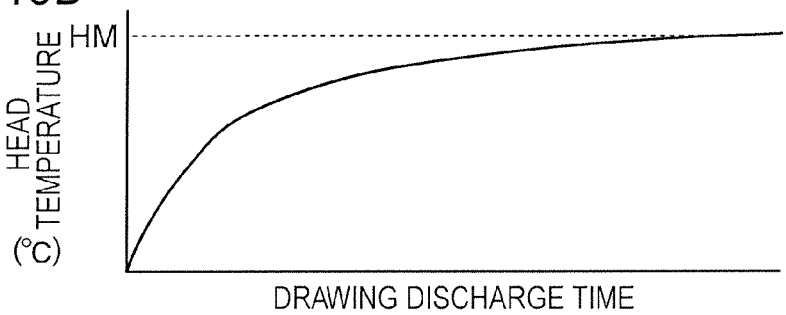
FIG. 18B is a graph showing a relation between time of performing drawing discharge and the head temperature.
Figure 18C:
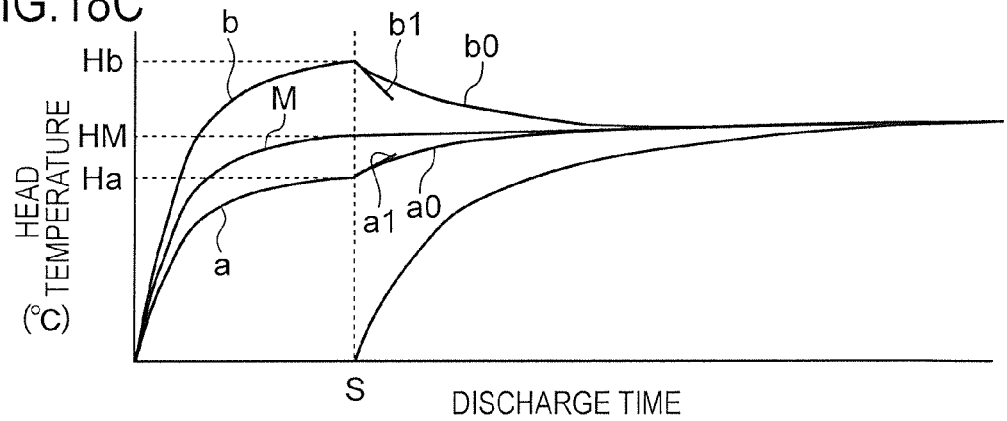
FIG. 18C is a graph showing a relation between time of performing warm-up drive and the drawing discharge and the head temperature.
Figure 18D:
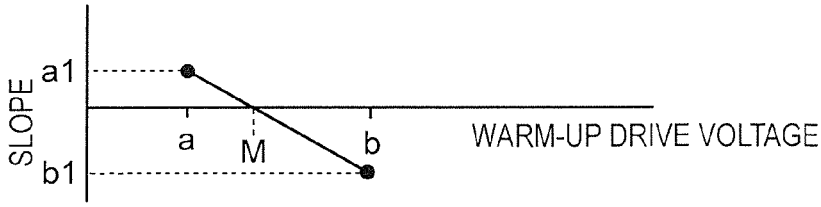
FIG. 18D is a graph showing a method for estimating a warm-up drive voltage.

A method for setting a condition of warm-up drive in the droplet discharge head 17 will be described with reference to FIGS. 18A to 18D. FIG. 18A is a graph showing a relation between a discharge weight (discharge amount) and a head temperature. FIG. 18B is a graph showing a relation between time for performing discharge drawing and a head temperature. FIG. 18C is a graph showing a relation between time for performing warm-up drive and discharge drawing and a head temperature. FIG. 18D is a graph showing a method for estimating a warm-up drive voltage.

As shown in FIG. 18A, a discharge amount of the droplet discharge head 17 depends on a head temperature of the droplet discharge head 17. As the head temperature of the droplet discharge head 17, a temperature of such part of the droplet discharge head 17 is used that the temperature of the part can be measured by relating variation of the temperature of the part to variation of the weight of a droplet discharged from the droplet discharge head 17, as described above. From the temperature of the part, a relation shown in FIG. 18A can be obtained.

As shown in FIG. 18B, the temperature of the droplet discharge head 17 performing drawing discharge increases as the performing time of the drawing discharge goes, and roughly settles at a drawing time saturated temperature HM° C.

As described with reference to FIG. 8, nozzle data transmitted to the shift registers 85 is latched with the timing with which a latch signal (LAT) is inputted into the latch circuit 86, and further, converted into a gate signal for the switch 88 by the level shifter 87. In a case where the nozzle date is "ON", the switch 88 is opened and a drive signal (COM) is supplied to the piezoelectric element 159 so as to discharge the functional liquid as droplets from a corresponding discharge nozzle 78. The discharged number of the functional liquid discharged from the discharge nozzle 78 as droplets with respect to the latched number is referred to as a "discharge ratio" of a discharge nozzle. An average value of the discharge ratios of all of the discharge nozzles 78 included in the droplet discharge head 17 is referred to as a discharge ratio of the droplet discharge head 17. An average value of the discharge ratios of all of the discharge nozzles 78 included in the nozzle row 78A is referred to as a discharge ratio of the nozzle row 78A. An average value of the discharge ratios of all of the discharge nozzles 78 included in a nozzle group composed of a plurality of discharge nozzles 78 is referred to as a discharge ratio of the corresponding nozzle group.

A drawing shape is various, so that the discharge ratio of the droplet discharge head 17 performing drawing discharge varies depending on the drawing shape. When the discharge ratio of the droplet discharge head 17 varies, operation states of the piezoelectric element 159 and a driving circuit of the piezoelectric element 159 vary. Therefore, the drawing time saturated temperature HM° C. also varies to be a value corresponding to each discharge ratio.

As shown in FIG. 18C, if the drawing discharge is started at a time point S without performing warm-up drive, the temperature of the droplet discharge head 17 performing drawing discharge roughly settles at an approximate drawing time saturated temperature HM° C. after a certain time of drawing discharge, as the case shown in FIG. 18B.

When warm-up drive is performed at a drive voltage a that is a drive voltage of a % of a design drive voltage by which a proper discharge amount is obtained, the head temperature converges at Ha° C. and the head temperature at the time point S becomes Ha° C. When drawing discharge is started at the head temperature of Ha° C., the head temperature increases as a temperature increasing curve indicated by a0 in FIG. 18C and roughly settles at an approximate drawing time saturated temperature HM° C. A slope at the time point S in the curve a0 is referred to as a1.

When warm-up drive is performed at a drive voltage b that is a drive voltage of b % of a design drive voltage by which a proper discharge amount is obtained, the head temperature converges at Hb° C. and the head temperature at the time point S becomes Hb° C. When drawing discharge is started at the head temperature of Hb° C., the head temperature decreases as a temperature decreasing curve indicated by b0 in FIG. 18C and roughly settles at an approximate drawing time saturated temperature HM° C. A slope at the time point S in the curve b0 is referred to as b1.

As shown in FIG. 18D, a value M of warm-up drive voltage at a point on which a line passing a point (a, a1) and a point (b, b1) meets a horizontal axis of the graph, that is, a value M in a case where a slope becomes 0 is obtained when the horizontal axis of the graph shows a warm-up drive voltage and a vertical axis shows a slope.

As shown in FIG. 18C, it is presumed that if warm-up drive is performed at a drive voltage M which is a drive voltage of M % of a design drive voltage by which a proper discharge amount is obtained, the head temperature converges at HM° C. and the head temperature at the time point S becomes the drawing time saturated temperature HM° C. In a case where the drawing discharge is started at the head temperature of the drawing time saturated temperature HM° C., there is little possibility that the temperature of the droplet discharge head 17 varies during the drawing discharge. Thus, the temperature of the droplet discharge head 17 is approximately stable from the start of the drawing discharge.

In a case where a reached temperature of the droplet discharge head 17 is different from the drawing time saturated temperature HM° C. in the performance of the warm-up drive at the drive voltage of M, the drive voltage of M of the warm-up drive is fine adjusted and the warm-up drive is performed again with the resulted drive voltage, thus obtaining a proper drive voltage, with which the drawing time saturated temperature HM° C. can be obtained, in the warm-up drive.

According to the first embodiment, the following advantageous effects can be obtained.

(1) In advance of the discharge weight measurement, the warm-up drive is performed so as to adjust the temperature of the droplet discharge head 17 in performing discharge weight measurement to the drawing time saturated temperature. Thus the temperature of the droplet discharge head 17 during the discharge weight measurement can be approximately same as the temperature during the drawing. Accordingly, a measurement error of the discharge weight can be restrained. The error is possibly caused by the difference between the temperature of the droplet discharge head 17 in the discharge weight measurement and the temperature of the droplet discharge head 17 in the drawing discharge.

(2) The warm-up drive is performed by using the drive voltage a or the drive voltage b. From the slope of increase or decrease of the head temperature at the time of the start of the drawing discharge, the drive voltage, by which the head temperature in the warm-up drive can be made be the drawing time saturated temperature HM° C., is estimated. Accordingly, time for obtaining the drive voltage can be shortened compared to a case obtaining a drive voltage in the warm-up drive by actually performing drawing discharge. Further, consumption of the functional liquid and a processed member consumed for obtaining the drive voltage can be suppressed.

(3) Measurement of the drawing time saturated temperature, adjustment of the head temperature, measurement of the discharge weight, and adjustment of the discharge amount corresponding to the measurement result are performed for each nozzle row 78A. Accordingly, even if there is variation between the temperatures of the nozzle rows 78A in the discharge unit 2, the variation is redressed so as to be able to perform measurement of the discharge weight and adjustment of the discharge amount on which an effect caused by the variation between temperatures of the nozzle rows 78A is suppressed.

(4) Measurement of the drawing time saturated temperature, adjustment of the head temperature, measurement of the discharge weight, and adjustment of the discharge amount corresponding to the measurement result are performed for each nozzle row 78A. Accordingly, measurement of the drawing time saturated temperature, adjustment of the head temperature, measurement of the discharge weight, and adjustment of the discharge amount corresponding to the measured result can be efficiently performed compared to a case performing these to each of the discharge nozzles 78. The functional liquid is supplied to the discharge nozzles 78 included in one nozzle row through the reservoir 155 that is shared by the nozzles 78. Thus the discharge nozzles 78 included in the nozzle row are lead to a common supply path, which is from the supply unit 60 to the reservoir 155, of the functional liquid. Therefore, it is presumable that conditions of the functional liquid which is supplied are nearly equivalent and variation between temperatures of the discharge nozzles 78 included in a nozzle row is small.

(5) The warm-up drive is performed at a drive voltage by which the head temperature can be made be the drawing time saturated temperature HM° C. by the performance of the warm-up drive. Therefore, by the performance of the warm-up drive, the temperature of the droplet discharge head 17 at least varies toward the drawing time saturated temperature HM° C. Accordingly, the possibility of excessive change of the head temperature can be decreased depending on time for performing the warm-up drive.

Second Embodiment

A second embodiment of the droplet discharge device, the droplet discharging method, the electrooptical device manufacturing device, the electrooptical device manufacturing method, the electronic apparatus manufacturing device, and the electronic apparatus manufacturing method will now be described. The droplet discharge device as the droplet discharge device of the second embodiment is used in the manufacturing line of a liquid crystal device as is the case with the first embodiment. The droplet discharge device includes an ink-jetting droplet discharge head which can discharge a functional liquid containing a material for a color element film. With this head, the droplet discharge device disposes the functional liquid on a glass substrate serving as a drawing object (processing object) so as to form a functional film such as a color element film of a color filter.

A droplet discharge device 301 (refer to FIG. 20) of the second embodiment has a similar basic structure and a similar function to the droplet discharge device 1 of the first embodiment. A different structure of the droplet discharge device 301 from that of the droplet discharge device 1, and a drawing step for forming a filter film 205 by the droplet discharge device 301 will be described.

Attachment of Droplet Discharge Head and Temperature Adjustment Unit

Figure 19A:
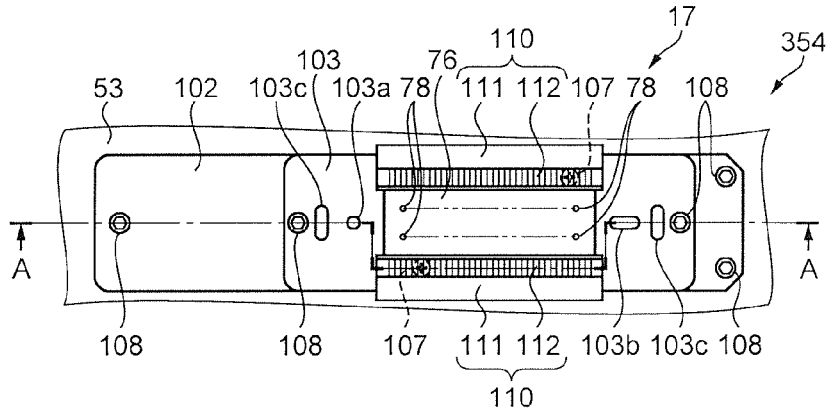
FIG. 19A is a plan view showing the droplet discharge head and a temperature adjustment unit attached to a carriage plate when viewed from the nozzle plate side.
Figure 19B:
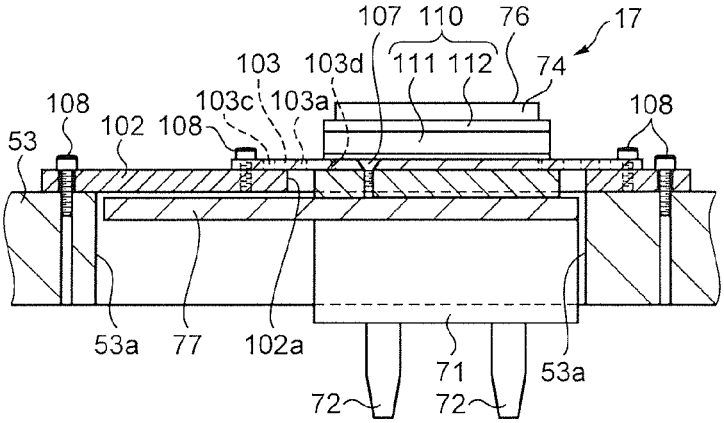
FIG. 19B is a sectional view showing a section taken at an A-A line of FIG. 19A.
Figure 19C:
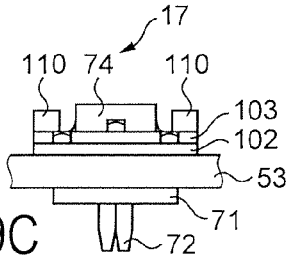
FIG. 19C is a lateral view showing the droplet discharge head and the temperature adjustment unit attached to the carriage plate.
Figure 19D:
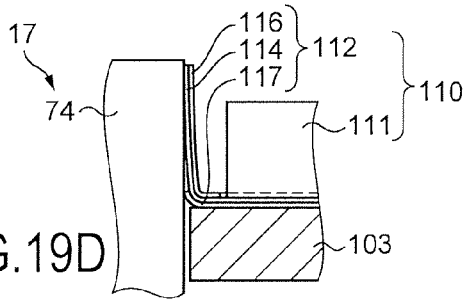
FIG. 19D is a lateral view showing the temperature adjustment unit attached to the carriage plate.
Figure 19E:
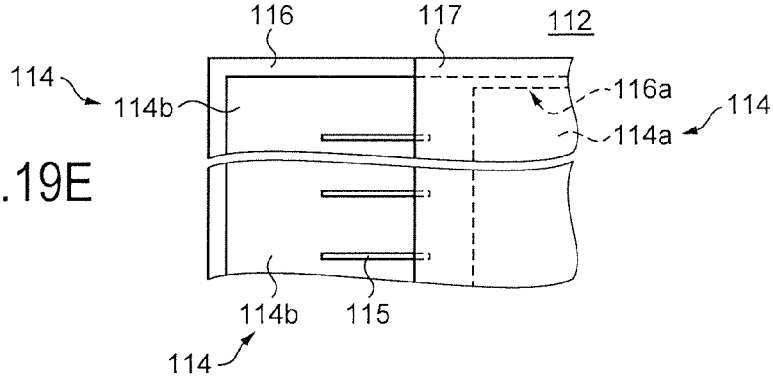
FIG. 19E is a plan view showing a terminal substrate of the temperature adjustment unit.

An attachment structure of the droplet discharge head 17 to the carriage plate 53 and an attachment structure of a temperature adjustment unit 110 in a head unit 354 included in a discharge unit 302 (refer to FIG. 20) will be first described with reference to FIGS. 19A to 19E. FIGS. 19A to 19E are diagrams showing an attachment structure of a droplet discharge head and a temperature adjustment unit to a carriage plate. FIG. 19A is a plan view showing the droplet discharge head and the temperature adjustment unit that are attached to the carriage plate and viewed from a nozzle plate. FIG. 19B is a sectional view showing a section taken along a line A-A of FIG. 19A. FIG. 19C is a lateral view showing the droplet discharge head and the temperature adjustment unit that are attached to the carriage plate. FIG. 19D is a lateral view showing the temperature adjustment unit attached to the carriage plate. FIG. 19E is a plan view showing a terminal substrate of the temperature adjustment unit.

As shown in FIG. 19A to 19C, the droplet discharge head 17 is attached to the carriage plate 53 with a main head holding member 102 and a sub head holding member 103 interposed. The main head holding member 102 and the sub head holding member 103 are used for accurately positioning the droplet discharge head 17 on the carriage plate 53 and for easily attaching and detaching the head 17 on and from the carriage plate 53.

A head opening 53*a* is formed on the carriage plate 53, and the main head holding member 102 is fixed on the carriage plate 53 in a manner roughly covering the head opening 53*a*. The main head holding member 102 is fixed on the carriage plate 53 by three holding member screws 108 engaging with screw holes which are formed on the carriage plate 53 in a manner going through holes formed on the main head holding member 102. Hereinafter, a surface on which the main head holding member 102 is set is referred to as a "back surface" and the other surface is referred to as a "front surface".

On the main head holding member 102, a flange opening 102*a* is formed. The sub head holding member 103 is fixed on the back surface of the main head holding member 102 in a manner straddling the flange opening 102*a* by its both end portions in a longitudinal direction. The sub head holding member 103 is fixed on the main head holding member 102 by two holding member screws 108 engaging with screw holes which are formed on the main head holding member 102 in a manner going through holes formed on the sub head holding member 103.

The sub head holding member 103 is made of stainless steel and the like and is formed to be a nearly rectangular flat plate. On the sub head holding member 103, a head body opening 103*d* having a square shape is formed. The head body 74 of the droplet discharge head 17 is inserted through the center of the head body opening 103*d*. As described above, the sub head holding member 103 is set on the back surface of the main head holding member 102 in a manner straddling the flange opening 102*a*. On the other hand, the droplet discharge head 17 is set from a front surface side of the main head holding member 102 in such a manner that the head body 74 is inserted through the head body opening 103*d* so as to protrude from the back surface of the sub head holding member 103. The droplet discharge head 17 is fixed on the sub head holding member 103 by two head fixing screws 107 engaging with the screw holes 79*a* (refer to FIG. 3) formed on the flange part 79 (refer to FIG. 3) in a manner going through holes formed on the sub head holding member 103.

At the periphery of the head body opening 103*d* of the sub head holding member 103, a first adjustment hole 103*a* and a second adjustment hole 103*b* are formed on a center line of two through holes corresponding to the screw holes 79*a* described above and the head body opening 103*d*. At the first adjustment hole 103*a* and the second adjustment hole 103*b*, an adjustment pin for compensation of a position is engaged.

On outer sides of the first adjustment hole 103*a* and the second adjustment hole 103*b* on the center line of the head body opening 103*d*, adhesive holes 103*c* are formed in a nearly symmetrical manner about the head body opening 103*d*. Each of the adhesive holes 103*c* is an elongate hole elongated in a transverse direction. An adhesive (not shown) is poured into the adhesive holes 103*c* so as to fix the sub head holding member 103 on the main head holding member 102 by the adhesive.

Two pieces of temperature adjustment units 110 are attached to one droplet discharge head 17. The temperature adjustment units 110 are fixed along an outer surface extending in an extending direction of the nozzle row 78A (refer to FIG. 3) of the droplet discharge head 17 of the head body 74.

As shown in FIG. 19D, the temperature adjustment unit 110 includes a temperature adjustment element 111 and a terminal substrate 112. The terminal substrate 112 is composed of a base film 116, a heat-transfer pattern 114, and a cover film 117 that are layered in a manner interposing the heat-transfer pattern 114 between the base film 116 and the cover film 117. The base film 116 and the cover film 117 are made of a flexible material such as polyimide. The heat-transfer pattern 114 is made of a material having high thermal conductivity such as copper and formed to be a foil or a thin plate which is deformable.

A part, which is not covered by the cover film 117 so as to be exposed, of the heat-transfer pattern 114 is bonded to an outer wall of the head body 74 of the droplet discharge head 17 by an adhesive made of a material having high thermal conductivity. The temperature adjustment element 111 is fixed on a part, which is exposed at the opening part 116*a* of the base film 116 shown in FIG. 19E, of the heat-transfer pattern 114. The temperature adjustment element 111 is electrically coupled to a discharge device controlling part 306 (refer to FIG. 20) by a flexible flat cable (FFC) (not shown). A control signal is sent from the discharge device controlling part 306 to the temperature adjustment element 111 through the FFC so as to control the temperature of the temperature adjustment element 111.

Through the heat-transfer pattern 114 of the terminal substrate 112 which is fixed to the temperature adjustment element 111, the temperature adjustment element 111 conducts thermal energy to the outer wall of the head body 74 of the droplet discharge head 17 to which the heat-transfer pattern 114 is bonded, or draws the thermal energy from the droplet discharge head 17. Thus, the temperature of the droplet discharge head 17 is adjusted. As described with reference to FIG. 3, the pressure chamber 158 is formed inside the outer wall of the head body 74. Therefore, the temperature of the pressure chamber 158, the temperature of a part, which faces the pressure chamber 158, of the nozzle plate 76, and the temperature of the functional liquid in the pressure chamber 158 are adjusted by adjusting the temperature of the outer wall. As the temperature adjustment element 111, Peltier element is used, for example. Peltier element functions as a heating element or a cooling element only by changing polarity of applied voltage.

As shown in FIG. 19E, the heat-transfer pattern 114 includes a heat-transfer base 114*a* and a terminal part 114*b*. At the boundary between the heat-transfer base 114*a* and the terminal part 114*b*, a plurality of adjustment holes 115 are formed.

One surface of the heat-transfer base 114*a* is covered by the cover film 117. The other surface is covered by the base film 116 at its periphery and a part corresponding to the opening part 116*a* of the base film 116 is exposed. To the exposed part of the heat-transfer base 114*a*, the temperature adjustment element 111 is coupled in a heat conductive manner.

One surface of the terminal part 114*b* is covered by the base film 116 together with the heat-transfer base 114*a*. The other surface is covered by the cover film 117 from the heat-transfer base 114*a* to an intermediate part of the adjustment holes 115, exposing the terminal part 114*b*. The terminal part 114*b* that is exposed is coupled to the outer wall of the head body 74 in a heat conductive manner.

In each of the plurality of adjustment holes 115 formed at the boundary between the heat-transfer base 114*a* and the terminal part 114*b*, the width of the boundary between the heat-transfer base 114*a* and the terminal part 114*b*, and an arrangement of a part at which the heat-transfer base 114*a* and the terminal part 114*b* are connected can be adjusted by changing the width of the adjustment hole 115. By adjusting the arrangement of the part at which the heat-transfer base 114*a* and the terminal part 114*b* are connected, an amount of traveling heat per unit of time can be changed in an alignment direction of the discharge nozzles of the nozzle row.

Electrical Structure of Droplet Discharge Device

Figure 20:
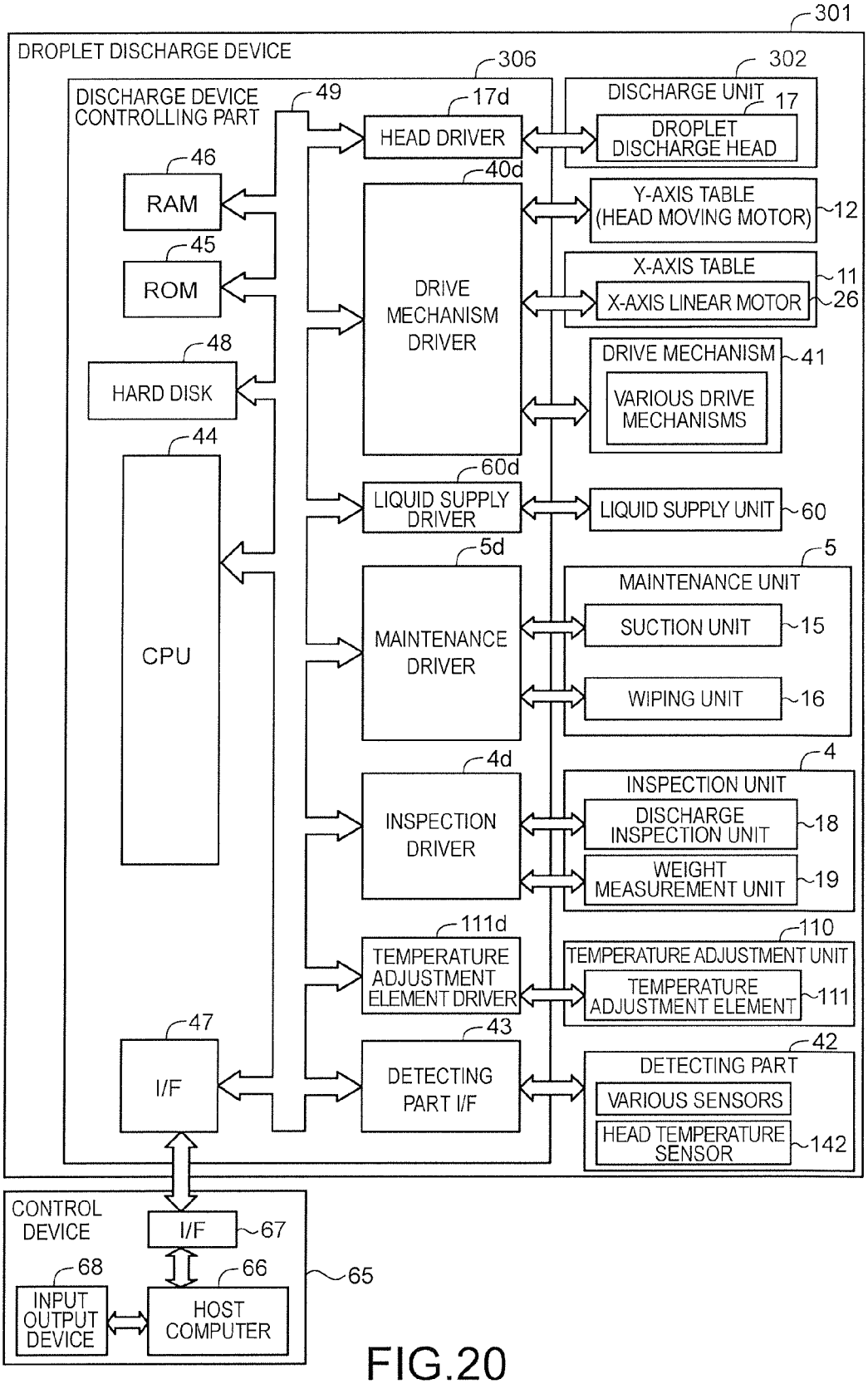
FIG. 20 is an electrical structure block diagram showing an electrical structure of a droplet discharge device.

An electrical structure for driving the droplet discharge device 301 having the above-mentioned structure will be described with reference to FIG. 20. FIG. 20 is a block diagram showing an electrical structure of a droplet discharge device. The droplet discharge device 301 is controlled by an application of data or an application of a controlling command of start or stop of an operation through the controlling device 65, as is the case with the droplet discharge device 1 of the first embodiment.

As shown in FIG. 20, a discharge device controlling part 306 of the droplet discharge device 301 includes a temperature adjustment element driver 111*d* and other components that are basically same structures as those of components of the discharge device controlling part 6 of the droplet discharge device 1.

To the temperature adjustment element driver 111*d*, the temperature adjustment element 111 of the temperature adjustment unit 110 is coupled. The temperature adjustment element driver 111*d* drives the temperature adjustment element 111 in accordance with a control signal from the CPU 44 so as to adjust the temperature of the droplet discharge head 17.

To the detecting part interface 43, the detecting part 42 including various sensors such as a head temperature sensor 142 for measuring the temperature of the droplet discharge head 17 is coupled. Detected information detected by each of the sensors of the detecting part 42 is transferred to the CPU 44 through the detecting part interface 43.

Arrangement of Functional Liquid

Figure 21:
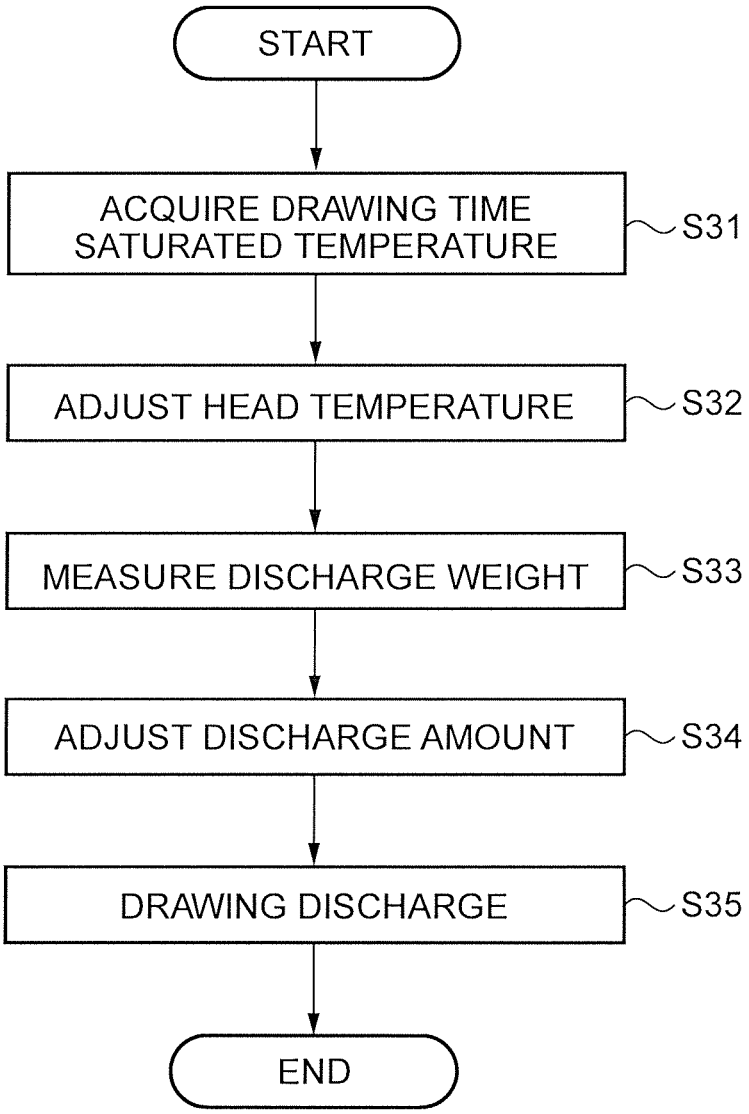
FIG. 21 is a flow chart showing a process of arranging a functional liquid.

A process of arranging the functional liquid will be described with reference to FIG. 21. In the process, the functional liquid is arranged on the filter film regions 225 of the CF layer 208 and the like on the mother counter substrate 201A by discharging the functional liquid from the droplet discharge head 17 of the droplet discharge device 301. FIG. 21 is a flow chart showing the process of arranging the functional liquid.

In a step S31 shown in FIG. 21, a drawing time saturated temperature that is obtained in advance is acquired. When the functional liquid is discharged toward the mother counter substrate 201A and the like from the droplet discharge head 17 of the droplet discharge device 301, that is, the drawing discharge is executed, the temperature of the head 17 is changed due to driving of the head 17. Then, the temperature becomes nearly constant by continuing the driving of the head 17 for the drawing discharge. This temperature is the drawing time saturated temperature. Data of the drawing time saturated temperature of each of 120 nozzle rows 78A formed in the discharge unit 302 is individually acquired. The nozzle rows 78A in this case correspond to nozzle groups.

Here, as the temperature of the droplet discharge head 17, a temperature of such a part of the droplet discharge head 17 is used that the temperature of the part can be measured by relating variation of the temperature of the part to variation of the weight of a droplet discharged from the droplet discharge head 17. For example, a temperature of a part, to which the terminal substrate 112 does not contact, of an outer wall surface of the pump part 75, a temperature of the nozzle plate 76, a temperature of a part, which constitutes the pressure chamber 158, of the vibrating plate 152, and the like can be used.

The temperature of the outer wall surface of the pump part 75 and the temperature of the part, constituting the pressure chamber 158, of the vibrating plate 152 can be measured by disposing a head temperature sensor on these parts. Alternatively, the temperature of the part, constituting the pressure chamber 158, of the vibrating plate 152 can be measured by using the piezoelectric material of the piezoelectric element 159 as a temperature sensor. Further, the temperature of an outer wall surface of the droplet discharge head 75 and that of the nozzle plate 76 can be measured from a removed position by using a contactless infrared temperature sensor.

The discharge device controlling part 306 receives the drawing time saturated temperature from the input output device 68 of the controlling device 65, for example, and stored the temperature in the RAM 46 or the hard disk 48 thereof. The input output device 68 of the controlling device 65 and the like correspond to a temperature acquisition unit.

A head temperature of the droplet discharge head 17 is adjusted in a step S32. As described above, the temperature of the droplet discharge head 17 can be adjusted by controlling the temperature of the temperature adjustment element 111 of the temperature adjustment unit 110 by the discharge device controlling part 306. The temperature of the head 17 is adjusted to the drawing time saturated temperature by using the temperature adjustment unit 110.

In specific, a relation between the temperature of a part, of which the temperature is the drawing time saturated temperature of the head temperature of the droplet discharge head 17, and the temperature of the temperature adjustment element 111 is obtained in advance so as to form a table of the temperature relation between the head temperature and the temperature adjustment element 111 and store the table in the RAM 46 or the hard disk 48 of the discharge device controlling part 306. Then, the drawing time saturated temperature that is inputted in the step S31 is referred to the table of the temperature relation so as to obtain a temperature of the temperature adjustment element 111 corresponding to the drawing time saturated temperature. Subsequently, the temperature of the temperature adjustment element 111 is adjusted to a temperature corresponding to the drawing time saturated temperature that is obtained.

As described above, two temperature adjustment units 110 are disposed to one droplet discharge head 17, and each of the temperature adjustment units 110 is fixed along the nozzle row 78A of the droplet discharge head 17. Therefore, the temperature can be adjusted in each nozzle row 78A by using the temperature adjustment unit 110. Drawing time saturated temperatures are individually obtained for 120 rows of the nozzle rows 78A of the discharge unit 302. Temperatures corresponding to individual drawing time saturated temperatures of the 120 rows of the nozzle rows 78A included in the discharge unit 302 are used as the temperature of the temperature adjustment element 111 corresponding to the drawing time saturated temperature.

The discharge device controlling part 306 and the temperature adjustment unit 110 correspond to a temperature adjustment unit and also correspond to a heating unit and a cooling unit.

In a step S33, discharge weight measurement is executed. In accordance with the start of the weight measurement, the X-axis second slider 23 is moved in the X-axis direction by the X-axis linear motor 26, and the head unit 354 is moved in the Y-axis direction by the Y-axis linear motor. By this operation, the liquid receiving container 94 of each of the weight measurement devices 91 fixed on the X-axis second slider 23 is allowed to face a first droplet discharge head 17 of each of the head groups 55 of the head unit 354.

Weight measurement discharge is executed with respect to each liquid receiving container 94 from all nozzles in one nozzle row 78A of the first droplet discharge head 17 of each of the head groups 55. At this time, second and third droplet discharge heads 17 of each of the head groups 55 face the weight measurement time flashing box 95 and perform discarding discharge to the weight measurement time flashing box 95. After the weight measurement discharge of the predetermined amount is ended, the electronic balance 99 measures the weight of discharged droplets that land on the liquid receiving container 94.

The discharge weight measurement of the head groups 55 is executed by individually measuring discharge weight of the six nozzle rows 78A of three droplet discharge heads 17 included in the head groups 55. As described above, the droplet discharge device 301 includes 10 pieces of the head units 354 having two head groups 55 and 10 pieces of weight measurement blocks 91A having two pieces of the weight measurement units 19. By executing the discharge weight measurement of the six nozzle rows 78A in one head group 55 by one weight measurement unit 19, the discharge weight measurement of the 120 rows of the nozzle rows 78A included in the droplet discharge device 301 can be executed. The weight measurement unit 19 provided with the weight measurement device 91 corresponds to a discharge amount measurement unit.

In a step S34, the discharge weight that is measured in the step S33 is compared with a specified discharge weight and the discharge amount is adjusted so as to correspond to the mismatched amount from the specified discharge weight. The discharge amount can be adjusted by changing a voltage value (drive voltage) of high potential in a driving waveform of a drive signal that is applied to the piezoelectric element 159 and thus adjusting the amount of the functional liquid to be filled in the pressure chamber 158, as described above with reference to FIGS. 9A and 9B. Alternatively, the discharge amount can be adjusted by adjusting time of the step-down discharge step and a voltage value of low potential, or by adjusting time of the step-up liquid supply step or time of the waiting state before discharge.

The discharge amount is adjusted for each of the 120 rows of the nozzle rows 78A of the discharge unit 302. The drive voltage value of the drive signal that is applied to the droplet discharge head 17 from the head driver 17*d* is adjusted by the CPU 44 that is controlled by a program stored in the ROM 45 and the like. The CPU 44 of this case corresponds to a discharge amount adjustment unit.

In a step S35, the functional liquid is discharged from the droplet discharge head 17 of which the discharge amount is adjusted in the step S34 toward the filter film regions 225 and the like, that is, the drawing discharge is executed.

After the execution of the drawing discharge of the step S35, the process of arranging the functional liquid is ended.

Here, when a processing object such as the mother counter substrate 201A after the execution of the drawing discharge is exchanged with a new processing object, the droplet discharge head 17 is in a resting state. Therefore, the temperature of the head 17 in the execution of the drawing discharge may not be maintained. Therefore, in a case where the head 17 rests, for example, during the exchange of processing objects in the drawing discharge, it is preferable that the temperature adjustment unit 110 is operated so as to execute the temperature adjustment of the head 17.

Figure 22A:
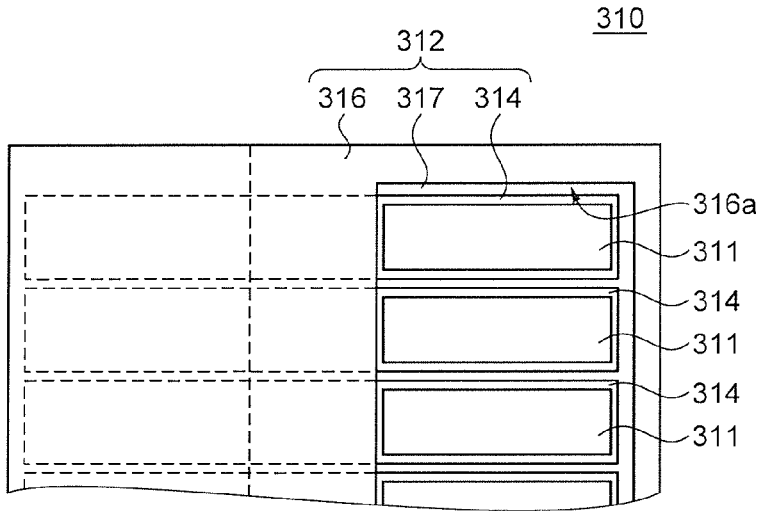
FIG. 22A is a plan view showing a terminal substrate of a temperature adjustment unit.
Figure 22B:
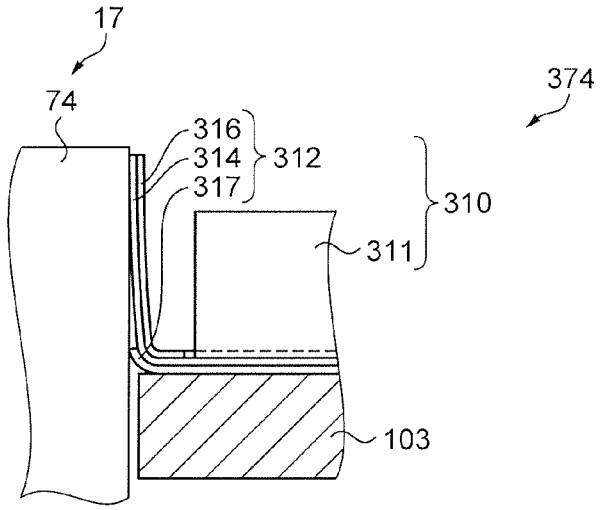
FIG. 22B is a lateral view showing the droplet discharge head and the temperature adjustment unit attached to the carriage plate.
Figure 22C:
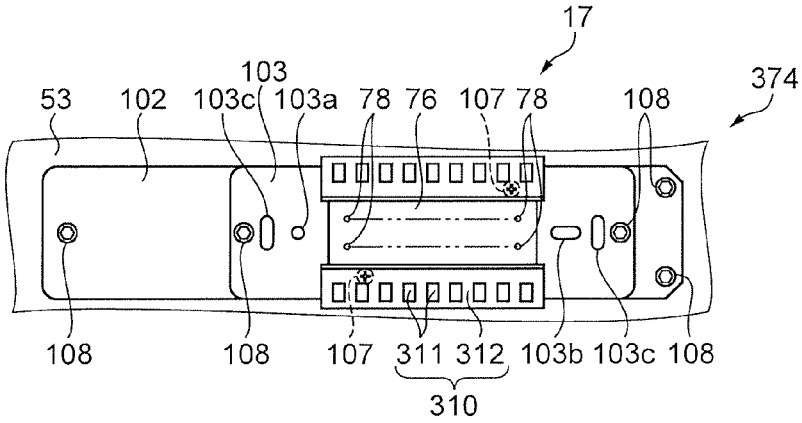
FIG. 22C is a plan view showing the droplet discharge head and the temperature adjustment unit attached to the carriage plate when viewed from a nozzle plate side.

Other Temperature Adjustment Units and Attachment of Other Temperature Adjustment Units A structure of a temperature adjustment unit 310 that is different from the temperature adjustment unit 110, and an attachment structure of the droplet discharge head 17 to the carriage plate 53 and that of the temperature adjustment unit 310 in a head unit 374 having the temperature adjustment unit 310 will be described with reference to FIGS. 22A to 22C. FIGS. 22A to 22C are diagrams showing a structure of a temperature adjustment unit, and an attachment structure of a droplet discharge head and the temperature adjustment unit to a carriage plate. FIG. 22A is a plan view showing a terminal substrate of the temperature adjustment unit. FIG. 22B is a lateral view showing the droplet discharge head and the temperature adjustment unit attached to the carriage plate. FIG. 22C is a plan view showing the droplet discharge head and the temperature adjustment unit attached to the carriage plate when viewed from a nozzle plate side.

As shown in FIGS. 20A and 20B, the temperature adjustment unit 310 includes a temperature adjustment element 311 and a terminal substrate 312. The terminal substrate 312 is composed of a base film 316, a heat-transfer pattern 314, and a cover film 317 that are layered in a manner interposing the heat-transfer pattern 314 between the base film 316 and the cover film 317. The base film 116 and the cover film 317 are made of a flexible material such as polyimide. The heat-transfer pattern 314 is made of a material having high thermal conductivity such as copper and formed to have a deformable shape.

A part, which is not covered by the cover film 317 so as to be exposed, of the heat-transfer pattern 314 is bonded to an outer wall of the head body 74 of the droplet discharge head 17 by an adhesive made of a material having high thermal conductivity. On a part, which is exposed at an opening part 316*a* of the base film 316, of the heat-transfer pattern 314, the temperature adjustment element 311 is bonded and fixed by an adhesive made of a material having high thermal conductivity. The terminal substrate 312 has a plurality of the heat-transfer patterns 314, and the temperature adjustment element 311 is fixed on each of the heat-transfer patterns 314.

The temperature adjustment element 311 is electrically coupled to a discharge device controlling part similar to the discharge device controlling part 306 (refer to FIG. 20) as is the case with the temperature adjustment element 111 by a flexible flat cable (not shown), and thus the temperature thereof is controlled by the discharge device controlling part. Temperatures of a plurality of the temperature adjustment elements 311 are individually controlled.

The discharge device controlling part and the temperature adjustment unit 310 correspond to a temperature adjustment unit and also correspond to a heating unit and a cooling unit.

The temperature adjustment element 311 adjusts the temperature of the heat-transfer pattern 314, to which the temperature adjustment element 311 is fixed, so as to adjust the temperature of the outer wall of the head body 74 on which the heat-transfer pattern 314 is bonded. As described with reference to FIG. 3, the pressure chamber 158 is formed inside the outer wall of the head body 74. Therefore, the temperature of the pressure chamber 158, the temperature of a part, which faces the pressure chamber 158, of the nozzle plate 76, and the temperature of the functional liquid in the pressure chamber 158 are adjusted by adjusting the temperature of the outer wall.

As shown in FIG. 22C, attachment of the droplet discharge head 17 to the carriage plate 53 in the head unit 374 is same as that in the head unit 354 described with reference to FIGS. 19A to 19E.

Attachment of the temperature adjustment unit 310 to the carriage plate 53 in the head unit 374 is same as that of the temperature adjustment unit 110 to the carriage plate 53 in the head unit 354 described with reference to FIGS. 19A to 19E.

Electronic Apparatus

An electronic apparatus will be described with reference to FIG. 23. The electronic apparatus is an example of an object on which a functional liquid is arranged by the droplet discharge device 1 or the droplet discharge device 301 so as to form a functional film. This electronic apparatus according to the present embodiment is equipped with a liquid crystal display device such as the liquid crystal display panel 200 described in the first embodiment. The electronic apparatus according to the present embodiment will be illustrated in detail.

Figure 23:
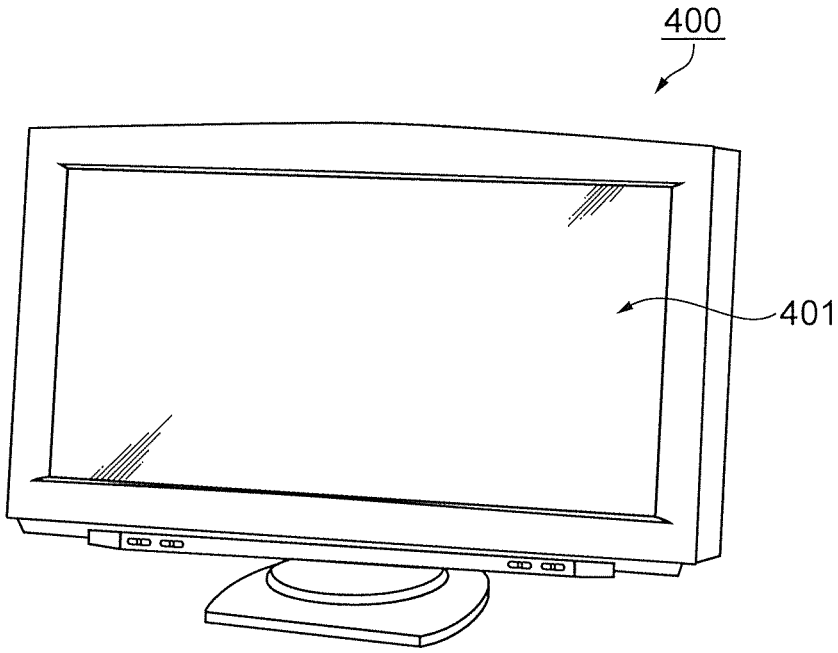
FIG. 23 is an external perspective view showing a large-sized liquid crystal television which is an example of an electronic apparatus.

FIG. 23 is an external perspective view showing a large-sized liquid crystal television which is an example of the electronic apparatus. As shown in FIG. 23, a large-sized liquid crystal television 400 which is an example of the electronic apparatus includes a display part 401. The display part 401 includes a liquid crystal display device such as the liquid crystal display device 200 described in the first embodiment as a display unit.

According to the second embodiment, the following advantageous effects are obtained in addition to the advantageous effects of the first embodiment.

(1) The head unit 354 and the head unit 374 respectively include the temperature adjustment unit 110 and the temperature adjustment unit 310. Therefore, the droplet discharge device 301 is capable of adjusting the temperature of the droplet discharge head 17 to a drawing time saturated temperature by using the temperature adjustment unit 110 or the temperature adjustment unit 310.

(2) Two pieces of the temperature adjustment units 110 and two pieces of the temperature adjustment units 310 are disposed for one droplet discharge head 17 having two nozzle rows 78A, and are fixed in a manner that the temperature of the outer wall nearly parallel with an extending direction of the nozzle rows 78A can be adjusted. With this structure, the temperature can be adjusted in each of the nozzle rows 78A by using the temperature adjustment unit 110 and the temperature adjustment unit 310.

(3) The terminal substrate 312 of the temperature adjustment unit 310 has the plurality of the heat-transfer patterns 314, and the temperature adjustment element 311 is fixed on each of the heat-transfer patterns 314. Therefore, the temperature is independently adjusted in each of the heat-transfer patterns 314. Accordingly, the temperature can be independently adjusted in individual discharge nozzles 78 or in a plurality of discharge nozzles 78 in a range corresponding to the heat-transfer pattern 314.

(4) The temperature adjustment unit 110 and the temperature adjustment unit 310 are respectively coupled through the terminal substrate 112 and the terminal substrate 312 that have flexibility to the droplet discharge head 17 in a heat conductive manner. Therefore, the temperature adjustment unit 110 and the temperature adjustment unit 310 are not necessarily positioned to the droplet discharge head 17 with high accuracy. Thus the temperature adjustment unit 110 and the temperature adjustment unit 310 can be easily attached to the head unit 354 and the head unit 374 respectively.

While the preferred embodiments are described with reference to the accompanying drawings, a preferred embodiment is not limited to the above embodiments. It should be understood that the invention is not limited to the above-mentioned embodiments, but can be applied to various modifications without departing from the scope and spirit of the invention.

The invention can be applied as follows.

(Modification 1)

In the above embodiments, a drawing time saturated temperature is obtained as a temperature, in a formation of a predetermined pattern, of the droplet discharge head 17 serving as the discharge unit so as to adjust the head temperature to the drawing time saturated temperature previous to the discharge weight measurement. However, an object for obtaining a temperature in a formation of a predetermined pattern and adjusting the temperature to the temperature in a formation of the predetermined pattern previous to the discharge weight measurement is not limited to the temperature of the discharge unit. A temperature of the droplet in a formation of a predetermined pattern may be obtained and the temperature of the droplet may be adjusted to the temperature in a formation of the predetermined pattern previous to the discharge weight measurement. If the temperature of the droplet varies, the viscosity of the droplet varies. The discharge amount (discharge weight) is influenced by the viscosity of the droplet that is discharged. The temperature of the droplet in the weight measurement is adjusted to the temperature of the droplet in a formation of the predetermined pattern, being able to suppress change of the discharge weight. The change of the discharge weight is caused by a difference between the temperature of the droplet in the weight measurement and the temperature of the droplet in a formation of the predetermined pattern. Accordingly, the discharge weight in a formation of the predetermined pattern can be properly duplicated in the weight measurement. Thus the discharge amount can be precisely measured.

(Modification 2)

In the above embodiments, obtaining the drawing time saturated temperature, adjustment of the temperature, measurement of the discharge weight, and adjustment of the discharge amount are performed in each of the nozzle rows 78A as the nozzle group. However, the nozzle group is not always the nozzle row 78A. Any group of discharge nozzles is applicable as long as variation of the discharge amount caused by variation of temperatures of the discharge nozzles that are included in the nozzle group does not influence characteristics of a functional film that is drawn. For example, the nozzle group may be a nozzle group composed of one kind of discharge nozzles that are included in one discharge head such as the droplet discharge head 17, or a nozzle group composed of discharge nozzles that discharge the same functional liquid such as the discharge nozzles 78 included in the red discharge head 17R and the like described with reference to FIG. 14. In a case where variation of the temperatures of the discharge nozzles is large, a single discharge nozzle may be a single nozzle group. While, in a case where variation of the temperatures of all of the discharge nozzles included in a liquid discharge device is small, all of the discharge nozzles included in the liquid discharge device may be a single nozzle group.

Here, the temperatures of the discharge nozzles are, in the droplet discharge head 17, for example, a temperature of the outer wall of the pressure chamber 158, a temperature at a periphery of the discharge nozzles 78 of the nozzle plate 76, a temperature of a part, constituting the pressure chamber 158, of the vibrating plate 152, and the like. Alternatively, the temperatures are a temperature of the functional liquid in the pressure chamber 158, a temperature of the functional liquid in the discharge nozzles 78, a temperature of the functional liquid about to be discharged or the functional liquid immediately after discharged from the discharge nozzles 78, and the like.

(Modification 3)

In the first embodiment, a drawing time saturated temperature is measured by the head temperature sensor 142. However, the drawing time saturated temperature need not to be actually measured as the temperature in a formation of a predetermined pattern. The drawing time saturated temperature may be obtained by estimation. The drawing time saturated temperature can be estimated in the same manner as the method in which the drawing time saturated temperature is obtained by estimating driving conditions of the warm-up drive described with reference to FIG. 18, for example.

As shown in FIG. 18C, if the drawing discharge is started at a time point S without performing warm-up drive, the temperature of the droplet discharge head 17 performing drawing discharge roughly settles at an approximate drawing time saturated temperature HM° C. after a certain time of drawing discharge, as the case shown in FIG. 18B.

When warm-up drive is performed at a drive voltage a that is a drive voltage of a % of a design drive voltage by which a proper discharge amount is obtained, the head temperature converges at Ha° C. and the head temperature at the time point S becomes Ha° C. When drawing discharge is started at the head temperature of Ha° C., the head temperature increases as a temperature increasing curve indicated by a0 in FIG. 18C and roughly settles at an approximate drawing time saturated temperature HM° C. A slope at the time point S in the curve a0 is referred to as a1.

When warm-up drive is performed at a drive voltage b that is a drive voltage of b % of a design drive voltage by which a proper discharge amount is obtained, the head temperature converges at Hb° C. and the head temperature at the time point S becomes Hb° C. When drawing discharge is started at the head temperature of Hb° C., the head temperature decreases as a temperature decreasing curve indicated by b0 in FIG. 18C and roughly settles at an approximate drawing time saturated temperature HM° C. A slope at the time point S in the curve b0 is referred to as b1.

As is the case with the method described with reference to FIG. 18D, a value of the temperature of the droplet discharge head 17 at a point on which a line passing a point (a, Ha) and a point (b, Hb) meets a horizontal axis of the graph, that is, a value in a case where a slope becomes 0 is obtained when the horizontal axis of the graph shows a temperature, which is converged after warm-up drive, of the droplet discharge head 17 and a vertical axis shows a slope. The obtained temperature is assumed as the drawing time saturated temperature. Whether the obtained temperature is the drawing time saturated temperature or not can be examined by adjusting the temperature of the droplet discharge head 17 to the obtained temperature and starting the drawing discharge. In a case where the obtained temperature is the drawing time saturated temperature, if drawing discharge is started at the obtained temperature, the temperature of the droplet discharge head 17 hardly varies during the drawing discharge. Thus, in a case where the temperature of the droplet discharge head 17 is roughly settled from the start of the drawing discharge, the temperature is the drawing time saturated temperature. In this case, the discharge device controlling part 6 that estimates the drawing time saturated temperature by controlling the driving conditions of the droplet discharge head 17 corresponds to a temperature acquisition unit.

(Modification 4)

In the above embodiments, a drawing time saturated temperature is obtained in advance, and the drawing time saturated temperature that is obtained in advance is acquired in the step of arranging the functional liquid. However, the drawing time saturated temperature need not to be obtained in advance as the temperature in a formation of a predetermined pattern. Instead of the step of acquiring the previously obtained temperature in a formation of a predetermined pattern, a step for acquiring a temperature in a formation of a predetermined pattern can be performed by measuring the temperature in a formation of the predetermined pattern or estimating temperature change from driving conditions of each nozzle performing drawing, a droplet discharge head, or a droplet discharge device including the nozzle and the head.

(Modification 5)

In the first embodiment, the driving conditions with which the temperature of the droplet discharge head 17 becomes the drawing time saturated temperature by performing the warm-up drive is obtained and the warm-up drive is executed under the obtained conditions. However, the driving conditions with which the temperature of the head 17 becomes the drawing time saturated temperature are not always required. The temperature of the head 17 may be measured by a temperature sensor such as the head temperature sensor 142 that measures the temperature of the head 17, while performing the warm-up drive, and then the warm-up drive may be controlled depending on the measured result. The head temperature sensor 142 in this case corresponds to a temperature measurement unit included in a temperature adjustment unit.

(Modification 6)

In the above embodiments, a drawing time saturated temperature of the droplet discharge head 17 is obtained, and the driving conditions of the warm-up drive by which the temperature of the head 17 becomes the drawing time saturated temperature is obtained by using the obtained drawing time saturated temperature as a reference. However, the drawing time saturated temperature need not be used as a reference. As is the case with Modification 2 described above, driving conditions by which the temperature of the head 17 becomes the drawing time saturated temperature may be estimated so as to be used as a reference. It may be assumed that the drawing time saturated temperature is achieved by performing the warm-up drive under the estimated driving conditions.

(Modification 7)

In the second embodiment, a drawing time saturated temperature is measured by the head temperature sensor 142. However, the drawing time saturated temperature need not to be actually measured as the temperature in a formation of a predetermined pattern. As the example described in Modification 3, the drawing time saturated temperature may be estimated. The drawing time saturated temperature can be estimated in the same manner as the method in which the drawing time saturated temperature is obtained by estimating driving conditions of the warm-up drive described with reference to FIG. 18, for example.

As shown in FIG. 18C, if the drawing discharge is started at a time point S without performing temperature adjustment, the temperature of the droplet discharge head 17 performing drawing discharge roughly settles at an approximate drawing time saturated temperature HM° C. after a certain time of drawing discharge, as the case shown in FIG. 18B.

For example, the temperature adjustment unit 110 is operated so as to heat or cool the temperature of the droplet discharge head 17 to Ha° C. As described above, when drawing discharge is started at the head temperature of Ha° C., the head temperature increases as a temperature increasing curve indicated by a0 in FIG. 18C and roughly settles at an approximate drawing time saturated temperature HM° C. A slope at the time point S in the curve a0 is referred to as a1.

In the same manner, the temperature adjustment unit 110 is operated so as to heat or cool the temperature of the droplet discharge head 17 to Hb° C. As described above, when drawing discharge is started at the head temperature of Hb° C., the head temperature decreases as a temperature decreasing curve indicated by b0 in FIG. 18C and roughly settles at an approximate drawing time saturated temperature HM° C. A slope at the time point S in the curve b0 is referred to as b1.

As is the case with the method described with reference to FIG. 18D, a value of the temperature of the droplet discharge head 17 at a point on which a line passing a point (a, Ha) and a point (b, Hb) meets a horizontal axis of the graph, that is, a value in a case where a slope becomes 0 is obtained when the horizontal axis of the graph shows a temperature, which is converged after warm-up drive, of the droplet discharge head 17 and a vertical axis shows a slope. The obtained temperature is assumed as the drawing time saturated temperature. Whether the obtained temperature is the drawing time saturated temperature or not can be examined by adjusting the temperature of the droplet discharge head 17 to the obtained temperature and starting the drawing discharge. In a case where the obtained temperature is the drawing time saturated temperature, if drawing discharge is started at the obtained temperature, the temperature of the droplet discharge head 17 hardly varies during the drawing discharge. Thus, in a case where the temperature of the droplet discharge head 17 is roughly settled from the start of the drawing discharge, the temperature is the drawing time saturated temperature. In this case, the discharge device controlling part 306 that estimates the drawing time saturated temperature by controlling the driving conditions of the droplet discharge head 17 corresponds to a temperature acquisition unit.

(Modification 8)

In the second embodiment, the temperature of the temperature adjustment element 111 is adjusted to a temperature corresponding to the drawing time saturated temperature, which is obtained in advance, of the droplet discharge head 17 so as to adjust the temperature of the head 17 to the drawing time saturated temperature. However, the temperature, corresponding to the drawing time saturated temperature of the head 17, of the temperature adjustment element 111 is not necessarily obtained. The temperature of the temperature adjustment element 111 may be controlled corresponding to a measured result of the temperature of the droplet discharge head 17. The measured result is obtained by measuring by a temperature sensor such as the head temperature sensor 142 that measures the temperature of the head 17. Since a measured value of the temperature of the head 17 is adjusted to the drawing time saturated temperature, the temperature of the head 17 can be adjusted to the drawing time saturated temperature with higher accuracy. The head temperature sensor 142 in this case corresponds to a temperature measurement unit included in a temperature adjustment unit.

(Modification 9)

In the above embodiments, the head temperature sensor 142 is, for example, a contact type temperature sensor, and contacts with either of the outer wall of the pump part 75, the nozzle plate 76, and the part, which constitutes the pressure chamber 158, of the vibrating plate 152 so as to measure either of the temperature of these. However, the head temperature sensor is not necessarily the contact type temperature sensor. The head temperature sensor may be a non-contact type infrared ray temperature sensor.

(Modification 10)

In the above embodiments, a drive voltage is specified as a driving condition of the warm-up drive. However, the drive voltage is not necessarily specified as the driving condition of the warm-up drive and adjusted for changing the driving condition. The discharge amount and the temperature of the droplet discharge head can be adjusted by changing various elements of the driving waveform described with reference to FIGS. 9A and 9B.

(Modification 11)

In the above embodiments, the droplet discharge device 1 and the droplet discharge device 301 include the weight measurement device 91 for measuring the weight of the functional liquid, which is discharged, as a device for measuring the discharge amount of the head 17. However, the discharge amount is not necessarily measured by measuring the discharge weight. For example, the discharge amount may be measured by obtaining a size or a volume of a droplet by an optical method. The discharge amount may be measured by obtaining a volume of a droplet by optically measuring a size of a flying droplet, a shape and a size of a droplet immediately after landing on an object, or a size of a droplet that lands and spreads on an object.

(Modification 12)

In the above embodiments, six pieces of the droplet discharge heads 17 are provided to the head unit 54 of the droplet discharge device 1 or the head unit 354 of the droplet discharge device 301. However, the number of the droplet discharge heads provided to the head unit is not limited to six. The head unit may be provided with any number of droplet discharge heads.

(Modification 13)

In the above embodiments, the droplet discharge device 1 as the droplet discharge device is provided with a pair of head units 54 and the droplet discharge device 301 is provided with a pair of head units 354. However, the liquid discharge device is not necessarily provided with a pair of head units. The liquid discharge device may be provided with any number of pairs of head units.

(Modification 14)

In the above embodiments, the heat-transfer pattern 114 and the heat-transfer pattern 314 as a heat-transfer member transferring heat between the temperature adjustment element 111 or the temperature adjustment element 311 and the droplet discharge head 17 are formed to have a shape of a substrate in which a metal material having a foil shape or a thin plate shape is sandwiched by films. However, the shape of the heat-transfer member is not limited to the shape of a substrate. The heat-transfer member may have any shape as long as the member can be brought into contact with the discharge head and transfer heat. The heat-transfer member may be made of any material as long as the material has high thermal conductivity.

(Modification 15)

In the above embodiments, the heat-transfer pattern 114 and the heat-transfer pattern 314 as a heat-transfer member transferring heat between the temperature adjustment element 111 or the temperature adjustment element 311 and the droplet discharge head 17 are formed to have a shape of a substrate in which a metal material having a foil shape or a thin plate shape is sandwiched by films. However, the heat-transfer member is not always a solid substance such as a metal. Heat may be transferred by circulating the droplet in a flowing path provided between the temperature adjustment element and the droplet discharge head.

(Modification 16)

In the above embodiments, the heat-transfer pattern 114 or the heat-transfer pattern 314 as the heat-transfer member for transferring heat between the temperature adjustment element 111 or the temperature adjustment element 311 and the droplet discharge head 17 is bonded to the outer wall of the head body 74 of the head 17 by an adhesive made of a material having high thermal conductivity. However, the adhesive is not necessarily used for fixing the heat-transfer member to the discharge head. Any fixing method may be employed as long as thermal conduction can be performed well. Further, any coupling method for coupling the temperature adjustment element and the heat-transfer member may be employed as long as thermal conduction can be performed well.

(Modification 17)

In the above embodiments, the drawing discharge by which the filter film 205 of the liquid crystal display panel 200 is formed is described. However, a film that is formed is not limited to the filter film. A film that is formed may be a pixel electrode film, an alignment film, or a counter electrode film of the liquid crystal display device, or an overcoat film formed to protect a color filter.

A device having a film to be formed, or a device in which a film needs to be formed in a forming process is not limited to the liquid crystal display device. The device may be any device as long as the device has the above-mentioned film or a device in which the above-mentioned film needs to be formed. For example, the device may be an organic EL display device. A functional film formed by the droplet discharge device in manufacturing the organic EL display device may be a positive electrode film or a negative electrode film of the organic EL display device, a film used in forming a pattern by photo-etching, or a photo-resist film for photo-etching.

(Modification 18)

In the above embodiments, the liquid crystal display panel 200, which is an example of the electrooptical device, provided with a color filter is described as an example of a drawing object on which the drawing is performed by arranging the functional liquid by the droplet discharge device 1. The wiring substrate 270 having wirings made of a conductive material is described as a drawing object. However, the drawing object is not limited to the electrooptical device or the wiring substrate. The liquid discharge device and the liquid discharging method described above may be used as a manufacturing device and as a manufacturing method for disposing various functional liquids so as to perform various processes on various processing objects. For example, the liquid discharge method and the liquid discharge device may be used as respectively a method and a device for processing a semiconductor wafer and a wiring conducting layer of a semiconductor device on which liquid conductive material is discharged, or may be used as respectively a method and a device for processing a semiconductor wafer and an insulating layer of a semiconductor device on which a liquid insulation material is discharged.

(Modification 19)

In the above embodiments, the CF layer 208 provided on the liquid crystal display panel 200 is a three-color filter having filter films of three colors, i.e., the red filter film 205R, the green filter film 205G, and the blue filter film 205B. However, the color filter may be a multiple-color filter having more kinds of filter films. The multiple-color filter is a six-color filter, a four-color filter, and the like, for example. The six-color filter includes organic EL elements of cyan, magenta, and yellow which are complementary colors of red, green, and blue as well as organic EL elements of red, green, and blue. The four-color filter includes an element of green as well as elements of cyan, magenta, and yellow.

(Modification 20)

In the above embodiments, the filter film region 225 serving as a film forming section, a functional film section, or a color element region has a rectangular shape. However, the film forming section, the functional film section, or the color element region is not necessarily rectangular. A display device of which a pixel shape is different from a rectangular shape has been designed recently so as to improve a display characteristic. The film forming section, the functional film section, or the color element region may have a shape in which a pixel having a different shape from a rectangle can be formed.

(Modification 21)

In the above embodiments, in a single film forming region, a single function film region, or a single filter region film, the filter film regions 225 serving as the film forming sections, the functional film sections, or the color element regions have the same size and the same shape as each other. However, the film forming sections, the functional film sections, or the color element regions do not necessarily have the uniform size in a single film forming region, a single functional film region, or a single filter film region. For example, the film forming region, the functional film region, or the filter region film may have film forming sections, functional film sections, or color element regions having different sizes from each other, such that color elements constituting a minimum unit of display in a four-color filter have different sizes from each other so as to correspond to a characteristic of a light source, for example.

(Modification 22)

In the above embodiments, the droplet discharge device 1 and the droplet discharge device 301 move the work placing board 21, on which the mother counter substrate 201A and the like are placed, in the main scanning direction, and at the same time discharges the functional liquid from the droplet discharge head 17 so as to arrange the functional liquid. Further, the device 1 and the device 301 respectively move the head unit 54 and the head unit 354 in the sub-scanning direction so as to position the droplet discharge head 17 (discharge nozzles 78) to the mother counter substrate 201A and the like. However, the device 1 and the device 301 do not necessarily perform the relative move between the droplet discharge head as an arranging head and the mother substrate in the main-scanning direction by moving the mother substrate, or perform a relative move in the sub-scanning direction by moving the discharge head.

The relative move between the discharge head and the mother substrate in the main-scanning direction may be performed by moving the discharge head in the main-scanning direction. The relative move between the discharge head and the mother substrate in the sub-scanning direction may be performed by moving the mother substrate in the sub-scanning direction. Alternatively, the relative move between the discharge head and the mother substrate in the main-scanning direction and the sub-scanning direction may be performed by moving one of the discharge head and the mother substrate in the main-scanning direction and the sub-scanning direction, or may be performed by moving both of the discharge head and the mother substrate in the main-scanning direction and the sub-scanning direction.

(Modification 23)

In the above embodiments, the droplet discharge device 1 and the droplet discharge device 301 provided with the ink-jet type droplet discharge head 17 are illustrated as the droplet discharge device that arranges a functional liquid on the mother counter substrate 201A and the like. However, the droplet discharge device is not necessarily the droplet discharge device. The droplet discharge device may be a discharge device having a dispenser, for example. In a case where a large amount of a film material needs to be arranged on a large sized film forming section, a dispenser of which the discharge amount per unit time is larger than that of the droplet discharge head is useful.

The entire disclosure of Japanese Patent Application No. 2008-139051, filed May 28, 2008 is expressly incorporated by reference herein.

What is claimed is:

1. A droplet discharge device comprising:

a discharge unit discharging a droplet and being moved relatively to a discharged object, on which the droplet is discharged, so as to form a predetermined pattern on the discharged object;

a discharge amount measurement unit measuring a discharge amount of the droplet discharged from the discharge unit;

a temperature acquisition unit acquiring a temperature in the formation of the predetermined pattern, of the droplet;

a temperature adjustment unit adjusting the temperature of the droplet; and a discharge amount adjustment unit adjusting the discharge amount of the discharge unit, wherein the temperature adjustment unit adjusts a temperature of the droplet in the measurement of the discharge amount by the discharge amount measurement unit so that the temperature of the droplet in the measurement of the discharge amount matches the temperature of the droplet in the formation of the predetermined pattern.

2. The droplet discharge device according to claim 1, wherein the discharge unit includes a plurality of nozzle groups each having one or more discharge nozzles;

the discharge amount measurement unit measures the discharge amount of the droplet at each of the nozzle groups;

the temperature acquisition unit acquires a temperature of the droplet in the formation of the predetermined pattern at each of the nozzle groups;

the temperature adjustment unit adjusts the temperature of the droplet at each of the nozzle groups; and the discharge amount adjustment unit adjusts a discharge amount of each of the nozzle groups.

3. The droplet discharge device according to claim 2, wherein the nozzle groups have a common path for supplying the droplet to each of the discharge nozzles of the discharge groups.

4. The droplet discharge device according to claim 2, wherein the nozzle groups are composed of discharge nozzles provided to one discharge head having the one or more discharge nozzles.

5. The droplet discharge device according to claim 2, wherein a single kind of the droplet is supplied to each of the discharge nozzles of the discharge groups.

6. The droplet discharge device according to claim 1, wherein the temperature adjustment unit adjusts the temperature of the droplet to the temperature in the formation of the predetermined pattern by warm-up driving the discharge unit.

7. The droplet discharge device according to claim 6, wherein the temperature acquisition unit performs the warm-up drive under two or more kinds of warm-up drive conditions of the warm-up drive so as to estimate a temperature in the formation of the predetermined pattern.

8. The droplet discharge device according to claim 6, further comprising:

a warm-up condition setting unit obtaining a warm-up condition of the warm-up drive, wherein the warm-up condition setting unit performs the warm-up drive under two or more different kinds of warm-up drive conditions so as to estimate the warm-up drive condition under which the temperature of the droplet becomes the temperature in the formation of the predetermined pattern by performing the warm-up drive.

9. The droplet discharge device according to claim 6, wherein the temperature adjustment unit further includes a first temperature measurement unit measuring the temperature of the droplet, and adjusts the temperature of the droplet to the temperature in the formation of the predetermined pattern by allowing the discharge unit to perform the warm-up drive depending on a measured result of the first temperature measurement unit.

10. The droplet discharge device according to claim 1, wherein the temperature adjustment unit is one of a heating unit and a cooling unit, and adjusts the temperature of the droplet to the temperature in the formation of the predetermined pattern by heating or cooling the droplet.

11. The droplet discharge device according to claim 10, wherein the temperature acquisition unit adjusts the temperature of the droplet at a starting time of the formation of the predetermined pattern to two or more different kinds of temperatures, and estimates the temperature in the formation of the predetermined pattern based on a temperature change in the formation of the predetermined pattern in each case of the different kinds of temperatures.

12. The droplet discharge device according to claim 10, wherein the temperature adjustment unit further includes a second temperature measurement unit measuring the temperature of the droplet, and one of the heating unit and the cooling unit heats or cools the droplet depending on a measured result of the second temperature measurement unit so as to adjust the temperature of the droplet to the temperature in the formation of the predetermined pattern.

13. A droplet discharge method by which a discharge unit discharging a droplet is relatively moved to a discharged object on which the droplet is discharged, so as to form a predetermined pattern on the discharged object, comprising:

a) acquiring a temperature of the droplet in the formation of the predetermined pattern;

b) adjusting the temperature of the droplet;

c) measuring a discharge amount of the droplet discharged from the discharge unit; and d) adjusting the discharge amount of the discharge unit, wherein in the step b), a temperature of the droplet in performing the step c) is adjusted so that the temperature of the droplet in performing the step c) matches the temperature of the droplet in the formation of the predetermined pattern.

14. The droplet discharge method according to claim 13, wherein the discharge unit includes a plurality of nozzle groups each having one or more discharge nozzles;

a temperature of the droplet in the formation of the predetermined pattern is acquired at each of the nozzle groups in step a);

the temperature of the droplet is adjusted at each of the nozzle groups in the step b);

the discharge amount of the droplet is measured at each of the nozzle groups in the step c); and a discharge amount in each of the nozzle groups is adjusted in the step d).

15. The droplet discharge method according to claim 14, wherein the nozzle groups have a common path for supplying the droplet to each of the discharge nozzles of the discharge groups.

16. The droplet discharge method according to claim 14, wherein the discharge nozzles of the nozzle groups are discharge nozzles provided to one discharge head having one or more discharge nozzles.

17. The droplet discharge method according to claim 15, wherein a single kind of the droplet is supplied to each of the discharge nozzles of the discharge groups.

18. The droplet discharge method according to claim 13, wherein the temperature of the droplet is adjusted to the temperature in the formation of the predetermined pattern by warm-up driving the discharge unit, in the step b).

19. The droplet discharge method according to claim 13, wherein the step a) includes e) forming the predetermined pattern after the warm-up drive is performed under a first warm-up drive condition, and f) forming the predetermined pattern after the warm-up drive is performed under a second warm-up drive condition that is different from the first warm-up drive condition, and the temperature in the formation of the predetermined pattern is estimated depending on a temperature change of the droplet in the formation of the predetermined pattern in each of the step e) and the step f).

20. The droplet discharge method according to claim 18, further comprising:

g) setting a warm-up drive condition of the warm-up drive, wherein the step g) includes h) forming the predetermined pattern after the warm-up drive is performed under a first warm-up drive condition;

i) forming the predetermined pattern after the warm-up drive is performed under a second warm-up drive condition that is different from the first warm-up drive condition; and j) estimating the warm-up drive condition under which the temperature of the droplet becomes the temperature in the formation of the predetermined pattern, based on a temperature change of the droplet in the formation of the predetermined pattern in each of the step h) and the step i).

21. The droplet discharge method according to claim 18, wherein the step b) further includes k) measuring the temperature of the droplet, and the discharge unit is warm-up driven depending on a measured result in the step k) so as to adjust the temperature of the droplet to the temperature in the formation of the predetermined pattern.

22. The droplet discharge method according to claim 13, wherein the temperature of the droplet is adjusted to the temperature in the formation of the predetermined pattern by heating or cooling the droplet, in the step b).

23. The droplet discharge method according to claim 22, wherein the temperature of the droplet at a starting time of the formation of the predetermined pattern is adjusted to two or more different kinds of temperatures, and the temperature in the formation of the predetermined pattern is estimated based on a temperature change in the formation of the predetermined pattern in each case of the temperatures, in the step a).

24. The droplet discharge method according to claim 23, wherein the step b) further includes l) measuring the temperature of the droplet, and the droplet is heated or cooled depending on a measured result of the step l) so as to adjust the temperature of the droplet to the temperature in the formation of the predetermined pattern.

* * * * *